US006034316A

United States Patent [19]

Hoover

[11] Patent Number: 6,034,316

[45] Date of Patent: Mar. 7, 2000

[54] CONTROLS FOR MUSICAL INSTRUMENT SUSTAINERS

[76] Inventor: Alan Anderson Hoover, 3937 Cranbrook Dr., Indianapolis, Ind. 46240

[21] Appl. No.: 09/258,251

[22] Filed: Feb. 25, 1999

[51] Int. Cl.[7] ..... G10H 1/057

[52] U.S. Cl. ..... 84/738; 84/DIG. 10

[58] Field of Search ..... 84/738, DIG. 10

[56] References Cited

U.S. PATENT DOCUMENTS

| | | |
|---|---|---|
| 472,019 | 3/1892 | Omhart . |
| 1,002,036 | 8/1911 | Clement . |
| 1,893,895 | 6/1933 | Hammond . |
| 2,001,723 | 5/1935 | Hammond . |
| 2,600,870 | 6/1952 | Hathaway et al. . |
| 2,672,781 | 3/1954 | Miessner . |
| 3,185,755 | 5/1965 | Williams et al. . |
| 3,571,480 | 3/1971 | Tichenor et al. . |
| 3,612,741 | 10/1971 | Marshall . |
| 3,742,113 | 6/1973 | Cohen . |
| 3,813,473 | 5/1974 | Terymenko . |
| 4,075,921 | 2/1978 | Heet . |
| 4,137,811 | 2/1979 | Kakehashi . |
| 4,181,058 | 1/1980 | Suenaga . |
| 4,236,433 | 12/1980 | Holland . |
| 4,243,575 | 1/1981 | Oliver . |
| 4,245,540 | 1/1981 | Groupp . |
| 4,248,120 | 2/1981 | Dickson . |
| 4,484,508 | 11/1984 | Nourney . |
| 4,697,491 | 10/1987 | Maloney . |
| 4,852,444 | 8/1989 | Hoover et al. . |
| 4,907,483 | 3/1990 | Rose et al. . |
| 4,941,388 | 7/1990 | Hoover et al. . |
| 5,031,501 | 7/1991 | Ashworth . |
| 5,050,759 | 9/1991 | Hoover et al. . |
| 5,054,361 | 10/1991 | Usa . |
| 5,123,324 | 6/1992 | Rose et al. . |
| 5,189,242 | 2/1993 | Usa . |
| 5,200,569 | 4/1993 | Moore . |
| 5,233,123 | 8/1993 | Rose et al. . |
| 5,275,586 | 1/1994 | Oba et al. . |
| 5,292,999 | 3/1994 | Tumura . |
| 5,378,850 | 1/1995 | Tumura . |
| 5,449,858 | 9/1995 | Menning et al. . |
| 5,523,526 | 6/1996 | Shattil . |
| 5,585,588 | 12/1996 | Tumura . |

OTHER PUBLICATIONS

NAMM Statistical Review of U.S. Music Products Industry, 1998 National Association of Music Merchants Publication, Carlsbad, CA.

(List continued on next page.)

*Primary Examiner*—Stanley J. Witkowski

[57] ABSTRACT

A sustainer is provided for prolonging the vibrations of strings of a stringed musical instrument. The instrument has at least one magnetic pickup means responsive to the vibrations of the strings. The pickup produces an output signal in response to the vibrations of the instrument strings. At least one control potentiometer provides the capability to control at least one parameter of the output signal. The sustainer comprises a string driver transducer capable of inducing vibrations in the strings, a sustainer amplifier having an input which accepts the pickup output signal, and an amplifier circuit which amplifies the pickup output signal to form a drive signal. The sustainer amplifier also has an output, from which the drive signal transfers sufficient energy to the string driver transducer to sustain the vibrations of the strings. A power supply provides electrical energy to the sustainer amplifier. A power switch provides connection and disconnection means between the power supply and the sustainer amplifier in response to actuation of the power switch in order to turn the sustainer on and off. The power switch is an integral part of the control potentiometer, where the two are a physical combination. Both switch and potentiometer are actuated by the shaft of the potentiometer. Furthermore, the appearance of the control potentiometer having the power switch as an integral part, when viewed from the outside of the musical instrument, is similar to that of the instrument containing the potentiometer without the power switch being present as the integral part of the potentiometer.

24 Claims, 24 Drawing Sheets

OTHER PUBLICATIONS

1998 Guitar and Bass Buyer's Guide, pp. 157–160, 162–169; Miller/Freeman, San Francisco, CA.
Electra Guitar info on internet: http://www.mindspring-.com/~ cantrells/electra.html 1999.
Gibson "Les Paul" and "SG" models from internet; http://www.gibson.com/products/gibson/ 1997.
Fender "Stratocaster" http://www.fender.com/ 1999.
1998 "Thoroughbred Music" catalog, pp. 2–22, various electric guitars including Gibson, Fender.
1998 "Thoroughbred Music" catalog, pp. 23–31, various effectors.
Widders–Ellis, Andy, "Four Fabulous D.I.Y. Pickup Tricks"; Guitar Player Magazine, Feb. 1993, pp. 98, 100, 102, 106, 153; Miller/Freeman, San Francisco, CA.
Integral Potentiometer.Switch Combintion; Stewart McDonals Guitar Supply catalog, Spring 1998, p. 63.
WD Music Products catalog, pp. 29 and contents; WD Music Products, Fr. Meyers, FL Jan. 1998.
Lindskold, Mike, "Guitar Wiring 101", Stewart McDonals Guitar Supply catalog, Spring 1998, p. 61.
Brosnac, Donald, Guitar Electronics For Musicians, Wise Publications, London, England various guitar wiring diagrams, use of integral switch/potentiometer combinations 1983.
1998 "Thoroughbred Music" catalog, p. 30, Heet "Ebow" sustainer.
Heet Ebow websight ad; http://www.ebow.com/brochure-.htm 1999.
Keibel, Jeff, "Albino Alligator", Internet article on "Infinite Guitar", invented by Michael Brook; http://www.dns.net/eyesore/html/interview/BrookMichael.AlbinoAlligator-Film.press.html 1997.
Internet article on Michael Brook and Infinite Guitar; http://web.inter.nl.net/users/K.vanBunningen/music/sylvian/others/brook.html 1997.
Intenet article on Michael Brook and Infinite Guitar; http://www.rolandca.com/reverb/e/cl–34.html 1999.
Lawrence, David; Guitar World Magazine, Jul., 1989; Kramer Floyd Rose Sustainer Solid–Body Guitar.
Jackson Guitar catalog, 1996, p. 16, showing Floyd Rose Sustainer in Jackson Guitar.
Ad showing Floyd Rose Sustainer in Kramer Guitar, Guitar Player Magazine, Jan. 1989, Miller/Freeman, San Francisco, CA.
Brochure, Audio Sound International, Indianapolis, IN, showing Sustainiac GA–2 sustainer, circa 1990.
Ad showing Sustainiac GA–2 Sustainer in Hamer Guitar, Guitar Player Magazine, circa 1990.
Article on Fernandes Sustainer; Guitar Player Magazine, Jan. 1989, Miller/Freeman, San Francisco, CA.
Fernandes Guitar Catalog, 1995, pp. inside cover, 1,2,3; Fernandes Guitars, No. Hollywood, CA also, see www-.fernandesguitars.com.
Sustainiac "Model B" sustainer brochure, Maniac Music, Inc. Indianapolis, IN 1989.
Sustainiac "Model B" sustainer Owner's Manual; Maniac Music, Inc. Indianapolis, IN 1989.
Advertisement, Sustainiac "Model B" sustainer, Guitar Player Magazine, Aug. 1987, Miller/Freeman, San Francisco, CA.

CONTROLS FOR MUSICAL INSTRUMENT SUSTAINERS

FIELD OF THE INVENTION

The present invention relates to vibration sustainers for stringed musical instruments which have one or more sustainer parts attached to the instrument, and to the controls of the sustainer.

BACKGROUND OF THE INVENTION

A sustainer for electric stringed musical instruments is sometimes considered to be a subclass of other electronic devices which modify the electric pickup signal of the instrument in order to enhance the sound which is heard from the instrument amplifier. These devices have been referred to as "electronic sound effect devices", otherwise simply called "effectors" or "effects" for musical instruments. They are widely used accessories for the creation of music with electric guitar. When examined more closely, however, a fundamental difference exists between sustainers and other effectors for stringed musical instruments: Other effector devices specifically modify the electrical signal produced by the instrument pickup. Then, this modified pickup signal is sent to the instrument amplifier. What the listener hears is this modified pickup signal. Conversely, sustainers split the pickup signal into two branches. One branch is sent to the instrument amplifier or other effects without any alteration other than standard volume and tone controls, which are basic functions of electric guitars. The other branch is sent to the sustainer, where the pickup signal is amplified and processed. Then, the amplified, processed signal is not sent to the instrument amplifier, but instead is sent to the string driver transducer. The transducer then converts the amplified electrical energy into vibrational energy which is imparted to the strings. This difference is important, and will be referred to frequently in the description which follows. Furthermore, the sustainer transducer must be attached to the instrument, or must be held in close proximity to the instrument strings in order for the sustainer to function properly.

These differences between sustainers and other effectors are crucial to the development of the present invention. They will be referred to frequently in the description which follows. First, however, it will be helpful to review effectors in general.

Electronic effectors for electric guitar have been available for about fifty years, ever since the invention of the electric guitar. Among the first electronic guitar effectors available were reverberation and tremolo devices. These early devices were sometimes included inside certain models of guitar amplifiers. Control of an early effector typically consisted of one or two potentiometers which were mounted onto the control panel of the amplifier, which were actuated by control knobs. Also, often one or more foot-actuated switches were mounted inside of a metal housing which was designed to sit on the floor, for convenient access by the musician in turning the effect on and off. The metal housing has come to be called a "floorbox", or the slang expression "stompbox". Eventually, with the advent of the transistor and other electronic miniature components, the entire effector evolved to be housed in floorboxes as accessories which sat on the floor, separate from the guitar amplifier. Additionally, several effector devices have been installed inside of production electric guitars, and also as retrofit items into existing instruments. Various switches and knobs have been used to control these in-guitar effectors, and are typically mounted onto the body of the instrument within easy reach of the musician.

At the present time, effector sales for electric guitar in the U.S. alone is approximately $86 million, with over 650,000 units being sold annually. These figures are according to the 1998 sales data published by NAMM, the National Association of Music Merchants. The data include only floorbox units having one or more effects contained within. Many different electronic effectors are currently available. The 1998 *Guitar and Bass Buyer's Guide,* published annually by Miller Freeman Publishing Company, San Francisco, Calif., lists seventy-one different manufacturers of electronic effectors for electric and acoustic guitar, and lists 470 different effector models. All of the effectors listed in that publication are similar in that they have one thing in common: They are inserted into the signal path of the guitar pickup signal. There, they change the tone or distortion characteristics of the pickup signal, or add time-delay effects such as echo and reverberation to the signal.

A fundamental requirement for the design and placement of the controls of effectors is that they be easily accessible to the musician, so as to enhance the creation of music. Turning the effector on and off during performance should not interfere with the musician in such a way as to impede playing movement of the hands. If the controls are hand-actuated, they must be placed near the playing position on the instrument so as to minimize actuation effort.

By far, most of the effector devices currently available are housed in floorboxes. These utilize foot-actuated switch controls to actuate the on/off switch for the effector. Sometimes they contain a foot-actuated potentiometer in order to modify a certain parameter, such as tone or modulation of a time delay. With modern-day miniaturization of electronic circuits, effector floorboxes can be made quite small. It has become standard practice for musicians to use several effector boxes simultaneously, connecting them in series in the signal path. Alternately, numerous "multi-effectors" exist which combine several electronic effector circuits into the one housing, having more than one foot-actuated control.

FIG. 1*a* shows, in perspective view, a typical popular effector with foot-actuated switch control. The effector, 100, is manufactured by ProCo Sound, of Kalamazoo, Mich. It is called "The Rat". Its function is to apply very high voltage gain to the pickup signal in order to overdrive an internal amplifier, thereby producing a large amount of distortion in the sound. Foot-actuated double-pole, double-throw switch 101 turns the effector on and off. FIG. 1*b* shows a schematic block diagram of certain parts of the effector circuit. Block 170 represents the actual internal circuit details of the effector, which are not shown.

A pickup output signal is applied to input connector 110, which is a common ¼ inch stereo phone jack, through plug 150, which is a common ¼ inch phone plug. The input signal enters the effector through the tip connection 154*d* of the plug, and connects to tip connection 114 of the jack. The input signal is applied to common terminal 106 of switch pole 101*a*. In the "on" position of switch 101, the incoming signal is applied to input terminal 174 of circuit 170 through terminal 107. The output signal of the effector passes from output terminal 176 of circuit 170 to tip terminal 122 of output jack 120. In the "off" position, the pickup signal bypasses the effect through signal path 180. When the effector is off, the input signal is applied directly to tip terminal 122 via signal path 180. Knob 102 is labeled "DISTORTION", and adjusts the amount of voltage gain of the internal circuit by varying the setting of an internal potentiometer 102*a*. Knob 103 is labeled "FILTER", and adjusts equalization via a variable filter which is varied by potentiometer 103*a*. The third knob 104, labeled "VOLUME", adjusts the effector output volume level via an internal potentiometer 104*a*. Typically, once the potentiometer settings are established, they are only occasionally reset at convenient intervals during performance.

Battery 160 is the power supply for the effector. Positive terminal 162 of battery 160 is connected to terminal 171 of effector circuit 170. Negative battery terminal 164 connects to ring terminal 114 of jack 110. The power supply circuit is completed when a standard monaural ¼ inch phone plug 150 is inserted into input jack 110. The shield terminal 152 of plug 150 connects to ring terminal of jack 110, shorting it to ground through shield terminal 118 of jack 110. This completes the electrical circuit and applies ground to terminal of 178 of circuit 170.

Many effectors have been designed to fit inside of electric guitars. This type of effector became popular for a time during the 1970's, when analog and digital electronic integrated circuit technology started to become a major industry. Then, for the first time, it became possible to design and to economically manufacture miniature electronic circuits of high complexity. Electronic effects could then be fit into an electric guitar of normal size, with minimal power consumption.

One example of "in-guitar" effectors is the "Electra" electric guitar, distributed during the 1970's by Saint Louis Music Company. This guitar featured two "MPC" (modular powered component) modules which were installed inside the instrument, which could be selected from a variety of available modules. Dedicated knobs and toggle switches, which were mounted to the top of the guitar body, were used to control the effector modules. The modules plugged into a custom connector inside the instrument.

The use of internal MPC effectors for the Electra guitar quickly peaked and has lost popularity. This could be because of the difficulty with keeping abreast of rapidly evolving technology of the effector product. Only a limited number of "MPC" modules were available, and only MPC modules fit into the custom connector of the Electra guitar. As a result, effector choices were limited. Most musicians preferred the flexibility of being able to choose from a wide variety of floorbox effectors, constantly evolving as technology progressed. Another factor which probably contributed to the mediocre success of in-guitar effectors is because the inclusion of in-guitar effectors necessitates the addition of switches and potentiometers on the front of the instrument body. This tends to clutter its appearance. The most popular electric guitars are those which have only a fundamental set of controls for volume and tone, plus a pickup selector switch. The "in-guitar" effector is still available, but is not nearly as popular as floorbox effectors. Most of the in-guitar effectors which are currently sold as retrofit items are enhancements of basic tone and volume control functions, as opposed to the more esoteric effectors which are available. None of the effectors listed in the 1998/1999 *Guitar/Bass Player's Guide* is an "in-guitar" effector.

Most electric guitars which have been manufactured since the invention of the electric guitar have basic function controls built into the body of the instrument. These are generally regarded as being basic to the operation of the instrument, and as such are not generally regarded as effectors. An inspection of the 1998 electric guitar catalogs of Fender Musical Instruments and Gibson Guitars, two world leaders in electric guitar sales, reveals that all of their listed models have only the following controls mounted to the body instruments: Volume controls, tone controls, and pickup selector switches. These are the controls which have become generally regarded as standard in the industry. Departures from this have not gained mass popularity. The volume controls are usually given "priority position" over the tone controls, as is evidenced by the fact that on most electric guitars a volume control is placed nearest the string-playing position. The pickup selector switch, which is used to select a particular pickup or combination of pickups in order to achieve the desired sound, is placed at a convenient position on the body of the instrument. These switches take numerous forms. Commonly used switch types are toggle, slide, and rotary multiple-position selector switches. The pickup selector switch has also withstood the test of time, and is present in nearly every electric guitar which has multiple pickups.

FIG. 2*a* shows in front plan view a popular electric guitar, 200, the well-known "Stratocaster®", manufactured by Fender Musical Instruments, Scottsdale, Ariz. Bridge pickup 210 is shown near bridge 205. Neck pickup 212 is shown adjacent to neck 215. Middle pickup 211 is shown between bridge and neck pickups. All controls, pickups, and neck are mounted to body 201. Pickup selector switch S270 is a lever-actuated, rotary-type switch, having five detent or "stop" positions. It is used to select one particular pickup or a combination of pickups, depending upon the detent setting of the switch. Volume control knob 220 is shown closest to the strings 240–245 on pickguard 202 for convenient access. Tone control knob 221 controls the tone of middle pickup 211. Tone control knob 223 controls the tone of neck pickup 212.

FIG. 2*b* shows an electrical schematic of a common version of the Fender "Stratocaster®" guitar. Pickups 210, 211 and 212 are depicted schematically as coils. One end of each coil is connected to common, or "ground" terminal 280. The other ends of the three coils are connected to terminals 271*a*, 271*b*, and 271*c*, respectively, of first pole 271 of five-position rotary pickup selector switch S270. Pole 271 is rigidly mechanically connected and also electrically connected to second pole 272 of switch S270. The electrical junction of the two poles is connected to guitar output terminal 231 of output jack 230 through volume control potentiometer 220*a*.

Pole 271 is rotated by applying finger pressure on handle 274 of pole 271. Since pole 272 is rigidly mechanically connected to pole 271, pole 272 rotates as pole 271 rotates. Detents 275*a*–275*e* are present on detent plate 275. These detents allow tip 276 of pole 272 of rotary pickup selector switch S270 to stop in five discrete positions.

Conductor 277 of pole 271 is depicted as connecting only to contact 271 a in detent position 275*a* in FIG. 2*b*. Contact 271*a* therefore connects only the bridge pickup 210 to volume potentiometer terminal 224. In this detent position 275*a*, pole 272 connects only to switch terminal 272*a*, which is not connected to anything. In detent position 275*b*, conductor 277 of pole 271 connects to both contacts 271*a* and 271*b*, bridge pickup 210 and middle pickup 211. This connects both bridge pickup 210 and middle pickup 211 to the output. Also in detent position 275*b*, conductor 278 of pole 272 connects to both switch terminals 272*a* and 272*b*. This connects pole 272 to potentiometer 221*a*, which is in turn connected to one end of capacitor 219 through potentiometer wiper terminal 221*b*. The other end of capacitor 219 is connected to ground. The combination of potentiometer 221*a* and capacitor 219 constitutes a tone control for middle pickup 211, by attenuating high frequencies when wiper terminal 221*b* is rotated toward terminal 221*c*, which corresponds to maximum counterclockwise rotation of knob 221.

In detent position 275*c*, conductor 277 of pole 271 selects only middle pickup 211 via switch terminal 271*b*. Also, conductor 278 of pole 272 selects tone control capacitor 219 and potentiometer 221*a*. In detent position 275*d*, which is depicted in FIG. 2*b* by showing pole 271 as dashed line 274*a*, and by showing pole 272 as dashed line 276*a*, connector 277 of pole 271 selects switch terminals 271*b* and 271*c*, which are connected respectively to pickups 211 and 212. Also, conductor 278 of pole 272 selects middle pickup tone control consisting of capacitor 219 and potentiometer 221*a,* and neck pickup tone control consisting of capacitor 219 and potentiometer 222*a*. In detent position 275*e*, conductor 277 of pole 271 selects only neck pickup 212 via switch terminal 271*c*. Also, pole 272 selects neck pickup tone control consisting of capacitor 219 and potentiometer 221*a*.

One problem with the configuration just described is that it is not possible to select the combination of bridge and neck pickups and still have the other pickup combinations with the selector switch S270 as shown. This extra pickup combination is sometimes desired by musicians.

In order to correct this shortcoming, another type of switch is often installed into electric guitars as a aftermarket item. This is a common "pull-on/push-off" switch which is built into a rotary-shaft potentiometer. By pulling the potentiometer shaft, the switch is actuated. FIG. 3*a* shows in rear/side perspective view a potentiometer/switch combination 300. Potentiometer VR305 is shown with double-pole/double-throw (DPDT) switch 310 attached. This type of switch is actuated by pulling and pushing on potentiometer shaft 302. When shaft 302 is pulled, shown by arrow 340 of FIGS. 3*a* and 3*b*, terminals 330 and 331 slide in the direction of arrow 340 and short switch terminals 312 to 313 and 315 to 316, respectively. When shaft 302 is pushed, shown by arrow 341 of FIGS. 3*a* and 3*c*, terminals 330 and 331 slide in the direction of arrow 341 and short switch terminals 312 to 311 and 315 to 314, respectively. Alternatively, potentiometer/switch combinations are available with push-on/push-off (push-push) function, or with momentary push-on or push-off. For switches with the push-push or momentary function, direction arrow 340 of FIG. 3 has no meaning. These various types of switch/potentiometer combinations are popular because they do not change the visual appearance of the surface of the instrument body. This is because only the potentiometer control knob is visible to the observer. Furthermore, the potentiometer/switch combination can often be added into a standard electric guitar electronics cavity without the necessity of enlarging or modifying the cavity.

The electrical schematic of FIG. 2*c* shows one of these potentiometer/switch combinations. In this schematic, a pull-on, push-off switch/potentiometer combination 300 is used to replace neck pickup tone potentiometer 222*a* of FIG. 2*c*. With this option, neck pickup 212 can be selected in combination with bridge pickup 210, when rotary selector switch S270 is in detent position 275*e* by pulling on potentiometer shaft 302, which actuates switch 310. Alternatively, all three pickups can be selected when rotary selector switch S270 is in detent position 275*e* by pulling on potentiometer shaft 302.

FIG. 2*d* shows another switching option of FIG. 2*c*, wherein a momentary push-off switch/potentiometer combination 290 replaces tone control potentiometer 221*a* of FIG. 2*b*. Switch 292 is connected in series with the output jack. Switch 290 is a momentary-action switch, whereby the switch is actuated by pushing the potentiometer shaft. The pushing direction is indicated by arrow 294. When pushing is ceased, the switch automatically returns to the rest position by a spring (not shown). This particular scheme allows an instant "cut-out" feature, where the output signal of the electric guitar is silenced whenever the tone control knob of the middle pickup is pushed. This type of arrangement is sometimes used by musicians to produce a "staccato" type of effect.

Alternative configurations of potentiometer/switch combinations are available, such as potentiometers having two concentric shafts, where one shaft controls the potentiometer setting and the other controls a rotary switch, as shown in rear/side perspective view of FIG. 3*d*. This drawing shows the potentiometer/switch combination of FIGS. 3*a*, 3*b*, and 3*c*, but having additional shaft 302*a* shown inside shaft 302, which is hollowed out to accept shaft 302*a* in concentric fit. With this potentiometer/switch combination, actuation of switch S310 can be pull-push, push-push or push momentary. Also, rotary would be possible. This type of switch/potentiometer combination is typically used with two concentric or stacked actuation knobs (not shown), which are attached to each shaft to make actuation more convenient. Most often, inner shaft 302*a* is used to actuate switch S310 and outer shaft 302 is used to actuate potentiometer VR305. On some switch/potentiometer combination units, outer shaft actuates rotary switch S310.

Other functions are often added to electric guitars on a custom basis, using these switch/potentiometer combinations. Sometimes they are used to select a winding tap on a pickup for additional pickup sounds, or to bypass a volume control in order to quickly change between predetermined backup and solo playing levels. Many other functions are possible. Potentiometer/switch combinations are an especially popular retrofit accessory to customize a guitar's basic control function. The main reason for this popularity is because this type of switch can often be installed on an instrument without having to modify the body or change the physical appearance of the instrument. Since the switch is an integral part of the potentiometer, no new hole has to be placed in the instrument body or pickguard to accommodate the switch. This is a very important advantage of this type of switch, which is becoming more important as time passes. One primary reason for this importance is because the antique value of older electric guitars is increasing, due to the fact that the electric guitar was invented over fifty years ago. Older guitars are worth more on the collector market if they have not been altered in appearance by cutting holes in the body to accommodate electronic modifications. Because of this type of switch/potentiometer combination, a particularly valuable instrument can be modified temporarily with the addition of an onboard effector control, and then returned to its original condition with little or no change to the antique value of the instrument.

Books and magazines are available which describe many retrofit modifications using potentiometers and switches. *Guitar Player Magazine,* published by Miller Freeman of San Francisco, Calif. is a magazine which often has articles on guitar modifications using potentiometers and switches. The *Stewart McDonald Guitar Shop Supply* catalog, published several times per year by Stewart McDonald Guitar Shop of Athens, Ohio, sells such switches and potentiometers, and also contains numerous articles on clever retrofit ideas. Another catalog containing guitar electronic parts is WD Music Products, of Ft. Meyers, Fla. A book called *Guitar Electronics for Musicians,* by Donald Brosnac, published by Wise Publications of London, England, describes many standard and custom electronic control plans and embellishments for electric guitar. Numerous other books are available on the subject.

Sustainer Prior Art

Sustainers for stringed musical instruments have been described as early as 1892 in U.S. Pat. No. 472,019 to Ohmart. This is the earliest description of such a device known to this inventor. Some 35 patents exist on sustainers for musical instruments. However, as far as this inventor knows, no prior art sustainer for musical instruments has achieved any significant commercial success until the late 1970's. This could be due partly to a combination of two factors: (a) The onset of miniaturized integrated silicon chip electronics which started to mature in the early 1970's has probably favorably affected the progress of sustainers as it has other effector types; (b) The development of certain "rock", "jazz", and "country" music playing styles for electric guitar during the last thirty years which involves producing sustained string vibration of electric guitar, whereby the musician stands in close proximity to a loud guitar amplifier, and takes advantage of sympathetic vibrations induced into the guitar strings as the intense acoustic vibrations of the amplifier loudspeaker impinges upon the guitar strings, has undoubtedly generated interest in sustainers.

The earliest sustainer known to this inventor to have achieved any degree of commercial success is the "E-Bow", or "Energy-Bow", manufactured by Heet Sound of Los Angeles, Calif. This sustainer is described in U.S. Pat. No. 4,075,921 to Heet, Feb. 28, 1978. It will be described later on in context with explanations of other sustainer types. Since then, other types of sustainer devices have appeared on the market with some commercial success. Most of those sold are used for electric guitar, but they are not limited to that application. Several embellishments and versions of sustainers are known to exist or have been publicly disclosed as patents.

Examination of retail store displays, public guitar shows and conventions around the U.S., and advertisements in guitar magazines reveals that while there has been some acceptance of the sustainer in the marketplace, sales of sustainers to date have not been as commercially successful as for other musical instrument effectors.

One reason for heretofore lackluster market penetration and general acceptance is that many musicians consider the sustainer to be an esoteric effect. This inventor believes that another reason concerns the enclosures in which prior art sustainers have been housed and the manner in which the controls of the sustainers are placed for use by the musician. In order to understand this reasoning, it will be helpful to understand musical instrument sustainers more completely, and to understand the distinct differences between sustainers and signal-processing effectors.

Sustainer Elements

FIG. 4 shows, in block diagram form, a sustainer for a stringed musical instrument. A stringed musical instrument having a sustainer must have one or more electric pickups 410, in order to convert some of the vibration energy of the instrument string or strings 430 into pulsating, or alternating electrical energy, at the pickup output 412 in response to the string vibrations, where electrical energy is defined as the product of voltage and current.

A sustainer 400 for stringed musical instruments comprises at least the following four elements:

(1) A control system 440, which comprises of one or more of the following control functions (not shown in FIG. 4): (a) one or more on/off switches; (b) one or more phase reversal switches for harmonic string vibration control; (c) potentiometer to control drive signal amplitude to the driver transducer; (e) potentiometer to control equalization; (f) potentiometer to control phase shift of the pickup or transducer signal;

(2) An amplifier 450, to amplify the alternating electrical energy from the pickup output;

(3) A power supply 460, usually either a dc battery or an ac line-powered supply, which is used to power the controller/amplifier;

(4) A driver transducer 420 which converts the amplified alternating electrical energy from the driver amplifier output into either alternating magnetic energy or pulsating acoustic energy, which is then coupled to the strings to replenish vibration energy to the strings which is normally lost due to friction.

A sustainer for stringed musical instruments is different from other effectors in two significant aspects:

(a) All other effectors modify the tone instrument output signal in some way. The sound which the listener hears from the instrument amplifier is this modified instrument output signal. A sustainer does not do operate on the instrument output signal. Instead, its basic function is to first split up the pickup signal into two branches. One branch is passed on to the instrument amplifier or other effectors as the instrument output signal, where it is heard without any further processing by the sustainer. The other branch is passed on to the sustainer controller and amplifier. The sustainer then operates on the instrument strings, not on the instrument output signal.

(b) For all sustainers known to this inventor, the string driver transducer must be either physically attached directly to the instrument or placed within about ¼ inch from a string being sustained. This is a necessary condition to impart vibrational energy into the strings.

These two aspects have had a significant impact on the mechanical characteristics of the housing of recent commercially-available sustainers, and also on how the controls of the sustainers have been arranged. For some sustainer types, the most practical housing is the instrument body itself. For another type, only the transducer is attached to the instrument body, with the rest of the sustainer components being housed inside of a floorbox. For still another type of sustainer, all components are housed inside of a small, hand-held box, which is brought near a string when the sustain function is desired.

Several different controls can be found on sustainers. All sustainers known to this inventor have at least a switch for turning the sustainer on and off. If this switch is readily accessible, then the musician can easily and quickly turn the sustainer on and off. This can be either by foot-actuated switch in the case of sustainers which have their control and amplifier circuits housed inside of a floorbox, or on the body of the instrument in a convenient position. Other arrangements are possible. Another useful control found on most recent commercial sustainers is the phase reversal switch of the transducer signal, for harmonic vibration control. This control should also be easily accessible to the musician. Still another useful control is to have a potentiometer which controls the amplitude of drive signal which is applied by the amplifier to the transducer. Therefore, it is preferable that the control of such a potentiometer for the sustainer consist of footpedal-actuated potentiometer, or a potentiometer which is mounted onto the instrument body near the string-playing position. Another useful control is one or more frequency control potentiometers, in order to change the frequency response of the drive signal, which alters the harmonic content of the drive signal, and consequently changes the harmonic vibration mode of the strings. Another way to accomplish changing of the string vibration harmonic mode is to provide a phase alteration control of the drive signal via a potentiometer.

Sustainers exist such that all of their basic elements are permanently attached to or contained inside the body of an instrument. Others exist such that only some of the basic elements are attached to or contained inside the instrument, and such that none of the basic elements are attached to or contained inside the instrument.

Sustainer Types

Most existing sustainers for stringed musical instruments can be classified into two main types: (A) Electromagnetic sustainers; (B) Electroacoustic sustainers. For both types of sustainers there are no significant differences between elements (1)–(3) as described above. The main difference between them is the type of driver transducer (4) being utilized.

String driver transducers for both electromagnetic sustainers and electroacoustic sustainers can be similar in operation, in that both are typically electromagnetic devices. Both types of transducer typically incorporate one or more coils, each coil being wound around a corresponding magnetic core. For both types of transducer, an alternating amplified electrical voltage is applied to each coil from the amplifier output. An alternating electrical current in the coil results from the applied alternating voltage. This alternating electrical current then produces a corresponding alternating polarity or pulsating-amplitude-same-polarity magnetic field in the respective core, depending on whether or not the core is biased with a permanent magnetic field.

The difference between the two types of sustainers lies in the manner in which the alternating or pulsating magnetic field in the core is used. For the magnetic sustainer, a pulsating-amplitude-same-polarity magnetic field is produced in the core and extends away from the core, impinging directly upon the instrument strings. This adds vibrational energy to the strings during each vibrational cycle. For the acoustic sustainer, the alternating polarity magnetic field produced in the core impinges upon one or more permanent magnets, causing the magnets to vibrate mechanically, in phase with the alternating polarity magnetic field produced in the transducer core. The permanent magnets are rigidly attached to a part of the instrument, but are held apart from the transducer core or cores by some flexible spacer, such as a piece of resilient foam rubber, so that the magnets can move relative to the cores. The acoustic vibrational energy of the permanent magnets is transmitted through the instrument body to the strings or directly to one of the ends of the strings, causing their vibration to be sustained.

(A) Descriptions of Electromagnetic Sustainers Follow (A-1) Coil/Core Magnetic Driver Electromagnetic sustainers of this type utilize a driver transducer which produces pulsating magnetic energy in response to the drive signal from the amplifier. The pulsating magnetic energy then impinges upon the vibrating strings at a location remote from the ends, to replenish their vibration energy, which is normally lost due to friction. This type of driver transducer only works for strings which are made of magnetic steel.

The transducer is built with one or more coils wound around corresponding magnetic cores. A permanent magnet is attached directly to each core. This produces a magnetic flux in each core, of polarity depending on which face of the permanent magnet contacts the core. The magnetic flux attracts the string or strings of the instrument. Then, as the alternating electrical voltage from the amplifier is applied to each coil, an alternating electrical current flows in the coil. The alternating electrical current in each coil produces a corresponding alternating magnetic field in the core, which adds or subtracts, depending on the instantaneous polarity of each magnetic pulsation, from the permanent magnet field existing in each core due to the permanent magnet attached to each core. This produces a pulsating attraction of one magnetic polarity on the vibrating strings in response to the amplifier signal, which tends to increase the vibrational energy already contained in the strings. One coil/core driver can be used to sustain vibration of a single string or of multiple strings, just as a pickup coil/core can be used to sense vibrations of one or more strings.

Several examples and patents of sustainers utilizing reverse pickup drivers exist. Very little information is contained in the patent information regarding specific control schemes, except that in some cases, switches and potentiometers are described or claimed as being present.

U.S. Pat. No. 472,019 to Omhart describes no embellishment or arrangement of controls adapted to any particular instrument in order to enhance the user's ability to use the sustainer or to enhance the appearance of the instrument. U.S. Pat. No. 1,002,036 to Clement describes a switch, but no particular embellishment or arrangement of controls adapted to any particular instrument in order to enhance the user's ability to use the sustainer or to enhance the appearance of the instrument. U.S. Pat. No. 2,600,870 to Hathaway et al, describes a sustainer and also a reverberation device which uses a single magnetic driver that drives all of the strings of an electric guitar. However, no switching or controls is described. U.S. Pat. No. 3,185,755 to Williams et al., May 25, 1965, also describes a sustainer having a driver which magnetically drives several strings, and furthermore describes a switch. However, '755 describes no special embellishment or arrangement of controls adapted to any particular instrument in order to enhance the user's ability to use the sustainer or to enhance the appearance of the instrument. Moreover, the Williams sustainer describes inducing sympathetic vibration of strings in response to notes played on another instrument, not self-sustaining notes played on the strings.

U.S. Pat. No. 3,742,113 to Cohen, Jun. 26, 1973, describes a magnetic transducer which applies a pulsating magnetic field to a string. Also described and claimed are switches to control the sustainer. However, the Cohen patent shows the arrangement of switches mounted onto the surface of the instrument in a convenient position in order to enhance the user's ability to use the sustainer. The switches are numerous and are visible to the casual observer. The problem with this type of control system is that toggle switches are mounted to the body of the instrument, which clutters the appearance. If the sustainer is used as a retrofit item, then the end user would have to modify the body of the instrument in order to mount the switches. This would likely decrease the value of the instrument.

U.S. Pat. No. 4,243,575 to Oliver, Mar. 13, 1979, describes a sustainer having a high frequency amplitude modulation scheme to reduce magnetic feedback between pickup and transducer. However, no controls are described or claimed.

U.S. Pat. No. 4,248,120 to Dickson, May 29, 1979, describes a stringed instrument sustainer, wherein the stringed instrument consists of a very long single string, of "30 to 100 feet in length". A sustain system is described for this device. The sustain signal is then mixed with the signal from an electric guitar in order to modify the sound of the guitar. No specific controls are described. The guitar which is described is not a physical part of the sustainer, nor are string vibrations of the guitar actually sustained by this invention.

None of the Coil/Core Magnetic Driver type sustainers described above is commercially available.

The "Infinite Guitar", invented by Michael Brook, is the first magnetic sustainer of the coil/core magnetic driver type for electric guitar known by this inventor to have received international attention. This sustainer was reported upon in a British publication *Making Music,* April, 1987. It was used on the *Joshua Tree* album by the rock music group U2, released in March, 1987. Apparently, no commercial success of this sustainer has been achieved, even though it has received limited press coverage and extensive public use by a world-famous musical group.

The "Infinite Guitar" sustainer (not shown) is designed to operate primarily with the Fender Stratocaster guitar. As shown in FIG. 2*a*, this model guitar has three pickups. They are normally of the single coil type. One of the pickups, typically neck pickup 212, is replaced with a "stack" type pickup. This "stack" type of pickup has two coils wound in opposite directions, connected in series, and stacked vertically such that only the top coil actually senses and responds significantly to string vibrations because of its proximity to the strings. Hence, the name. However, both coils do respond equally to external magnetic fields. Therefore, this configuration functions much like a "humbucker" pickup, where the two coils are placed side-by-side. Since the two coils are stacked vertically instead of being laid side-by-side horizontally, the "stack" humbucker takes up only half the area on the instrument body as the full-size humbucker pickup, and appears visually much like a single-coil pickup.

The "Infinite Guitar" sustainer uses this "stack" type neck pickup as the string driver transducer. This is because when used as a driver transducer, the radiated field of a "stack" pickup is less than with a single-coil transducer, because the same magnetic field cancellation properties of a humbucking pickup work equally well in the far field for a radiated magnetic field when the pickup is used in reverse as a driver transducer.

The controller, amplifier, and power supply are contained inside a metal box, which normally sits on the floor. There are foot-actuated switches which are used to turn the sustainer on and off, and also to reverse the phase in order to select the vibration mode of the strings. A shielded electrical cable routes the guitar pickup signal from instrument output jack 230 to the floorbox of the sustainer. Another shielded cable (not shown) then routes the transducer drive signal back to the instrument, where it is applied to the string driver transducer. The shielding isolates the pickup signal from the drive signal, because if not shielded, the capacitive interaction between the two signals would likely cause an uncontrolled oscillatory condition. No controls are mounted to the body of the instrument.

One problem with this sustainer is that there is no automatic pickup selection when the sustainer is turned on. In order to function best, the selected pickup should be the one farthest from the driver when the sustainer is on. This is because there is the least amount of magnetic crosstalk between driver and pickup, resulting in a minimum amount of noise and distortion introduced into the pickup by the transducer. This spacing also allows the highest possible system gain to be set in the sustainer for most robust sustainer performance. In the case of a Stratocaster guitar of FIG. 2*a* with a driver transducer (not shown) in the neck pickup position 212, the pickup farthest removed from this position is the bridge pickup 210. If, for instance, the pickup selector switch is set in the middle pickup position, less than optimal spacing is present. If the sustainer gain is optimized and adjusted for bridge pickup spacing, selecting the middle pickup with the sustainer on might even cause uncontrolled oscillation due to direct magnetic feedback between middle pickup 211 and transducer in neck pickup position 212. This would be a most undesirable situation in performance, because such an uncontrolled oscillation typically produces a loud squealing sound.

A second problem with the "Infinite Guitar" sustainer is the cable which connects the floorbox controller/amplifier with the transducer (not shown). This extra cable limits the musician's mobility when performing on stage.

U.S. Pat. No. 4,907,483 to Rose et al., Mar. 13, 1990, describes a sustainer of this type. The patent describes switches to turn the sustainer on and off, and also a potentiometer to control the phase of the drive signal to the transducer. No particular placement of the controls is specified or claimed. A prior art sustainer manufactured under the '483 patent by Kramer Music Products, Neptune, N.J., is a Kramer Floyd Rose Sustainer Solidbody Guitar. A review of that prior art was published in Guitar World magazine, 1989, July, page 106. Also, it is installed into certain Jackson guitars. Control of this sustainer consists of three toggle switches and a potentiometer, all of which are mounted into the body of the guitar. These controls are placed in addition to the "basic function" volume and tone controls of the guitar. This clutters the appearance of the instrument.

Another relevant prior art magnetic sustainer is provided by U.S. Pat. No. 4,941,388 to Hoover et al., Jul. 17, 1990, and also U.S. Pat. No. 5,050,759 to Hoover et al., Dec. 10, 1991. The Sustainiac model GA-1 and GA-2 sustainers, manufactured by Maniac Music, Inc. Indianapolis, Ind., are based on the '388 and '759 patents. These are sustainers which have achieved some commercial success. They were sold in certain guitars manufactured by Hamer Guitars of Chicago, Ill., during the time period 1989–1992. The GA-2 sustainer was sold in certain models of Fernandes guitars of Japan during 1990, 1991, and in guitars manufactured by Audio Sound International, a corporation of Indianapolis, Ind., during 1990, 1991. The GA-2 was also sold to individuals for retrofit into existing instruments during the same time period, and continues to be so at the present time.

These Sustainiac model GA-1 and GA-2 sustainers were designed to be wholly contained inside the body of typical electric guitars. The accessible controls consist of two toggle switches. A description of a typical installation of that sustainer in a common variety of electric guitar is described below, and shown in FIG. 5.

FIG. 5*a* contains a front plan view of the body 530 of a typical electric guitar 500. FIG. 5*b* contains a rear plan view, and FIG. 5*c* contains an electrical schematic of this same guitar. Guitar 500 contains three pickups for producing an electrical output signal in response to string vibrations. Bridge pickup 510 is a standard "humbucker" type of hum canceling pickup. Pickups 512 and 514 are typical single-coil pickups. Pickup selector switch S520 is a five position selector switch, similar to the pickup selector switch S270 of FIG. 2*a*. S520 can select the following five pickup combinations: pickup bridge pickup 510 only in switch position 520*a* (terminal 521 of S520), the combination of bridge pickup 510 and middle pickup 512 in switch position 520*b* (terminals 521 and 522 of S520), middle pickup 512 only in switch position 520*c* (terminal 522 of S520), the combination of middle pickup 512 and neck pickup 514 in switch position 520*d* (terminals 522 and 523 of S520), or neck pickup 514 only in switch position 520*e* (terminal 523 of S520). Volume control potentiometer VR534 and tone control potentiometer VR532 are provided to adjust the amplitude and frequency response, respectively, of the selected pickup signal at output terminal 538 of output jack J536. Knobs 534 and 532 are attached to the rotary shafts of potentiometers VR534 and VR532, respectively. The function of the rotary shafts is to move the potentiometer wiper elements, which move along the resistive elements of the potentiometer elements to select the desired tone and volume settings.

Referring again to the back plan view of body 530 of electric guitar 500: Cover plate 553*a* is shown, which covers cavity 553 (shown in hidden view) which is cut into body 530. The purpose of cavity 553 is to house electrical components VR532, VR534, and S520, plus the electrical wiring associated with them.

FIG. 5*d* contains another front plan view of the electric guitar body 500, which has been modified by the installation of sustainer 550 inside the body 530. FIG. 5*e* contains a rear plan view of the same instrument. Typically, the installation is done by cutting a cavity 551 into the back of the instrument in a convenient place, near the existing electronics cavity 553 which houses pickup selector switch S520, volume control VR534, and tone control VR532. Circuit board 550 containing the electronic circuitry of the GA-2 sustainer controller/amplifier is then placed in the cavity. Toggle switches S552 and S554 are permanently mounted to the circuit board. These toggle switches mount to the surface of the front of the body by threaded nuts, (not shown) and are the means by which the circuit board 550 is attached to body 530. Pickup selector switch S520 selects the same pickup configurations as in FIGS. 5*a* and 5*d*, as explained above. FIG. 5*f* contains a simplified schematic and functional block diagram of the sustainer, showing pertinent functional components and the relationship between the sustainer and the electronic components of a typical electric guitar.

The sustainer circuits are active but in standby mode whenever a standard ¼ inch monaural phone plug is plugged into guitar output jack J536*a*. J536*a* is a standard ¼ inch diameter stereo phone jack, which accepts a standard ¼ inch phone plug. When a monaural ¼ inch phono plug is inserted into J536*a*, ring terminal 537 is electrically connected to ground terminal 502. This connects terminal 537 to ground, which causes sufficient base current from darlington pair PNP transistor Q574 (shown as a single transistor for simplicity) to flow through R572 so as to place Q574 in saturation. The emitter of transistor Q574 is connected to dc voltage supply 558, which consists of two 9 volt batteries connected in series. The collector of Q574 is the dc power supply, Vcc, for all of the circuits in the sustainer. In standby mode, all circuits of the sustainer are powered. Input signal 535 from bridge pickup 510 is applied to the input terminal 539 of the sustainer. Bridge pickup 510 is chosen to provide the sustainer input signal because it is the pickup which is farthest from transducer 556. Operational amplifier U560 functions as a unity gain buffer amplifier for the input signal 535.

Toggle switch S554 is actuated to turn the sustainer ON and OFF. In FIGS. 5*c* and 5*f*, the up position of S554 indicated by arrow 590 turns the sustainer ON, and the down position of S554 indicated by arrow 591 turns the sustainer OFF. This switch has three poles. Pole S554C grounds out the non-inverting input of power amplifier U570 in the OFF position, which prevents signal from reaching the output of amplifier U570. The OFF position of pole S554B converts driver transducer 556 to a pickup, and to a string driver transducer when the S554B is in the ON position. In the OFF position, transducer 556 functions as a neck pickup instead of a string driver transducer, and produces a voltage in response to string vibrations at terminal 557. Terminal 557 of transducer 556 is connected to the intersection of two windings of voltage step-up transformer T580, terminals 581, 582. This transformer is connected as an autotransformer, with one end of the primary 583 being connected to ground. Output terminal 584 of transformer T580 is connected to terminal 523 of pickup selector switch S520. This corresponds to neck pickup select position 520*d* of S520 in FIG. 5*e*. With this connection of transducer 556 and transformer T560, the transducer 556 functions as a neck pickup when the sustainer is OFF and transducer terminal 557 is electrically disconnected from the power amplifier. Transformer T560 is used to increase the voltage output of the transducer in response to string vibrations. In many guitars which are modified with the installation of this sustainer, a neck pickup exists in the instrument. By using transformer T560 in conjunction with transducer 556 to form a pickup when the sustainer is off, no new cavity has to be milled into guitar body 530 in order to accommodate the transducer. This feature is explained is detail in U.S. Pat. No. 5,050,759 to Hoover et al., Dec. 10, 1991.

Pole S554A is used to select the bridge pickup 510 as the output signal of the guitar whenever S554A is in the ON position, regardless of the setting of S520, the pickup selector switch. This is done for two reasons: (1) the bridge pickup is the pickup on the instrument which lies physically furthest from the transducer, and therefore is least subject to magnetic crosstalk from the transducer. Therefore, bridge pickup 510 produces less audible crosstalk noise than middle pickup 512. Furthermore, bridge pickup 510 is a humbucking pickup, which is less susceptible to magnetic crosstalk from driver 556 than is a single-coil pickup. (2) because if pickup selector switch S520 is in the neck pickup position, the transducer 522 cannot be simultaneously a driver transducer and a neck pickup. In the OFF position of S554A, the instrument output jack is connected to the common terminal 524 of S520, such that pickup selection functions normally.

This selecting of bridge pickup 510 as the output signal of the guitar whenever S554A is in the ON position, regardless of the setting of S520, the pickup selector switch, is the primary reason why it has become a standard practice to install a magnetic sustainer inside of electric guitars instead of in a separate floorbox as in the case of the "Infinite Guitar".

Switch S552 is a three-position toggle switch, which switches the sustainer operation into three separate operational modes: Selection of switch terminal 552*a* selects fundamental mode, where string vibration is in the fundamental mode of vibration; switch terminal 552*b* selects mix mode, where string vibration occurs mostly in the fundamental mode of vibration for high frequency notes, and mostly in the harmonic mode of vibration for low frequency notes, as capacitor C563 resonates with the inductance of the coil of transducer 556; switch terminal 552*c* selects harmonic mode, where string vibration is in the harmonic mode of vibration.

In position 552*a* and 552*b* of switch 552, operational amplifier U568 functions as a unity-gain follower. The amplified signal which is applied to transducer 556 is in phase with the input signal from bridge pickup 510. In position 552*c*, the non-inverting amplifier input is grounded, which causes U568 to function as a unity-gain inverting amplifier.

The advantage of installing sustainer 550 inside the body 530 can be appreciated by examining the FIG. 5 drawings and by studying the above description. Clearly, when using the sustainer in the instrument shown, certain functionality of the instrument is decreased when the sustainer is in operation. This is because the magnetic field which is radiated by transducer 556 prevents the use of middle pickup 512 due to magnetic crosstalk. The neck pickup function is lost, because transducer 556 only functions as neck pickup when the sustainer is off. If original neck pickup 514 was placed directly adjacent to transducer 556, the problem of magnetic crosstalk would exist, and it could not be used when the sustainer was operating. These limitations would be present whether the sustainer was placed inside the body of the instrument or not, because they are a result of having a string driver transducer within close proximity to the neck and middle pickups. The advantage of automatic bridge pickup selection is obvious. It allows the musician to place the sustainer in operation without having to remember to select only the bridge pickup at the same time the sustainer is turned on. It would be very difficult to accomplish automatic pickup selection without placing the sustainer inside the body of the instrument. Separate shielded cables would have to be used to connect each pickup to an external automatic pickup selector circuit. If a sustainer of this type is to be used with a stringed instrument such as an electric guitar, it is obvious that it is advantageous to place it inside the body of the instrument.

The resulting disadvantage which is created is the same as that described in the previous paragraph for the Kramer Floyd Rose sustainer: Switches must be mounted to the body of the instrument, which clutters the appearance of the instrument. If the installation of the sustainer is a retrofit, then the instrument must be permanently altered in order to install the sustainer and switches. This reduces the value of the instrument.

Another example of a prior art magnetic sustainers is provided by U.S. Pat. No. 5,123,324 to Rose et al., Jun. 23, 1992. This sustainer describes controls which mount inside a box, which is mounted to the body of an instrument. No specific arrangement of controls is described or claimed.

U.S. Pat. No. 5,200,569 to Moore, Apr. 6, 1993, describes a sustainer having switches to turn the sustainer on and off, and to switch the phase of the drive signal. No particular placement of the controls is specified or claimed.

U.S. Pat. No. 5,233,123 to Rose et al, Aug. 3, 1993, describes another magnetic sustainer. This sustainer describes controls which mount inside a box, which is mounted to the body of an instrument. No specific arrangement of controls is described or claimed.

Other relevant prior art magnetic sustainers are provided by U.S. Pat. No. 5,292,999 to Tumura, Mar. 8, 1994, U.S. Pat. No. 5,378,850 to Tumura, Jan. 3, 1995, and U.S. Pat. No. 5,585,588 to Tumura, Dec. 17, 1996. None of these patents specify or claim any specific controls or arrangement of controls. Some of the described and claimed elements of the Tumura inventions can be found in the "Fernandes Sustainer", manufactured by Fernandes Guitars of Tokyo, Japan and distributed in the U.S. by Fernandes U.S.A. Controls for the Fernandes sustainer are identical to those of the Sustainiac GA-2. Therefore, the same problems exist.

U.S. Pat. No. 5,449,858 to Menning et al, Sep. 12, 1995, describes a multipurpose feedback device which has all of the elements of a magnetic sustainer. The device magnetic transducer is described as being held in or attached to the hand or other parts of the musician's body. No specific controls or special arrangement of controls are described or claimed, although a "signal processor" box is described as having control capabilities.

Still other examples are shown in U.S. Pat. No. 5,523,526 to Shattil, Jun. 4, 1996. The Shattil patent neither specifies nor claims any particular controls or arrangement of controls.

Neither the Menning nor Shattil sustainers has been commercially available, as far as this inventor knows.

Of all the coil/core magnetic driver sustainers mentioned above, only the following examples are known to this inventor to have achieved any degree of commercial success: The "Floyd Rose" sustainer, "Sustainiac GA-1" sustainer, "Sustainiac GA-2" sustainer, and "Fernandes" sustainer. These examples are similar in that they are all totally contained within the body of electric guitars, and are powered by batteries. However, examination of retail store displays, advertisements, public guitar shows and conventions around the U.S. reveals that when compared to other types of effectors, sales volume of these sustainers is not large. This inventor believes that the fact that the controls of these sustainers are discernible on electric guitars, and cause them to appear different from guitars which are not equipped with sustainers.

(A-2) Conducting String Magnetic Driver

Another type of magnetic sustainer has basic sustainer elements (1)–(4) as described above, but with a different magnetic string driver configuration: The magnetic string driver (5) function is accomplished in the following manner: The amplifier output feeds alternating current in response to string vibrations into the strings, which act as electrical conductors. The alternating magnetic field which surrounds each string due to the current flowing through it interacts with a permanent magnet which is mounted onto the instrument body underneath the strings. Thus, electrical energy coming from the amplifier is converted into magnetic energy, and finally to vibrational energy in the strings.

U.S. Pat. No. 4,137,811 to Kakehashi describes a prior art sustainer of this type. No commercial example of this sustainer is known to this inventor. No specific control arrangement is specified in the patent. In the U.S. Pat. No. 5,378,850 Tumura patent, two Japanese patents are described, 52-151022 and 53-139836, both owned by Roland Corporation, which disclose this type of sustainer. This inventor does not have access to these prior art patents. Since the '811 Kakehashi patent is assigned to the Roland Corporation, these could be similar.

An example of this prior art sustainer is provided by U.S. Pat. No. 4,181,058 to Suenaga, Jan. 1, 1980. No commercial example of this sustainer is known to this inventor. Controls consisting of numerous switches are described and illustrated in drawings. These controls are shown mounted to the surface of the body of a guitar. The problem with this type of control system is that numerous switches are mounted to the body of the instrument, which clutters the appearance. If the sustainer is used as a retrofit item, then the end user would have to modify the body of the instrument in order to mount the switches. This would likely decrease the value of the instrument.

(A-3) Hand-Held Sustainer

This type of magnetic sustainer has all basic sustainer elements (1)–(5) contained inside a small box which is held in one hand of the musician. The sustainer is used by holding it along the length of a single string of an instrument having steel strings. This example is described in U.S. Pat. No. 4,075,921 to Heet, Feb. 28, 1978. A sustainer having the trade name of "E-Bow" is available in the marketplace. The control of this sustainer consists of a single on/off switch, which is located on the sustainer enclosure. In this case, the sustainer must be stored in some convenient position until the musician is ready to use it. After reaching for and grasping the E-bow sustainer, the musician must actuate the power switch. An alternative method of activating the sustainer would be to first switch the sustainer on before starting a song. Then, sometime during the song when the sustainer is needed, it can then be quickly grasped and used. The E-Bow sustainer has achieved some limited commercial success. The E-bow obviously presents considerable problems to the musician who wishes to switch back and forth quickly between normal playing style and sustained notes.

All of the sustainers described in (A-1), (A-2), and (A-3) above are of the electromagnetic-type sustainers.

(B) Descriptions of Electroacoustic Sustainers Follow (B-1) One type of electroacoustic sustainer string driver first converts the amplified alternating electric signal coming from the amplifier into a pulsating magnetic field. Then, due to the mechanical construction of the transducer, the pulsating magnetic field is converted into a pulsating acoustic vibration, which is applied directly to some part of the body of the instrument. The acoustic vibrational energy then travels through the body to one or both ends of the strings, and is transferred to them. This then restores vibrational energy which would normally be lost due to normal frictional losses in the strings, and thereby sustains the string vibration.

Several examples of this type sustainer exist. The first known to this inventor is disclosed in U.S. Pat. No. 2,672,781 to Miessner, Mar. 23, 1954. This sustainer comprises vibrating reeds mounted to a reed plate. Pickups convert reed vibrations to electrical signals. An amplifier applies amplified pickup signal to a driver transducer. The driver transducer mounts to the reed plate which is vibrated by the transducer. This sets up sustained vibration of the reeds. A potentiometer is described which controls reed vibration amplitude. No details of mounting of this control are given.

U.S. Pat. No. 3,571,480 to Tichenor et al describes a feedback loop for musical instruments which contains all of the elements of this type of electroacoustic sustainer. No controls are described or claimed.

U.S. Pat. No. 3,813,473 to Terymenko, May 28, 1974, describes an acoustic sustainer where an electromagnetic string driver transducer having a single coil is attached to the bridge of a guitar. The string vibrations are sustained as one end of the strings are imparted vibrational energy by the transducer through the vibrating bridge. Numerous controls are described which are actuated by footpedal, and are located in a floorbox. The driver transducer in the Terymenko patent is alsospecified as being capable of exciting the strings into sustained vibration through direct magnetic energy transfer.

U.S. Pat. No. 4,236,433 to Holland, Dec. 2, 1980, describes an acoustic sustainer for an electric stringed instrument. Individual sustainers are provided for each string. All pickups and transducers are mounted to a special bridge assembly. The bridge assembly anchors one end of each of the strings. Amplifiers and control potentiometers are mounted inside a box which sits on the bridge assembly near the ends of the strings. The potentiometers control the gain of the amplifiers.

U.S. Pat. No. 4,484,508 to Nourney, 1984, describes an acoustic sustainer for an electric stringed instrument. Amplifier and control circuitry are described as being external to the instrument. Various controls are described and depicted as also being external to the instrument. The patent describes no embellishment or arrangement of controls whereby switches are an integral part of any control potentiometer on the instrument, such that the original appearance of an instrument is substantially preserved after being modified by the addition of the sustainer.

U.S. Pat. No. 4,697,491 to Maloney, Oct. 6, 1987, describes an acoustic sustainer for an electric stringed instrument. The transducer mounts to the headstock of the instrument. The amplifier is described as being mounted inside a floorbox, with a phase reversal switch also being included inside the box.

No commercial examples of the electroacoustic sustainers described above are known to this inventor.

Another prior art acoustic sustainer is disclosed in U.S. Pat. No. 4,852,444 to Hoover et al., Aug. 1, 1989. That prior art provides an electromagnetic transducer affixed to a musical-instrument body. The "Sustainiac Model T" and "Sustainiac Model B" sustainers are two examples of sustainers which are based on this patent. Amplifier and controls for these sustainers are located in a floorbox. Some commercial success of these sustainers has been achieved. The "Sustainiac Model B" sustainer continues to sell at the present time. One disadvantage of this particular sustainer is that an electrical cable must be used to connect the transducer, which is mounted to the headstock or some other part of the body of an electric guitar or other electric stringed musical instrument, to the floorbox. This can create a problem when playing onstage, because the cord can impair motion, particularly for musicians who tend to move around the stage a lot when performing. As a result, this device tends to sell more to studio musicians, where dancing or other large movements are less likely to be made while playing.

An acoustic sustainer such as the "Sustainiac Model B" can be placed entirely inside the body of the instrument. This solves the problem of having an extra cable to deal with. Since the transducer of the "Sustainiac Model B" sustainer is usually mounted to the headstock of an electric guitar, magnetic feedback between transducer and pickups is usually not a problem, due to the relatively wide spacing between the headstock of a guitar and the pickup location on a typical guitar body. Therefore, no automatic pickup selection is needed when the sustainer is turned on.

However, in some cases it might be desirable to place the transducer of the "Sustainiac Model B" in such a way that instead of vibrating a guitar headstock, instead it vibrates the guitar bridge. This would place the transducer much closer to the pickups. In this situation, having automatic pickup selection to a pickup farthest removed from the transducer would be a definite advantage, much as it is for a magnetic sustainer such as the Sustainiac GA-2 sustainer.

Another prior art acoustic sustainer is disclosed in U.S. Pat. No. 5,031,501 to Ashworth, Jul. 16, 1991. The patent describes and claims means for attaching an audio transducer to a stringed musical instrument. No controls are specified or claimed. Ashworth U.S. Pat. No. 3,449,531 is the transducer described in '501, but is not specifically a sustainer. No commercial example of a sustainer using this technology is known to this inventor.

U.S. Pat. No. 5,054,361 to Usa, Oct. 8, 1991, describes an invention which vibrates the body of a musical instrument in response to notes played on the instrument for the purpose of producing tactile vibratile sensations in the hands of the musician is disclosed. The drawings clearly depict a piano.

This invention is not a sustainer. Switches are described which appear to be hidden by and are actuated by the keys of the piano, although they are not specified or claimed to be hidden. U.S. Pat. No. 5,189,242 to Usa, Feb. 23, 1993, describes the same electronic musical instrument as the '361 patent. In this patent, the hidden actuator switches are claimed.

U.S. Pat. No. 5,275,586 to Oba et al, Nov. 16, 1993, describes an invention which vibrates the soundboard of a musical instrument with a transducer in response to notes played on the instrument for the purpose of modifying the sound of the notes played on the instrument. No sustain device is specifically described or claimed. Switches and other controls are described as being mounted onto a control panel. No commercial example of a sustainer using this technology is known to this inventor.

No commercial electroacoustic sustainers of this type are known by this inventor to be designed to be totally mounted inside of a stringed instrument such as a guitar. However, there could be advantages similar to those of magnetic sustainers of the coil/core driver type. If the transducer of an acoustic sustainer was used to vibrate the bridge of an electric guitar, then the transducer might be mounted in close proximity to the bridge pickup, and further away from other pickups on the instrument body. Then, automatic switching away from the bridge pickup to one of the other pickups would be a distinct advantage. But, mounting the sustainer inside of the instrument would cause the necessity of mounting other controls of the sustainer on the instrument body. This would result in a cluttered appearance of the instrument, unless steps were taken to mount the added controls in such a manner as pot to detract from a desired appearance of the instrument.

(B-2) Another type of electroacoustic sustainer string driver utilizes a common cone-type electromagnetic loudspeaker mounted to the body of a stringed instrument, in close proximity to the strings. The vibrating air molecules emanating from the speaker impinge upon the vibrating strings of the instrument, which restores vibrational energy to the strings that would normally be lost due to normal frictional losses, and thereby sustains the string vibration. Typically, these airborne vibrations impinge upon the strings at a location other than the ends. Alternatively, vibrations in the frame of the loudspeaker can transmit vibrations into the body of the instrument, which are then coupled into the ends of the strings after traveling through the instrument body.

The first sustainer of this type known to this inventor is U.S. Pat. No. 1,893,895 to Hammond, Jun. 13, 1929. This patent is primarily one describing a sound reinforcement means for a piano or other musical instrument, having pickups, control means, amplifier, and loudspeaker. The patent describes the loudspeaker as being mounted to the sounding board of the instrument, and having the capability of reducing the string vibration damping by coupling vibrational energy from the loudspeaker to the strings through the air and also through the sounding board. Multiple potentiometers are described which are used to control the amplitude of the pickup signals to the amplifier. No special mounting or positioning of the controls is mentioned in the patent. No commercial example of a sustainer using this technology is known to this inventor.

Another patent by Hammond, U.S. Pat. No. 2,001,723, Jun. 16, 1932, describes a "regenerative piano". It also describes an instrument having, having pickups, control means, amplifier, and loudspeaker. It includes a filter network to minimize spurious oscillation occurring due to sounding board and pickup natural vibration frequencies. By minimizing spurious oscillations, sustain of note vibrations is prolonged. Potentiometers are described which set the gain of different string groups, in order to equalize sustain of all strings on the instrument. U.S. Pat. No. 3,612,741 to Marshall, Oct. 12, 1971, describes a sustain device substantially similar to the U.S. Pat. No. 2,001,723 device. No controls are described or claimed. No commercial example of a sustainer using this technology is known to this inventor.

A prior art acoustic sustainer is disclosed in U.S. Pat. No. 4,245,540 to Groupp, Jan. 20, 1981. That prior art provides a musical instrument having a loudspeaker mounted to the body of a guitar, located underneath the strings, an amplifier to drive the loudspeaker with the amplified pickup signal of the guitar. Because the loudspeaker is located within close proximity to the strings, string vibrations are sustained by imparting vibrational energy from the loudspeaker to the strings through the air. A control panel is mounted to the surface of the instrument which has all of the controls necessary to operate the sustainer. No effort is made to incorporate the sustainer controls and the normal function controls of the guitar so as to hide the additional controls required to operate the sustainer. Therefore, the appearance of the guitar body appears cluttered and unlike that which has gained popular acceptance. No commercial example of a sustainer using this technology is known to this inventor.

SUMMARY OF PRIOR ART

In summary of the prior art, the ongoing evolution of progress in the art of sustainers for musical instruments has advanced the technology to a degree where commercially successful sustainers have started to become a reality. Advances in the miniaturization of electronics have made it possible to entirely enclose both magnetic and acoustic sustainers within electric stringed instruments such as the electric guitar. The controls of the sustainers have been advanced such that musicians can creatively control the sustainers, and, as a result, can use them to enhance the creation of music. Despite these advances, the total quantity of sustainers sold in recent years continues to lag significantly behind that of other effector types. Improvements can be made to increase the desirability of this type of device.

The above description of prior art for stringed instrument sustainers, particularly those used for electric guitar, shows that there is a distinct operational advantage in placing entire sustainers of the magnetic coil/core driver type, and also in some cases sustainers of the acoustic transducer type inside the instrument. One reason why it is advantageous to place the entire sustainer inside the instrument body is because the driver transducer must typically be attached to the instrument. Putting the entire sustainer inside the instrument makes it unnecessary to have an external electrical cable connecting the sustainer amplifier with the transducer, interfering with the musician's mobility.

The above description of the prior art shows that another advantage in placing all of the parts of the sustainer inside of the instrument has to do with pickup selection on instruments having multiple pickups, when the sustainer is in use. This is because the pickup selector switch or switches can then be incorporated with the sustainer on/off switch, such that one particular pickup can be automatically selected as the source of the output signal of the instrument whenever the sustainer is in operation. This particular pickup is usually the one which is located on the body of the instrument farthest away of all the instrument pickups from the sustainer driver transducer. This is desirable in order to minimize the audible effects and other effects of magnetic radiation emanating from the transducer which reaches and is sensed by the other instrument pickups.

The above description of prior art shows that enclosing the entire sustainer inside the instrument body puts the controls within easy reach of the musician. The description shows that along with this advantage comes a significant disadvantage: When mounting the sustainer in the body of the instrument, room must me made for other controls which are desirable or necessary for operation of the sustainer. Placement of these added controls causes an undesirable cluttered appearance of the surface of the body of the instrument. In many cases, the instrument must be permanently altered or damaged in order to mount the added controls. For a valuable antique instrument, this is not a viable option without seriously degrading the value of the instrument.

Clearly, the above description of the prior art reveals that there is a need for a means in which controls of a sustainer can be added to a stringed instrument such as a guitar or other instrument such that the added controls are concealed without compromising their functionality, and also without significantly changing the normal appearance of or doing permanent damage to the instrument.

SUMMARY

One aspect of the invention provides a sustainer for an electric stringed musical instrument. The musical instrument comprises one or more strings which produce the musical tones of the electric stringed musical instrument, and at least one pickup responsive to the string vibrations, which produce a pickup output signal in response to the string vibrations. The instrument has at least one control potentiometer, used for varying respective one or more parameters of the pickup output signal. Each control potentiometer has a rotary shaft for varying the electrical resistance setting of the control potentiometer. An output terminal is provided for accepting the pickup output signal, such that the pickup output signal can be connected to an external instrument amplifier for the purpose of producing audible tones corresponding to the vibrations of the strings. An instrument body is provided on which to mount the strings, one or more pickups, one or more potentiometers, and the sustainer. The function of the sustainer is to sustain the vibrations of the strings of the instrument. The sustainer comprises a string driver transducer capable of inducing vibrations in the strings, a sustainer amplifier having an input which accepts the pickup output signal, an amplifier circuit which amplifies the pickup output signal to form a drive signal, an output, from which the drive signal transfers sufficient energy to the string driver transducer to sustain the vibrations of the strings, a power supply for providing electrical energy to the sustainer amplifier, and a power switch which provides connection and disconnection function between the power supply and the sustainer amplifier in response to actuation of the power switch in order to turn the sustainer on and off. The power switch is an integral part of the control potentiometer, where the two are a physical combination, and both switch and potentiometer are actuated by the shaft of the potentiometer. Furthermore, the appearance of the control potentiometer having the power switch as an integral part, when viewed from the outside of the musical instrument, is substantially the same as that of the instrument containing the potentiometer without the power switch being present as the integral part of the potentiometer.

According to one feature of this aspect of the invention, the aforementioned combination switch/potentiometer power switch is actuated by pulling on the rotary shaft of the potentiometer to connect the power supply to the sustainer amplifier, and by pushing on the potentiometer shaft to disconnect the power supply from the sustainer amplifier. This type of actuation is commonly known in the art as push-pull, or pull-push.

According to another feature of this aspect of the invention, the aforementioned combination switch/potentiometer power switch is actuated by pushing on the rotary shaft of the potentiometer in order to connect the power supply to the sustainer amplifier, and by again pushing on the potentiometer shaft to disconnect the power supply from the sustainer amplifier. This type of actuation is commonly known in the art as push-push.

According to another feature of this aspect of the invention, the aforementioned combination switch/potentiometer power switch is actuated by rotating the rotary shaft of the potentiometer in one direction to connect the power supply to the sustainer amplifier, and by again rotating the rotary shaft of the potentiometer in the other direction to disconnect the power supply from the sustainer amplifier. This type of actuation is commonly known in the art as rotate-on, rotate off.

According to another feature of this aspect of the invention, the aforementioned combination switch/potentiometer power switch is actuated by pushing on the rotary shaft of the potentiometer to connect the power supply to the sustainer amplifier, and by releasing the potentiometer shaft to disconnect the power supply from the sustainer amplifier. This type of actuation is commonly known in the art as momentary-push.

According to another feature of this aspect of the invention, the aforementioned combination switch/potentiometer power switch is actuated by pushing, pulling, or rotating a second shaft which is a separate shaft, concentric with the potentiometer shaft. This type of integral concentric potentiometer/switch combination is common in the art of electronics.

According to another feature of this aspect of the invention, the stringed musical instrument further comprises at least a second control potentiometer for varying a second parameter of the pickup output signal. This second parameter of the pickup output signal is varied by rotating the rotary shaft of the second control potentiometer. The sustainer also comprises a phase reversal switch which provides phase reversal of the driver signal in response to actuation of the phase reversal switch. Like the first control potentiometer, the phase reversal switch is an integral part of the second output signal control potentiometer, such that the phase reversal switch is actuated by the shaft of the second control potentiometer. Actuation of this phase reversal switch is of the push-pull, push-push, rotary shaft, or concentric shaft type.

According to another feature of this aspect of the invention, one of the musical instrument control potentiometers is replaced by a sustainer control potentiometer, which controls a parameter of the sustainer drive signal. A useful sustainer drive signal parameter to control with a potentiometer mounted to the instrument body is drive signal amplitude. Another useful sustainer drive signal parameter to control with a potentiometer mounted to the instrument body is drive signal phase shift as a function of frequency.

The main intended advantage of all the above-described integral combination potentiometer/switch combination elements is that the external appearance of the electric stringed musical instrument is not changed by the replacement of the original instrument potentiometers by the integral potentiometer/switch combinations.

In accordance with another aspect of the invention, a sustainer is provided for an electric stringed musical instrument. The musical instrument comprises one or more strings, which produce the musical tones of the electric stringed musical instrument. A first pickup and second pickup are provided, which are responsive to the vibrations of the strings. The first pickup produces a first pickup output signal in response to the instrument string vibrations. The first pickup output signal is split into two branches, a first branch being a first pickup instrument output signal, and a second branch being a sustainer input signal. The first pickup is defined as the pickup furthest removed from the sustainer transducer, so as to receive a minimum amount of magnetic crosstalk from the transducer. The second pickup produces a second pickup output signal in response to the instrument string vibrations. A pickup selector switch is provided for selecting either the first pickup instrument output signal or second pickup output signal or a combination of both first pickup instrument output signal and second pickup output signal. The resulting output signal is called the selected pickup output signal. One or more control potentiometers, each having a control shaft, are provided for varying one or more parameters of the first pickup instrument output signal, or for varying a parameter of the second pickup output signal or for varying a parameter of the selected pickup output signal. Each pickup output signal parameter is varied by rotating the shaft of the respective potentiometer.

An output terminal is provided for accepting the selected pickup output signal, such that the pickup output signal can be connected to an external instrument amplifier for the purpose of producing audible tones corresponding to the vibrations of the strings. An instrument body is provided on which to mount the strings, pickups, one or more potentiometers, and the sustainer. The function of the sustainer is to sustain the vibration of the strings of the instrument. The sustainer comprises a string driver transducer capable of inducing vibrations in the strings, a sustainer amplifier having an input which accepts the first pickup output signal, an amplifier circuit which amplifies the pickup output signal to form a drive signal, an output, from which the drive signal transfers sufficient energy to the string driver transducer to sustain the vibrations of the strings, a power supply for providing electrical energy to the sustainer amplifier, and a power switch which provides a connection and disconnection function between the power supply and the sustainer amplifier in response to actuation of the power switch in order to turn the sustainer on and off. The power switch is an integral part of one of the instrument control potentiometers, and is actuated by the shaft of the potentiometer. When the sustainer power switch is actuated to connect the power supply to the sustainer amplifier, the invention also causes a first pickup signal to be connected to the instrument output terminal, regardless of which pickup is selected by the instrument pickup selector switch. This is done because the second pickup output signal, being more subject to the effects of magnetic crosstalk, is more likely to have a noisy, distorted signal than is the first pickup output signal. Furthermore, the appearance of the control potentiometer having the power switch as an integral part, when viewed from the outside of the musical instrument, is similar to that of the instrument containing the potentiometer without the power switch being present as the integral part of the potentiometer.

According to one feature of this aspect of the invention, a mute circuit is provided to mute the sustainer drive signal momentarily when the sustainer is first disconnected from the power supply. This is done to prevent excessive magnetic crosstalk from the second pickup, should it be selected by the pickup selector switch. If not muted, this magnetic crosstalk from the sustainer transducer to the second pickup can cause an uncontrolled oscillation during the brief time interval that the sustainer power supply filter capacitor still retains charge, resulting in a loud squealing sound from the instrument amplifier. The mute circuit responds to a mute control signal. The mute control signal is produced in response to the power supply being disconnected from the power supply by the sustainer power switch.

According to another feature of this aspect of the invention, one of the musical instrument control potentiometers is replaced by a sustainer control potentiometer, which controls a parameter of the sustainer drive signal. A useful sustainer drive signal parameter to control with a potentiometer mounted to the instrument body is drive signal amplitude. Another useful sustainer drive signal parameter to control with a potentiometer mounted to the instrument body is drive signal phase shift as a function of frequency. According to another feature of this aspect of the invention, the sustainer additionally comprises a potentiometer for controlling a parameter of the drive signal. This drive signal control potentiometer replaces one of the instrument control potentiometers for controlling a parameter of the selected pickup output signal, or for varying a parameter of the first pickup instrument output signal or for varying a parameter of the second pickup output signal. The sustainer power switch is an integral part of one of the instrument control potentiometers or of the drive signal control potentiometer. When the outside of the musical instrument is viewed, its appearance is similar to that of the instrument containing the potentiometer without the power switch being present as the integral part of the potentiometer.

According to another feature of this aspect of the invention, the sustainer power switch, which is an integral part of an instrument pickup signal parameter control potentiometer or of a sustainer parameter control potentiometer, is a double pole, double throw type (DPDT). A first pole provides connection and disconnection function between the power supply and the sustainer amplifier. A second pole of the double pole, double throw power switch provides substitution for substituting the first pickup instrument output signal for the selected pickup output signal when the sustainer is turned on, regardless of which pickup output signal is selected by the pickup selector switch when the sustainer is turned off.

According to another feature of this aspect of the invention, the double pole, double throw power switch is either a pull-push, push-push, momentary-push, or is of concentric-shaft type switch.

According to another feature of this aspect of the invention, the sustainer power switch, which is an integral part of an instrument pickup signal parameter control potentiometer or of a sustainer parameter control potentiometer, is a single pole, single throw switch. Substitution of the first pickup instrument output signal for the selected pickup output signal when the sustainer is turned on, regardless of which pickup output signal is selected by the pickup selector switch when the sustainer is turned off, comprises an electronic switch circuit which responds to the connection and disconnection between the power supply and sustainer amplifier.

According to another feature of this aspect of the invention, the stringed musical instrument comprises additionally a third pickup, also responsive to the vibrations of the instrument strings. The third pickup produces a corresponding third pickup output signal in response to the string vibrations of the instrument. The pickup selector switch selects either the first pickup output signal or the second pickup output signal or the third pickup output signal, or a combination of the first pickup output signal and the second pickup output signal.

According to another aspect of the invention, a sustainer is provided for an electric stringed musical instrument. The musical instrument comprises one or more strings which produce the musical tones of the electric stringed musical instrument, and at least one pickup responsive to the string vibrations, which produce a pickup output signal in response to the string vibrations. The instrument has at least one control potentiometer, used for varying respective one or more parameters of the pickup output signal. Each control potentiometer has a rotary shaft for varying the electrical resistance setting of the control potentiometer. An output terminal is provided for accepting the pickup output signal, such that the pickup output signal can be connected to an external instrument amplifier for the purpose of producing audible tones corresponding to the vibrations of the strings. An instrument body is provided on which to mount the strings, one or more pickups, one or more potentiometers, and the sustainer. The function of the sustainer is to sustain the vibration of the strings of the instrument. The sustainer comprises a string driver transducer capable of inducing vibrations in the strings, a sustainer amplifier having an input which accepts the pickup output signal, an amplifier circuit which amplifies the pickup output signal to form a drive signal, an output, from which the drive signal transfers sufficient energy to the string driver transducer to sustain the vibrations of the strings, at least one control potentiometer for varying one or more parameters of the sustainer drive signal, a power supply for providing electrical energy to the sustainer amplifier, and a power switch which provides a connection and disconnection function between the power supply and the sustainer amplifier in response to actuation of the power switch in order to turn the sustainer on and off. The power switch is an integral part of the control potentiometer, where the two are a physical combination, and both switch and potentiometer are actuated by the shaft of the potentiometer. The potentiometer/switch combination could have concentric shafts, whereby one shaft controls the potentiometer, and the other shaft controls the switch. Furthermore, the appearance of the control potentiometer having the power switch as an integral part, when viewed from the outside of the musical instrument, is substantially the same as that of the instrument containing the potentiometer without the power switch being present as the integral part of the potentiometer.

According to one feature of this aspect of the invention, each sustainer drive signal potentiometer with integral switch replaces a corresponding number of instrument control potentiometers used for varying pickup output signal parameters of the pickup output signal. This does not substantially change the original external appearance of the electric stringed musical instrument.

According to another feature of this aspect of the invention, one drive signal parameter which is controlled by the replacement switch/potentiometer combination controls the amplitude of the drive signal.

According to another feature of this aspect of the invention, one drive signal parameter which is controlled by the replacement switch/potentiometer combination controls the frequency response of the drive signal.

According to another feature of this aspect of the invention, one drive signal parameter which is controlled by the replacement switch/potentiometer combination controls the phase response of the drive signal.

DETAILED DESCRIPTION OF THE INVENTION

Objects and Advantages

Figure 1A:
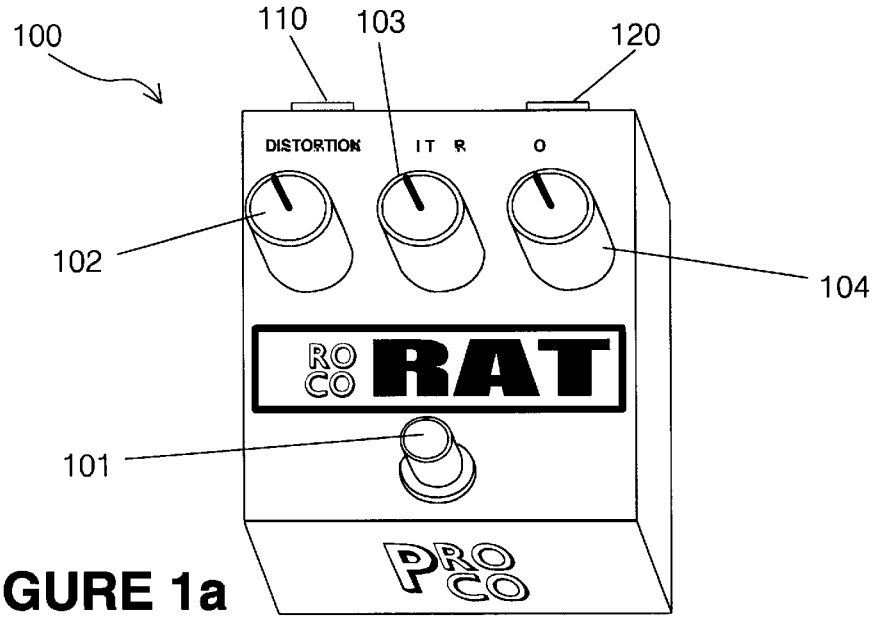
FIGURE 1a PRIOR ART
FIG. 1*a* Prior Art effector perspective view
Figure 1B:
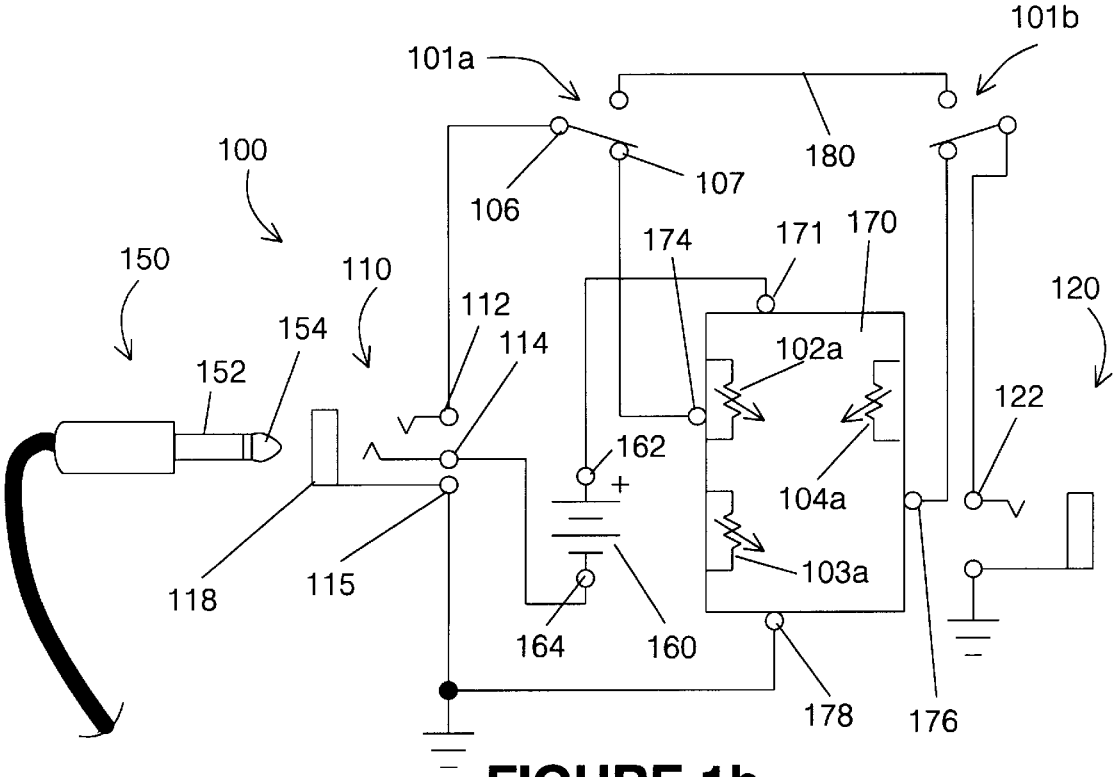
FIGURE 1b PRIOR ART
FIG. 1*b* Prior Art effector electrical schematic

The Prior Art description has shown that the transducer element of a sustainer for a musical instrument must be either attached to the instrument or held very close to the strings of the instrument in order to function properly. Also, since the sustainer controls should be placed in some convenient location for easy access by the musician (as in a floorbox or attached to the instrument body), it makes sense for some types of sustainer to put the entire sustainer inside the instrument. The primary advantages of installing an entire sustainer into an electric stringed instrument are: (1) to provide both a convenient switch for turning the sustainer on; (2) to minimize the amount of wires which would have to run from the instrument pickup to an external enclosure such as a floorbox, then back from the external enclosure back to the transducer located on the instrument; (3) to provide a means for automatic pickup selection to a preferred pickup when the sustainer is switched on.

For advantage (3), this preferred pickup is the one furthest removed from the transducer. If automatic preferred pickup selection is not provided, undesirable consequences of magnetic crosstalk to non-preferred pickups can create noise, distortion, and uncontrolled oscillation in the instrument output signal. This can be true for both magnetic and acoustic type sustainers. This preferred pickup is defined as a "first" pickup.

One problem that arises with the installation of a sustainer in the body of an instrument is that it then becomes necessary to attach the electronic controls for the sustainer to the instrument in some manner. Often, this means that the instrument must be permanently altered, such as having holes drilled in to the body. Most of the prior art patents and descriptions show that this can detract from the aesthetic appearance of the instrument. Also, it can decrease the value of many instruments, particularly those which are made of expensive woods or having antique value due to age.

The primary object of this invention is to provide an improved sustainer for electric guitar or other stringed electric musical instrument, wherein the sustainer and the controls for the sustainer are attached to the body of the instrument. The sustainer controls are arranged in such a way as to integrate them with existing function controls of the instrument, such that they cannot be seen from the outside of the instrument. When a sustainer is constructed and installed into an electric stringed instrument according to the invention described herein, then the controls for the sustainer are not easily visible from the outside of the instrument. The instrument appears substantially as it would before the installation of the sustainer.

The choice of control elements is such that their use would not normally require that the instrument be permanently altered or damaged when they are installed and used. This is accomplished by substituting the normal control potentiometers which are typically incorporated on the body of such instruments with multifunction controls. The multifunction controls are commonly-available potentiometers which have switches attached to them, whereby the switch is actuated by the potentiometer shaft. These combination controls, which have not heretofore been used in sustainers, make the sustainer controls substantially indistinguishable from the original instrument controls when viewed from the outside of the instrument. Furthermore, they can be installed into existing instruments without incurring damage to the instruments.

The ensuing description will illustrate by way of examples and diagrams that even though such integral potentiometer/switch controls are used for many electronic functions in the electric stringed musical instrument art, their use in sustainers in the manner described constitutes a novel invention. Further objects and advantages of the invention will become apparent from a consideration of the drawings and ensuing description.

Detailed Description

Figure 6A:
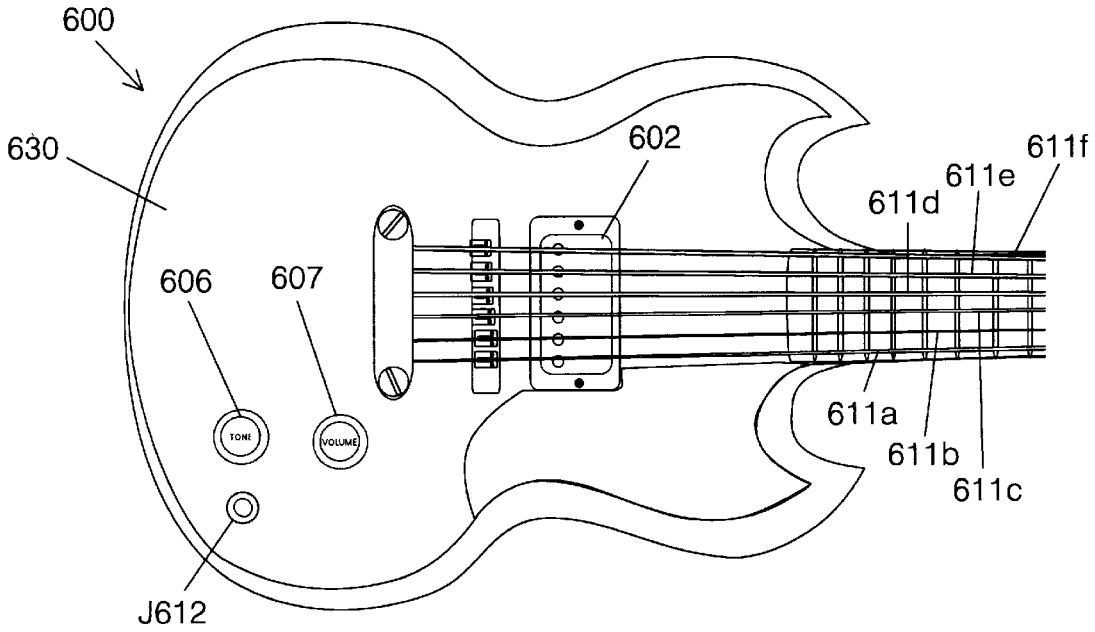
FIG. 6a Prior Art
FIG. 6*a* Prior Art electric guitar front plan view
Figure 6B:
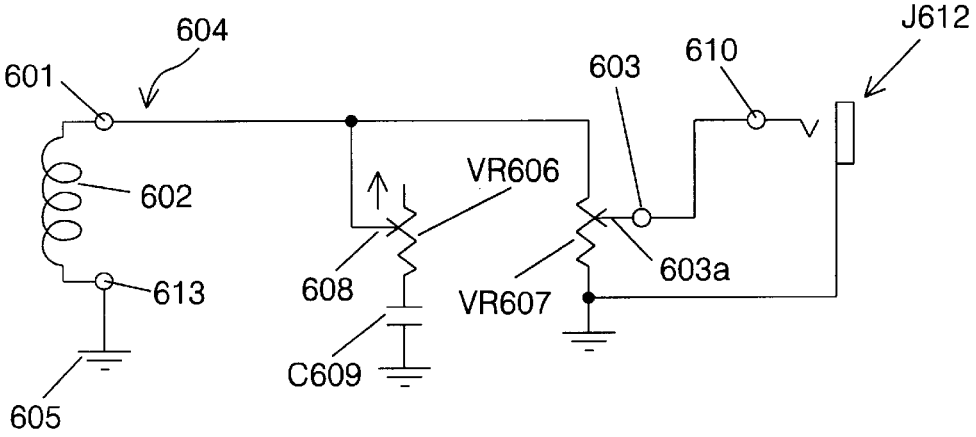
FIG. 6b Prior Art
FIG. 6*b* Electrical schematic of Prior Art electric guitar of FIG. 6*a*

In accordance with one aspect of the invention, a sustainer is provided for an electric stringed instrument which has at least one string. FIG. 6*a* shows a front plan view of body 630 of guitar 600. FIG. 6*b* shows an electrical schematic of the same instrument. The instrument comprises the following elements: At least one pickup 602 is present for sensing and producing a pickup signal 604 at pickup terminal 601 in response to vibrations of the six instrument strings 611*a*, 611*b*, 611*c*, 611*d*, 611*e*, and 611*f*. A second terminal 613 of pickup 602 is connected to the common or "ground" terminal 605 for all electrical signals. At least a first control potentiometer is provided to control one or more basic function parameters of the pickup output signal, as described in the PRIOR ART section. Volume control potentiometer VR607 adjusts the amplitude of pickup output signal 604 by moving potentiometer wiper 603*a* along its resistive element. The potentiometer wiper terminal 603 is connected to potentiometer wiper 603*a* and also to output terminal 610 of instrument output jack J612. Potentiometer VR607 shaft (not shown) is rotated by turning knob 607. A second potentiometer VR606 is shown which adjusts the tone of pickup signal 604 by shunting high frequency signals to ground through capacitor C609 whenever potentiometer wiper 608 is moved to the end of the resistive element of potentiometer which is connected to capacitor C609. VR606 is actuated by rotating knob 606 which is attached to the potentiometer shaft (not shown).

Figure 6C:
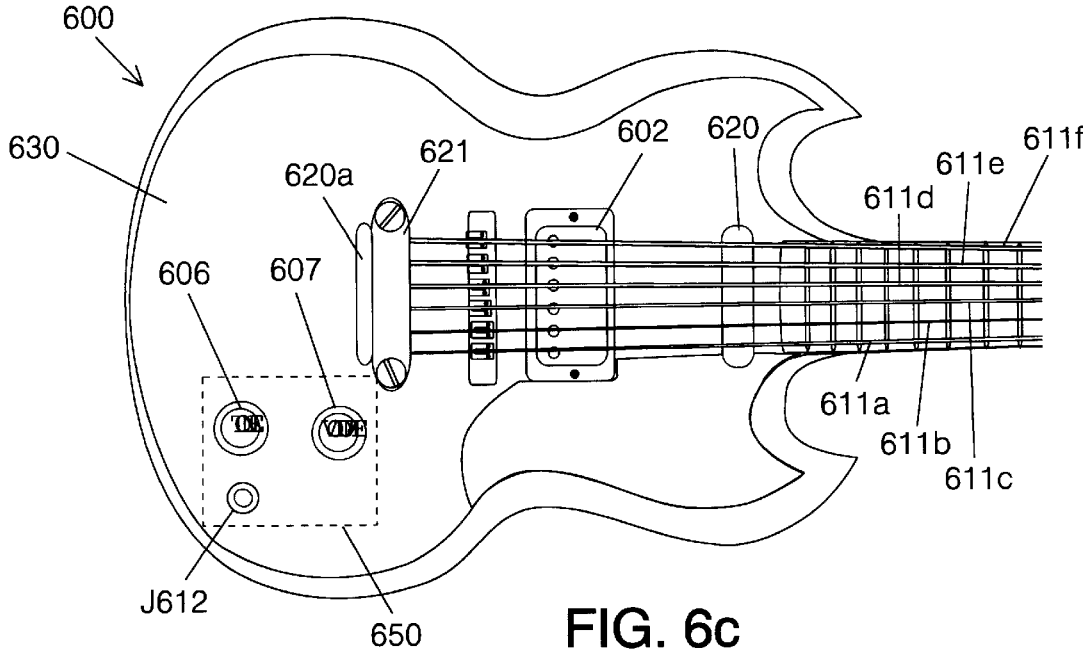
FIG. 6*c* Electric guitar of FIG. 6*a* showing magnetic sustainer and optional acoustic sustainer transducer installed FIG. 6*d* Electrical schematic of guitar and sustainer of FIG. 6*d*, showing switch/potentiometer combination of FIG. 3 as guitar control and sustainer power switch FIG. 6*e* Electrical schematic of guitar and sustainer of FIG. 6*d*, showing use of two switch/potentiometer combinations of FIG. 3 as guitar controls and sustainer power switch and sustainer phase inverter switch FIG. 6*f* Electrical schematic of guitar and sustainer of FIG. 6*e*, showing use of two switch/potentiometer combinations of FIG. 3 for sustainer power switch and sustainer phase inverter switch, replacing one guitar control potentiometer with sustainer control potentiometer FIG. 7*a* Prior Art electric guitar front plan view FIG. 7*b* Electrical schematic of Prior Art electric guitar of FIG. 7*b*

FIG. 6*c* shows a front plan view of the instrument of FIG. 6*a* and 6*b*, after being modified by having a sustainer installed. As can be seen by in FIG. 6*c*, the instrument looks substantially the same as before being modified, with the exception of magnetic transducer 620 and optional acoustic transducer 620*a* rigidly attached to bridge 621. Dashed box 650 shows the electronic circuit of the sustainer and power supply in hidden view, which is mounted into the existing guitar electronics cavity. Since the cavity for this particular model electric guitar basic function electronics components is cut into the back of the instruments, as is the case for most electric guitars, it is not shown in FIG. 6*c*.

Figure 3A:
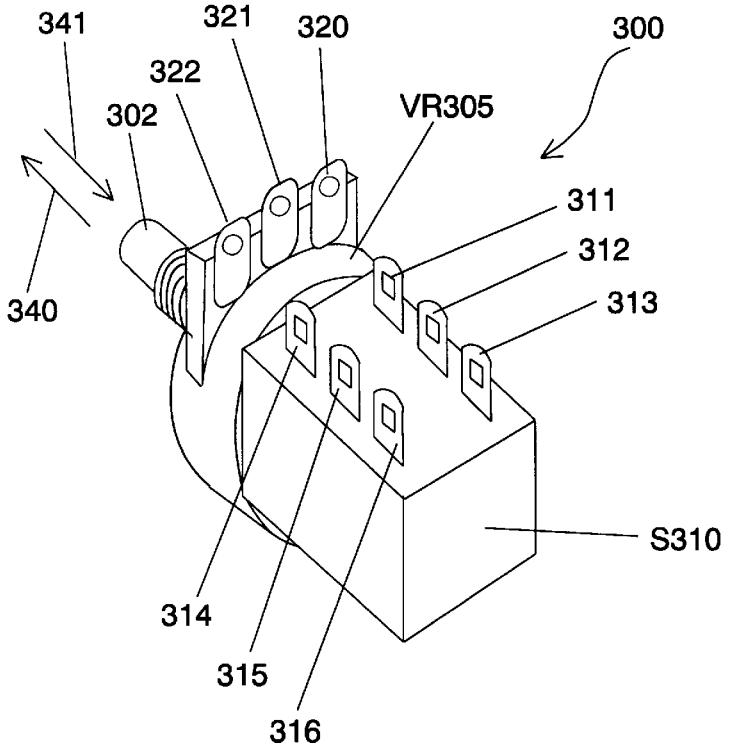
FIG. 3a PRIOR ART
Figure 3B:
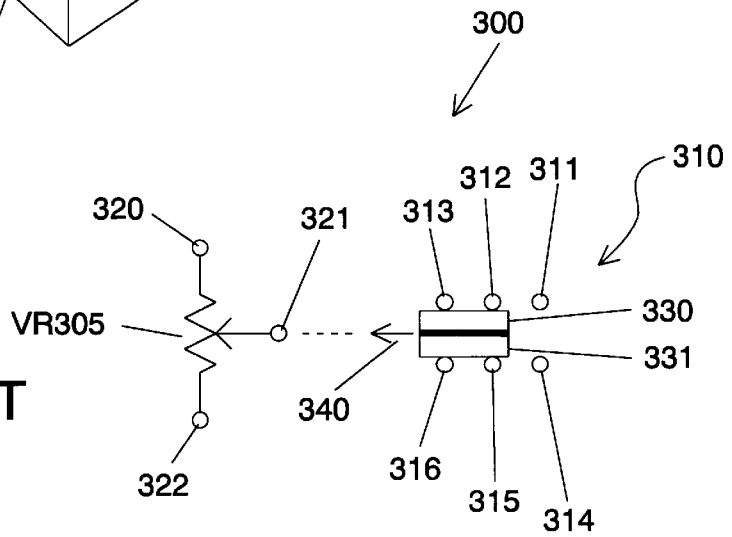
FIG. 3b PRIOR ART
Figure 3C:
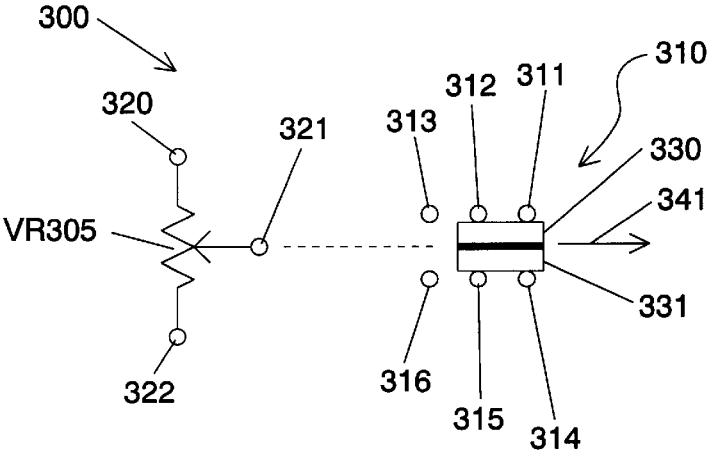
FIG. 3c PRIOR ART
Figure 3D:
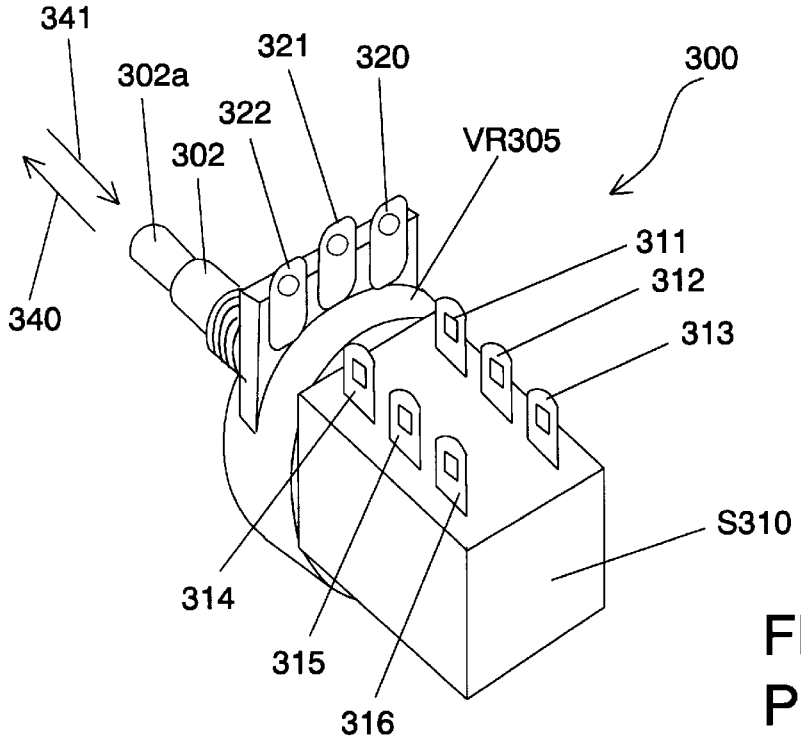
FIG. 3d PRIOR ART
Figure 4:
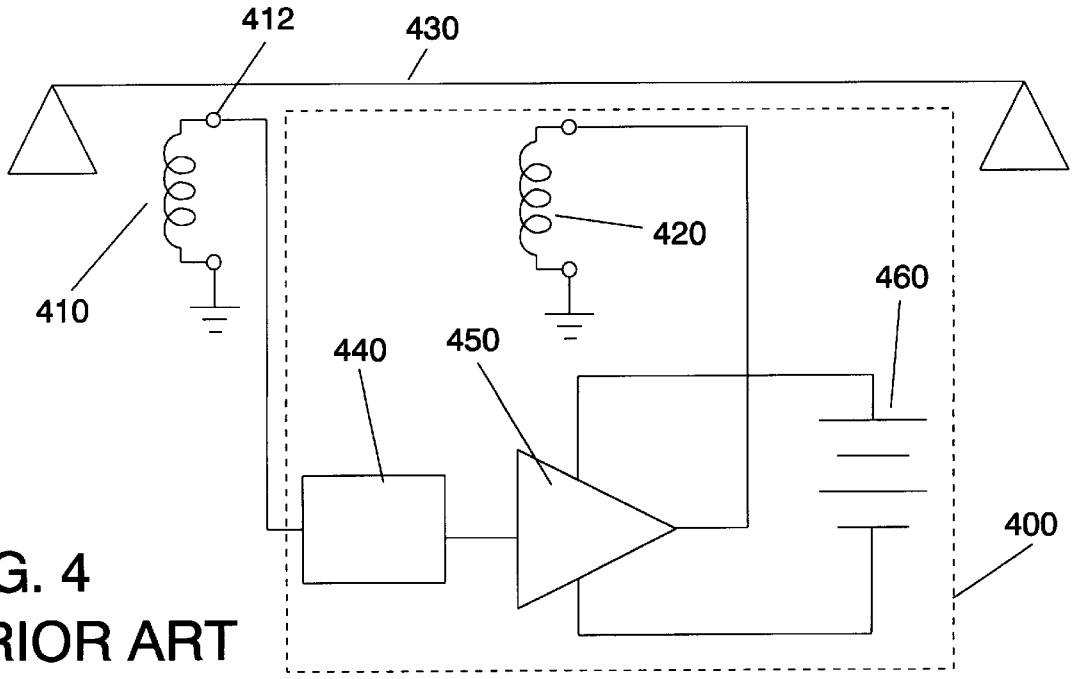
FIG. 4 PRIOR ART
Figure 6D:
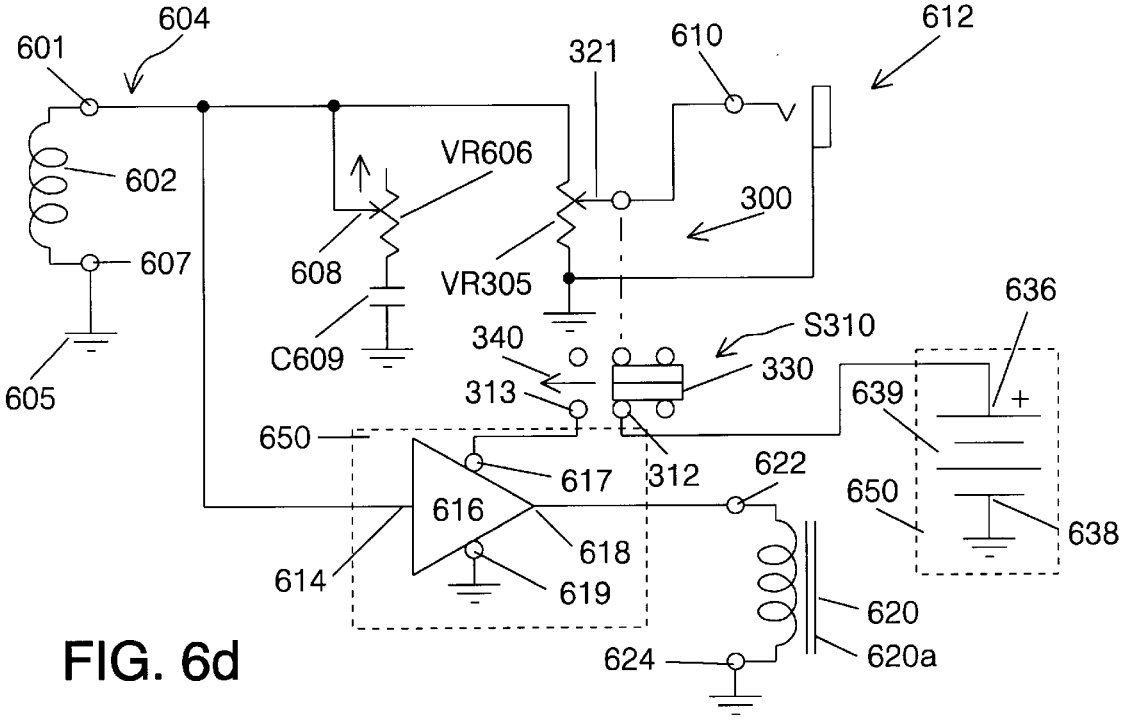

FIG. 6*d* shows a partial electrical schematic of the sustainer circuitry (enclosed by dashed box 650) and guitar basic function electronics circuitry, showing the changes which must be made to the guitar circuitry in order for the guitar and sustainer to function properly together. Some details of the sustainer circuit were left out in order to make the schematic less complex. These omitted details pertain only to subtleties of the sustainer operation, and not to any aspect of the invention. The schematic shows the necessary details to convey the actual invention. Volume control potentiometer VR607 of FIG. 6*b* is replaced with a potentiometer/switch combination 300. The potentiometer portion of potentiometer/switch combination 300 is VR305, from prior art FIG. 3. This potentiometer has switch S310 attached to it, and is an integral part of the potentiometer. Actuation of switch S310 is accomplished by pulling and pushing rotary shaft 302, as shown in FIG. 3*a*, which controls wiper 321 of control potentiometer 305.

Switch S310 is provided to connect and disconnect electrical power from dc power supply 639 to amplifier 616 when desired. Positive supply terminal 636 supplies voltage and current to terminal 312 of switch S310. When switch S310 is closed, as indicated by arrow 340, electrical current flows from terminal 312 to terminal 313, as sliding conductive contact 330 shorts terminal 312 to 313, to the positive voltage terminal 617 of amplifier 616. Alternatively, switch S310 could be connected to the negative supply terminal 638 without significantly changing the function of the invention. Switch S310 is shown as a double-pole, double-throw (DPDT) switch, because this type is readily available from numerous sources of electric guitar parts. While switch S310 is shown as a DPDT switch, only one pole is used. Therefore, a single-pole, double-throw (SPDT) switch could be used, or a single-pole, single-throw (SPST) type, without negating the intent of the invention.

Alternatively, the switch could be of the push-on, push-off type. Still another alternative would be a rotary actuation of the switch, as shaft 302 (shown in FIG. 3 only) is turned. Another alternative is a momentary push-on switch, which would enable the sustain function only as long as potentiometer shaft 302 of FIG. 3 is pushed. All of these switch types are well known in the art. All of the above arrangements would be defined as integral potentiometer/switch combinations, for the purposes of this invention.

Other methods of actuating switch S310 might be possible, which would not negate the intent of the invention. The main intent is that the switch be an integral part of an instrument control potentiometer, such that actuation of the switch is accomplished by moving the rotational shaft of the potentiometer. Furthermore, the advantage of using a switch such as S310 is that when the instrument is viewed from normal viewing angles, the instrument appears as does the original instrument of FIG. 6*a*. There is no switch visible to the observer, thereby preserving the original aesthetic appearance of the instrument.

Still another type of potentiometer/switch combination which can be used is a potentiometer having a hollow rotary shaft, with a switch-actuation shaft protruding through the hollow potentiometer shaft, such that the two shafts are concentric (or, reverse configuration, as described in the Prior Art section). Prior Art FIG. 3*d*. shows such a combination in perspective view. Such an arrangement would be defined as an integral potentiometer/switch combination, for the purposes of this invention.

In addition to providing the output signal for the instrument, pickup signal 604 is also applied to input terminal 614 of sustainer amplifier 616. The amplified pickup output signal at output terminal 618 of sustainer amplifier 616 is defined as the drive signal. It is connected to input terminal 622 of sustainer driver transducer 620. In the context of this document, throughout the document, the terms "driver", "driver transducer", and "transducer" are interchangeable, indicating the transducer which receives a drive signal from the sustainer amplifier for the purpose of imparting vibrational energy into the strings in response to the drive signal, in order to sustain the vibrations of the strings.

The string vibrations are sustained in response to pulsating magnetic energy which is imparted directly into them from the driver transducer 620, in the case of a magnetic sustainer. Alternatively, the transducer can be an acoustic transducer 620*a* for inducing vibrational energy into the strings by producing acoustic vibrations. Acoustic transducer 620*a* can be attached to the bridge 621, as shown, or alternatively to the body 630 or other part of the instrument. Acoustic vibrations are then transferred through the bridge, body, or other part of the instrument to one or both ends of the strings. Other types of transducers might also be used which are not commonly known in the art, such as piezoelectric or other technologies, without changing the scope of the invention. Sustained vibration is achieved because vibration energy which is imparted into the strings equals that which is lost due to normal friction.

A second terminal 624 of sustainer transducer 620 is connected to ground. Electrical power is supplied by power supply 639, which can be a battery or ac mains-derived dc power supply. The dc supply is transferred to amplifier 616 through terminal 617. Power supply negative terminal 638 is connected to the ground terminal, and provides a return path for current to the power supply ground terminal 619. Amplifier 616 typically utilizes bipolar transistors, field effect transistors, or other amplifying devices. Vacuum tubes could be used, but would have size and efficiency disadvantages for such an application. Amplifier 616 might include other signal processing circuitry not shown, such as frequency or phase control circuitry.

Figure 6E:
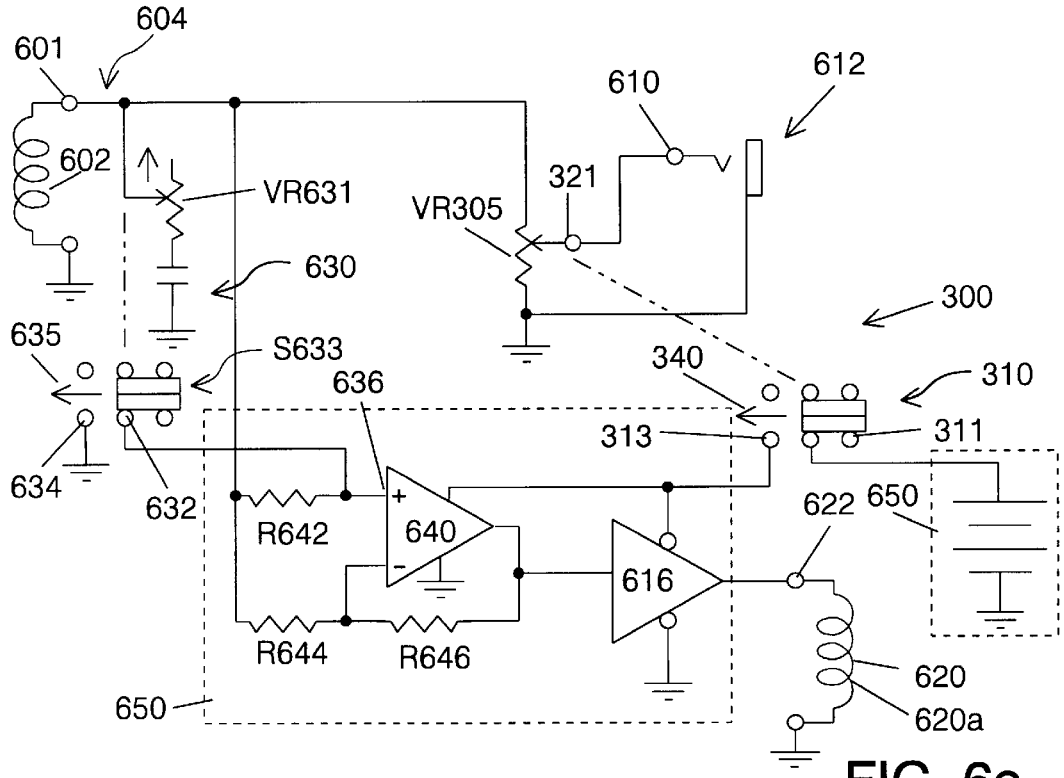

FIG. 6*e* shows an embellishment of FIG. 6*d*. A useful function known in the art of sustainers is to reverse the phase of the drive signal which is applied to the string driver transducer. By reversing the phase of the drive signal, string vibration sustain is changed from fundamental vibration mode to some harmonic mode of vibration, or from one harmonic mode of vibration to another harmonic mode of vibration. Second instrument control potentiometer VR606 is replaced with a switch/potentiometer combination 630, similar to combination 300, consisting of VR631/S633. Switch S633, the switch of switch/potentiometer combination 630, is used in FIG. 6*d* as a sustainer phase reversal switch. Operational amplifier 640 is shown connected as a unity-gain amplifier. Resistors R642, R644, and R646 could be all of equal value. Terminal 632 of S630 is connected to noninverting terminal 636 of operational amplifier 640. When switch S633 is in the normal position shown (non-actuated), amplifier 640 functions as a non-inverting unity-gain buffer. When switch S630 is actuated, as shown by arrow 635, by pulling, pushing, or rotating the rotary shaft of instrument control potentiometer VR606, depending on which type of combined switch/potentiometer is desired, noninverting terminal 636 is connected to ground through switch terminals 632 and 634. This connects operational amplifier 640 as an inverting amplifier, which inverts the phase of drive signal 622. The inverted phase of drive signal 622 causes the sustained vibration harmonics of the strings to change.

The addition of a second switch/potentiometer combination control 630 for controlling phase inversion does not change the visual appearance of the instrument which remains as shown in FIG. 6*c*, which is an advantage of the invention.

Figure 6F:
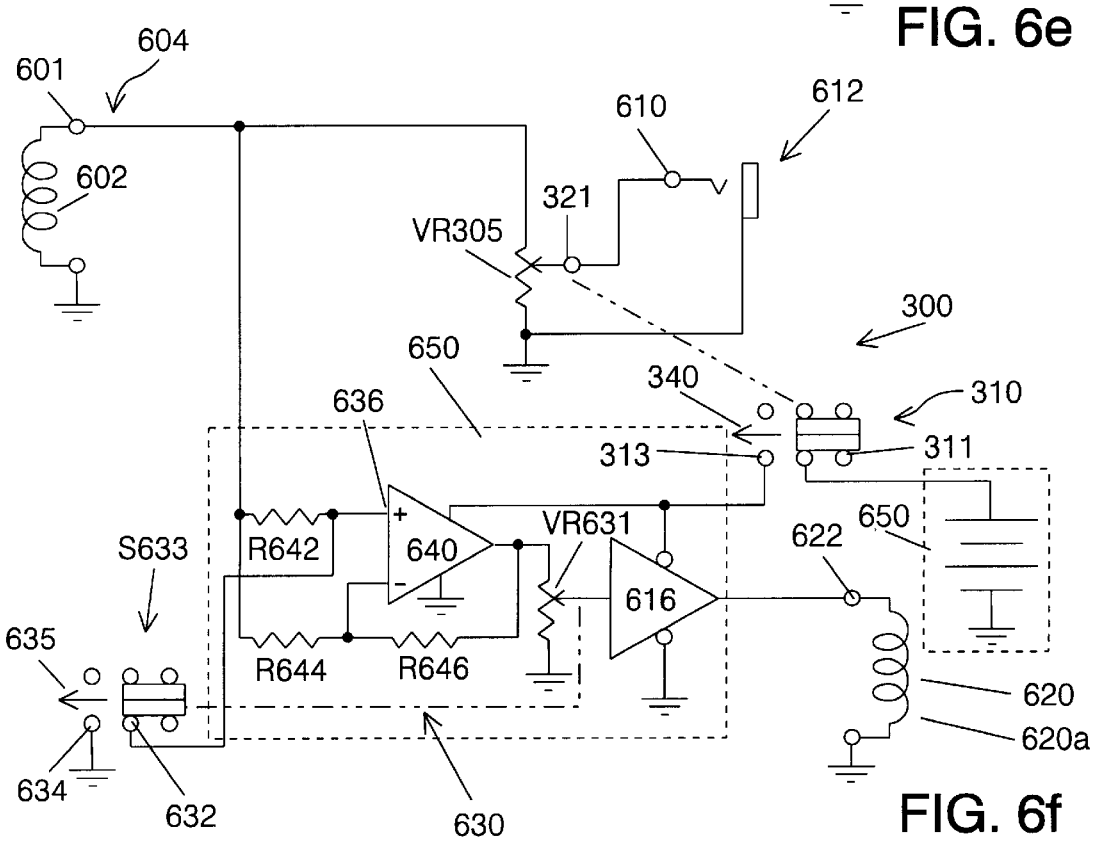

The schematic of FIG. 6*f* shows another option. Potentiometer VR631 of FIG. 6*e*, which is used as the instrument tone control, is instead used in FIG. 6*f* to control a sustainer function. This means that for the example of this particular instrument, the tone control function which was originally accomplished by potentiometer VR606 and capacitor C609 is lost. In the example shown, potentiometer VR631 of switch/potentiometer combination control 630 is used to control the amplitude of the input signal to sustainer amplifier 616. Switch S633 of switch/potentiometer combination control 630 is still used to change the phase of the drive signal, as shown in FIG. 6*e*. Such a sustainer control function potentiometer VR631 might control another parameter of the sustainer drive signal, such as phase vs. frequency, or amplitude vs. frequency. Although replacing a basic function control of an instrument such as tone control compromises the original intended function of the instrument, such a replacement might be desirable to some musicians in order to embellish the functionality of the sustainer. As with the above modifications to the instrument of FIG. 6*d* and FIG. 6*e*, since no permanent damage is done to the instrument by making such a replacement, the instrument may be restored to its original condition without decreasing its value. This is an advantage of the invention.

Figure 7A:
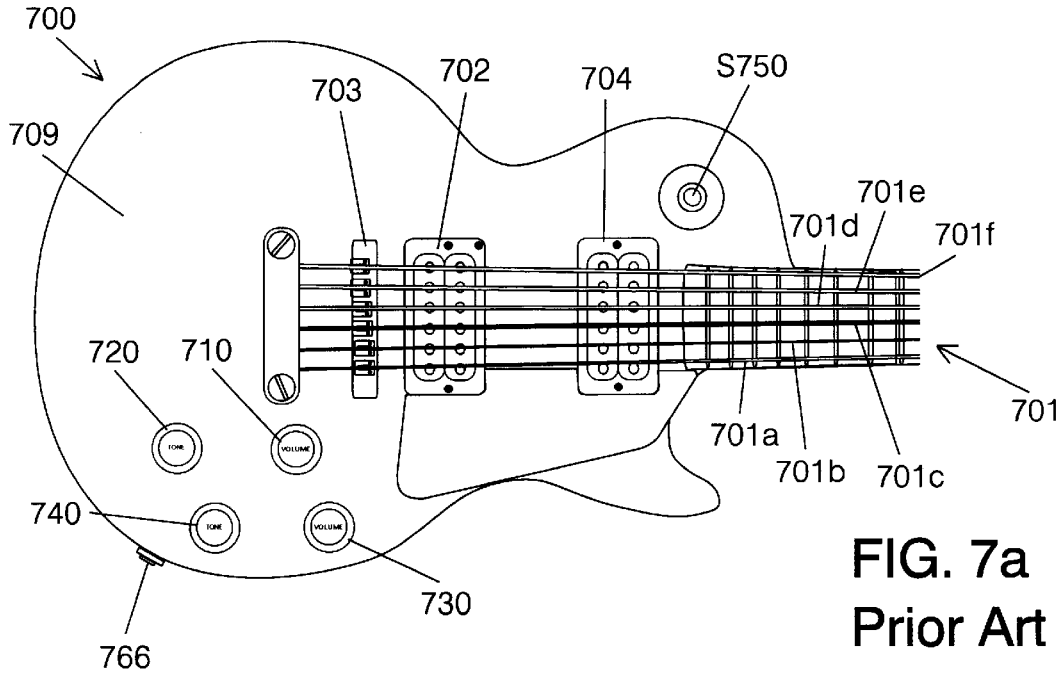
FIG. 7a Prior Art
FIG. 7*c* Electric guitar front plan view of FIG. 7*a* having magnetic sustainer installed FIG. 7*d* Electrical schematic of guitar and sustainer of FIG. 7*c*, showing switch/potentiometer combination of FIG. 3 as guitar control and sustainer power switch, also showing pickup substitution switching function, where the bridge pickup is a "first pickup".
FIG. 7*e* Electric guitar front plan view of FIG. 7*a* having acoustic sustainer installed FIG. 7*f* Electrical schematic of guitar and sustainer of FIG. 7*d*, showing switch/potentiometer combination of FIG. 3 as guitar control and sustainer power switch, also showing pickup substitution switching function, where the neck pickup is a "first pickup".
FIG. 7*g* Electrical schematic of guitar and sustainer of FIG. 7*f*, having one guitar function potentiometer converted to a sustainer function potentiometer.
Figure 7B:
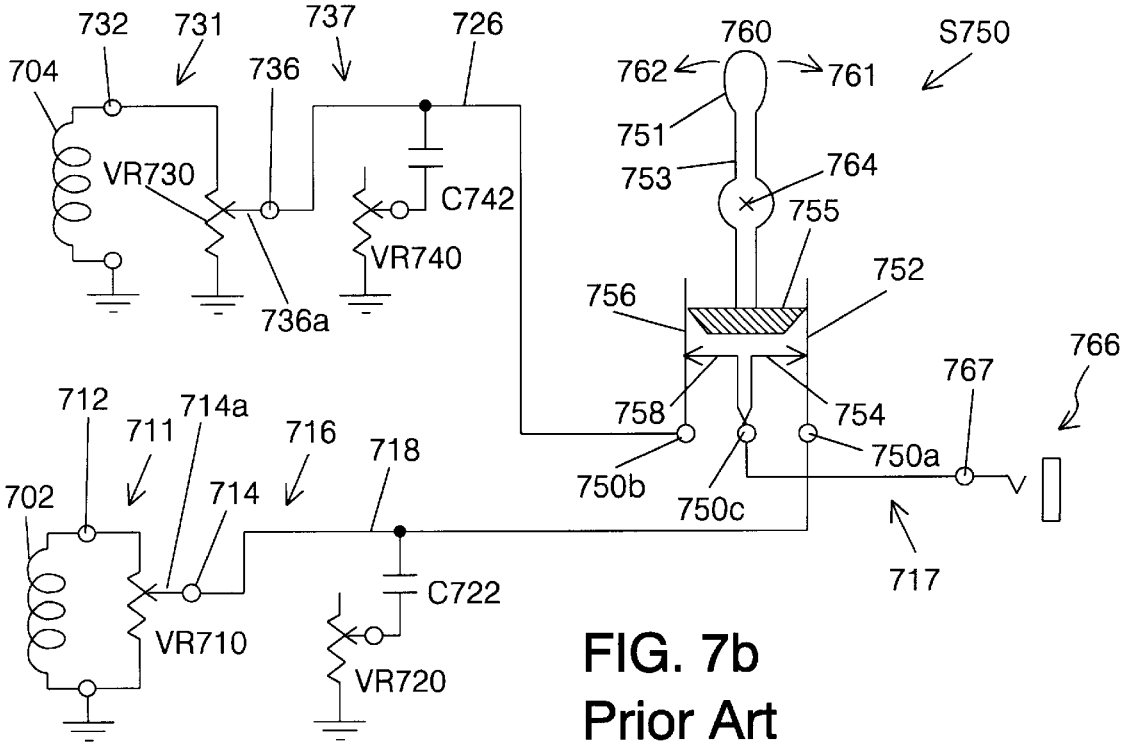
FIG. 7b Prior Art

In accordance with a second aspect of the invention, a sustainer is provided for an electric stringed instrument which has at least one string. FIG. 7*a* shows a front plan view of a popular prior art electric guitar, a version of the "Les Paul" model, made by Gibson guitars of Nashville, Tenn. FIG. 7*b* shows a schematic diagram of the same instrument. The instrument 700 comprises the following elements: Bridge pickup 702, a humbucking pickup located adjacent to guitar bridge 703, is provided for sensing and producing a bridge pickup signal 711 at bridge pickup output terminal 712 in response to vibrations of the instrument strings 701*a–f*. This pickup has two coils connected in series, positioned side-by-side as shown in FIG. 7*a*. FIG. 7*b* does not show both coils, in order to keep details to a minimum. Potentiometer VR710 functions as volume control for bridge pickup output signal 711. Knob 710 is visible on the surface of the body 709 of guitar 700. Knob 700 is attached to the rotary shaft (not shown) of potentiometer VR710 for actuating the shaft, which controls the wiper element 714*a* of potentiometer VR710. Terminal 714 is the wiper terminal of potentiometer VR710. Conductor 718 connects the volume-controlled bridge pickup signal at potentiometer wiper terminal 714 to terminal 750*a* of pickup selector switch S750. Potentiometer VR720 is provided in conjunction with capacitor C722 for controlling the tone of volume-controlled bridge pickup signal 718.

Neck pickup 704, also a humbucking pickup, located adjacent to neck 701, is provided for sensing and producing a neck pickup signal 731 at neck pickup output terminal 732 in response to vibrations of the instrument strings 701*a–f*. This pickup likewise has two coils connected in series, positioned side-by-side as shown in FIG. 7*a*. Potentiometer VR730 functions as volume control for second pickup output signal 731. Knob 730 is attached to the rotary shaft (not shown) of potentiometer VR730 for actuating the shaft, which controls the wiper element 736*a* of potentiometer VR730. Terminal 736 is the wiper terminal of potentiometer VR730. Conductor 726 connects the volume-controlled neck pickup signal at potentiometer wiper terminal 736 to terminal 750*b* of pickup selector switch S750. Potentiometer VR740 is provided in conjunction with capacitor C742 for controlling the tone of volume-controlled neck pickup signal 737.

Pickup selector switch S750 selects either volume-controlled and tone-controlled bridge pickup signal 716 or volume-controlled and tone-controlled neck pickup signal 737, or the combination of both these signals. This selected pickup output signal 717 is applied to instrument output terminal 767 of output jack 766 from pickup selector switch common terminal 750*c*. Pickup selector switch S750 is a three position toggle switch. Finger pressure on handle 751 moves lever 753, which rotates about fulcrum 764. As shown in FIG. 7*b*, insulated pressure pad 755 contacts both leaf spring contacts 752 and 756 in center position 760 of handle 751. In this center position, leaf spring contact 752 contacts stationary contact 754, which connects volume-controlled bridge pickup signal conductor 718 to output terminal 767 of output jack 766 through conductor 750*c* of switch S750. Also in the center position, leaf spring contact 756 contacts stationary contact 758, which connects volume-controlled neck pickup signal conductor 726 to output terminal 767 of output jack 766 through conductor 750*c* of switch S750. Therefore, both bridge and neck pickups are selected in this center position of pickup selector switch 760.

When handle 751 is moved to position 761, insulated pressure pad 755 pushes leaf spring contact 756 away from stationary contact 758, which disengages the two contacts. This disconnects volume-controlled neck pickup signal 737 from center contact 750*c*, leaving only volume-controlled bridge pickup signal selected. Similarly, when handle 751 is moved to position 762, insulated pressure pad 755 pushes leaf spring contact 752 away from stationary contact 754, which disengages the two contacts. This disconnects volume-controlled bridge pickup signal 716 from output terminal 767, leaving only volume-controlled neck pickup signal selected. This type of pickup control scheme is found on many guitars having two humbucker pickups.

Figure 7C:
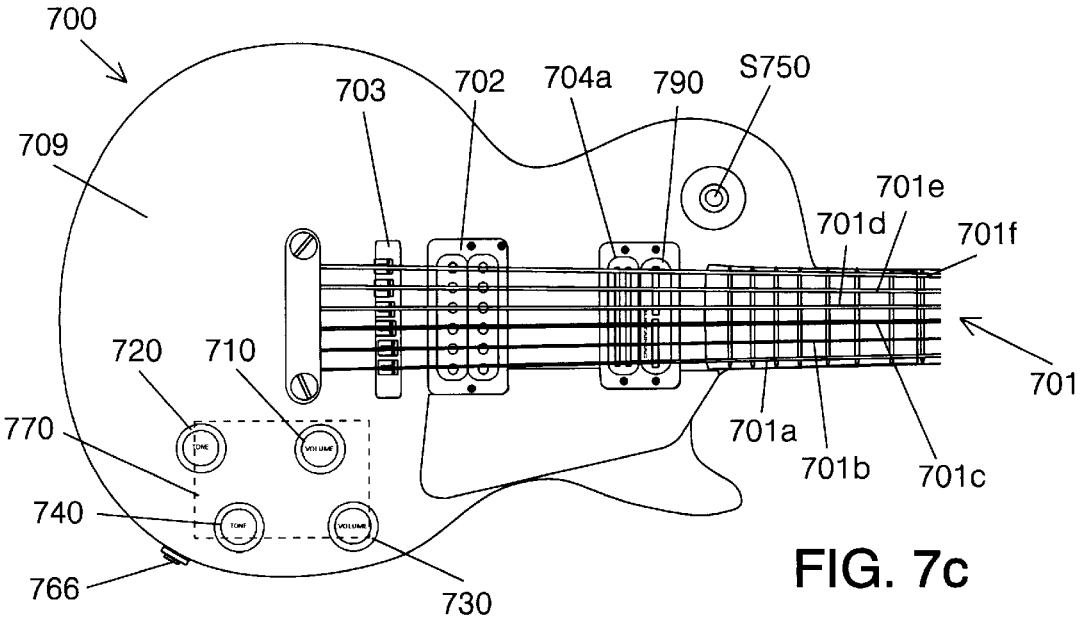

FIG. 7*c* shows a front plan view of the instrument of FIG. 7*a* and 7*b*, after being modified by having a magnetic sustainer installed. Dashed box 770 of FIG. 7*c* shows the electronic circuit of the sustainer and power supply in hidden view, which is mounted into the existing guitar electronics cavity (not shown). Full-size humbucker neck pickup 704 of FIG. 7*a* is shown replaced by half-size humbucker neck pickup 704*a* in FIG. 7*c*. Sustainer magnetic transducer 790 sits adjacent to neck pickup 704*a*. Both pickup 704*a* and transducer 790 fit into the space formerly occupied by full-size humbucker 704, in order to preserve as much as possible the original appearance of the instrument. Examination of the guitar of FIG. 7*c* having a sustainer installed shows that the physical appearance of the guitar is substantially similar to that of FIG. 7*a*, which is the intent of the invention.

Figure 7D:
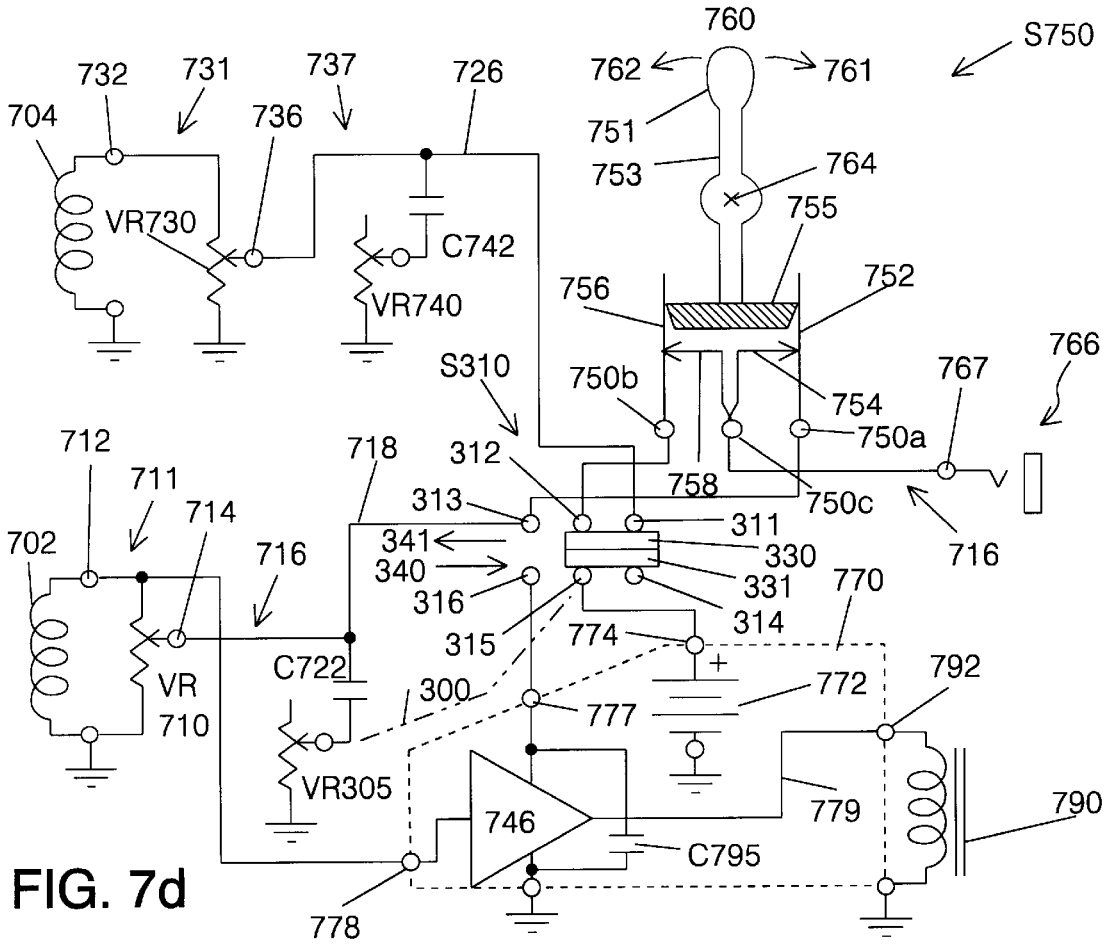

FIG. 7*d* shows an electrical schematic of the sustainer circuitry 770 (enclosed by a dashed box) and guitar circuitry, showing how the basic function guitar circuitry and sustainer circuitry are interconnected in order for the guitar and sustainer to function properly together. Sustainer circuitry 770 consists of power supply 772 and amplifier 746. These function in conjunction with existing guitar basic function circuit elements and sustainer transducer 790. Certain actual details of the sustainer circuit are deliberately left out of schematic drawing FIG. 7*d*, such as equalization circuitry, specific circuit elements of the amplifier, and automatic gain-control circuitry, in order to keep the complexity of the drawing at a minimum. The entire circuit is depicted here as an amplifier block 746. Omission of these other details does not detract from the actual invention presented here, which is concerned with the interface between the instrument and sustainer and not specific electronic embellishments designed to enhance certain parameters of sustainer performance.

Bridge pickup output terminal 712 is connected directly to input 778 of sustainer amplifier 746, as well as to bridge pickup volume control VR710. Volume-controlled bridge pickup signal 716 becomes the instrument output signal when the bridge pickup is selected by pickup selector switch S750. Output 779 of sustainer amplifier 746 is applied to input terminal 792 of sustainer transducer 790. Vibrations of the instrument strings are sustained because string vibration energy which would normally be lost to friction is replenished magnetically by transducer 790 in response to output 779 of sustainer amplifier 746. Transducer 790 could be an acoustic-type transducer, imparting acoustic vibration energy into one or both ends of the strings in order to sustain their vibration, and the invention would still function substantially as described.

Bridge pickup tone control potentiometer VR720 of FIG. 7*b* is shown in FIG. 7*d* replaced by potentiometer/switch combination 300, as described in the PRIOR ART section and shown in FIG. 3. Tone control potentiometer VR305 operates in conjunction with capacitor C722 to adjust the tone of pickup output signal 711. Sustainer on/off switch S310 is an integral part of instrument control potentiometer VR305. The rotary shaft (not shown) of potentiometer/switch combination 300 is fitted with control knob 720. Therefore, potentiometer/switch combination 300 appears from the front of the instrument as shown in FIG. 7*c* substantially as in FIG. 7*a*. The function of sustainer on/off switch S310 is to turn the sustainer on and off. The function of instrument control potentiometer VR305 is to control the tone of the bridge pickup signal 711. Potentiometer VR305 could be a control potentiometer for some other instrument parameter, such as a volume control, without affecting the intent of the invention. Sustainer on/off switch S310 is actuated by the rotary shaft of potentiometer VR305. The potentiometer shaft is used to actuate the potentiometer by moving the potentiometer wiper along its resistive element.

The preferred method of actuating Sustainer on/off switch S310 is "pull-push", where pulling on the potentiometer rotary shaft turns the sustainer on, and where pushing on the potentiometer shaft turns the sustainer off (or, the reverse). Other standard actuation methods are possible. Examples of other standard actuation methods would be "push-push", where alternately pushing on the potentiometer shaft turns the sustainer on and off. Still another actuation method would be "momentary push", where as long as the potentiometer shaft is held pushed, the sustainer is on, but as soon as pushing pressure is released from the shaft, the sustainer turns off. This would be useful if only short time intervals of sustained string vibration are desired to enhance a musical performance. Still another common actuation method of switch S310 is to rotate the potentiometer shaft in one direction to turn the sustainer on, and in the opposite direction to turn the sustainer off. These offered switch-actuation examples are not meant to be all-inclusive. Other methods of actuating switch S310 might be possible, which would not negate the intent of this aspect of the invention. The main intent is that the sustainer on/off switch be an integral part of an instrument control potentiometer, such that actuation of the switch is accomplished by moving the rotational shaft of the potentiometer. An advantage of this aspect of the invention, and improvement over the prior art, is that when the instrument is viewed from normal viewing angles, the instrument appears as though there is no switch S310 visible to the observer, thereby preserving the original aesthetic appearance of the instrument.

Sustainer on/off switch S310 is shown in FIG. 7*d* to be of the double-pole, double-throw type (DPDT). It has two operational positions: The "off" position of the sustainer is shown by arrow 340. The "on" position of the sustainer is shown by arrow 341.

When the sustainer is switched "on" by actuating sustainer on/off switch S310, shown by arrow 341, pole 331 shorts out contacts 315 and 316, which completes the electrical circuit between positive terminal 774 of dc power supply 772 and Vcc terminal 777 of sustainer amplifier 746. The ground terminals of amplifier 746 and power supply 772 complete the power supply circuit. Obviously, the power supply switch terminals could be in the ground circuit without changing the intent of the invention. When the sustainer is switched off, as is the condition of S750 in FIG. 7*d*, this path is broken.

In the "off" position 340 of switch S310, pole 330 shorts out terminals 311 and 312 of S310. In this "off" condition, wiper terminal 736 of neck pickup volume control potentiometer VR730, which carries volume-controlled neck pickup output signal 737, is connected through switch S310 pole 330 to terminal 750*b* of pickup selector switch S750. In this "off" condition of the sustainer, pickup selector switch S750 selects bridge pickup 702 or neck pickup 704 or the combination of both pickups 702 and 704 as in PRIOR ART drawings 7*a* and 7*b*. When the sustainer is switched "on", pole 330 shorts out terminals 312 and 313 of S750. In this "on" condition of switch S750, volume-controlled bridge pickup signal 716 is connected to terminal 750*b* of switch S750 through sustainer on/off switch S310, pole 330. Sustainer on/off switch S310 provides an automatic neck pickup substitution signal, substituting volume-controlled bridge pickup output signal 716 for volume-controlled neck pickup output signal 737. Therefore, when the sustainer is turned "on" by switch S310, the pickup selector switch selects only bridge pickup 702 for all three switch positions 760, 761, and 762.

The reason for selecting only the bridge pickup when the sustainer is on is to minimize magnetic "crosstalk" which is produced by the magnetic field which is radiated by transducer 790. When the sustainer is on, this magnetic field radiation, which induces vibration energy into strings 701*a*–701*f* in order to sustain their vibration, also impinges on both pickups 702 and 704*a*. Since neck pickup 704*a* sits immediately adjacent to transducer 790, it receives substantially more magnetic crosstalk energy than does bridge pickup 702, due to the established inverse square relationship between radiated electromagnetic energy and distance. Therefore, if neck pickup 704*a* is selected when the sustainer is on, excessive noise and distortion is generally heard due to this magnetic crosstalk from the driver transducer 790.

Furthermore, if neck pickup 704*a* is allowed to produce the input signal to sustainer amplifier 746, this excessive magnetic crosstalk will generally limit sustainer performance to an unacceptably low level. In order to have robust performance, the gain of sustainer amplifier must be set to a relatively high level. As the gain of amplifier 746 is increased, a level is reached where uncontrolled feedback oscillation occurs. As the distance between transducer 790 and the pickup which provides the input signal to amplifier 746 is allowed to decrease incrementally, the gain level where this oscillation occurs correspondingly decreases incrementally. (This is analogous to the well-known feedback oscillation situation in acoustics where the feedback loop consists of microphone, amplifier, and speakers of a typical public address sound reinforcement system. The system gain must often be monitored, or a similar uncontrolled oscillation "squeal" often occurs until the gain is lowered to an appropriate level. This occurs because sound produced by the speakers is sensed and responded to by the microphone, which produces a microphone output signal which is amplified, and then reproduced by the speakers. If the gain is set too high, then an oscillation occurs at some dominant frequency which has more system gain than other frequencies, resulting in the familiar characteristic single-frequency oscillation.) As the amplifier gain of the sustainer is lowered, sustainer robustness decreases. A minimum spacing between transducer and pickup is reached where the gain has to be set so low in order to prevent uncontrolled oscillation due to direct magnetic feedback, that the sustainer robustness is no longer useful for effective musical expression. This minimum distance has been found experimentally with known transducer technology to be approximately 5 cm. The distance between transducer 790 and neck pickup 704*a* is only about 2 cm. The distance between transducer 790 and bridge pickup 702 for the Gibson "Les Paul" model guitar is typically over 10 cm.

For the example of FIGS. 7*c* and 7*d*, the bridge pickup is the preferred pickup signal during operation of the sustainer. Also, the bridge pickup supplies the input signal to the sustainer. Because of this, the bridge pickup signal 716 is defined as the "first" pickup signal 716. Since operation of the neck pickup signal during operation of the sustainer would result in a compromised performance, the neck pickup signal 736 is referred to as the "second" pickup signal. It can only be selected if the sustainer is in the "off" condition. If, in the example of FIGS. 7*c* and 7*d* the transducer 790 was placed adjacent to bridge pickup 702, and spaced relatively far from neck pickup 704*a*, then neck pickup signal 737 would become "first" pickup signal and bridge pickup signal 716 would become "second" pickup signal, requiring that during sustainer operation only first pickup signal be selected for optimum operation.

The sustainer depicted in FIGS. 7*c* and 7*d* and described herein has a magnetic-type driver transducer. However, it could be an acoustic-type transducer, and would not negate the intent of the invention. If the transducer was of the acoustic type as described in Prior Art U.S. Pat. No. 3,813,473, Terymenko, where the acoustic transducer (not shown) is attached to bridge 703 of the instrument, a similar situation would exist. In this case, the transducer sits close to bridge pickup 702, and couples more magnetic energy into bridge pickup 702 than it couples to neck pickup 704*a*, which is spaced farther away from the transducer. For this case, bridge pickup signal 716 would become "second" pickup signal, and neck pickup signal 737 would become "first" pickup signal. For this case, it would be best to provide automatic substitution means of only neck pickup 704 (or 704*a*) when the sustainer is on.

Figure 7E:
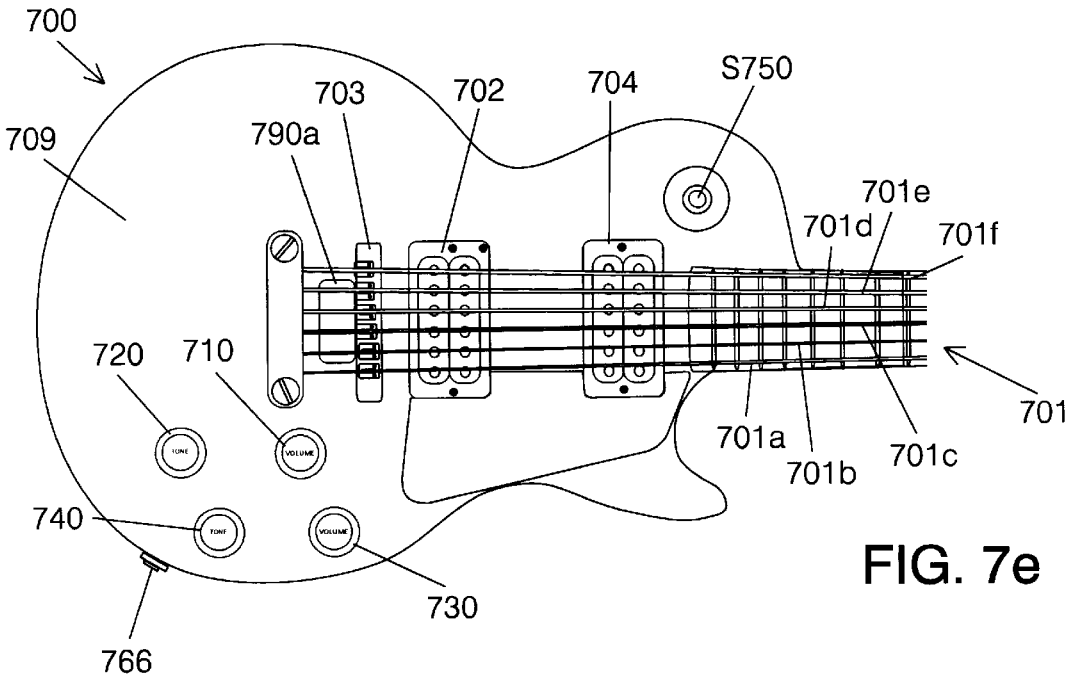
Figure 7F:
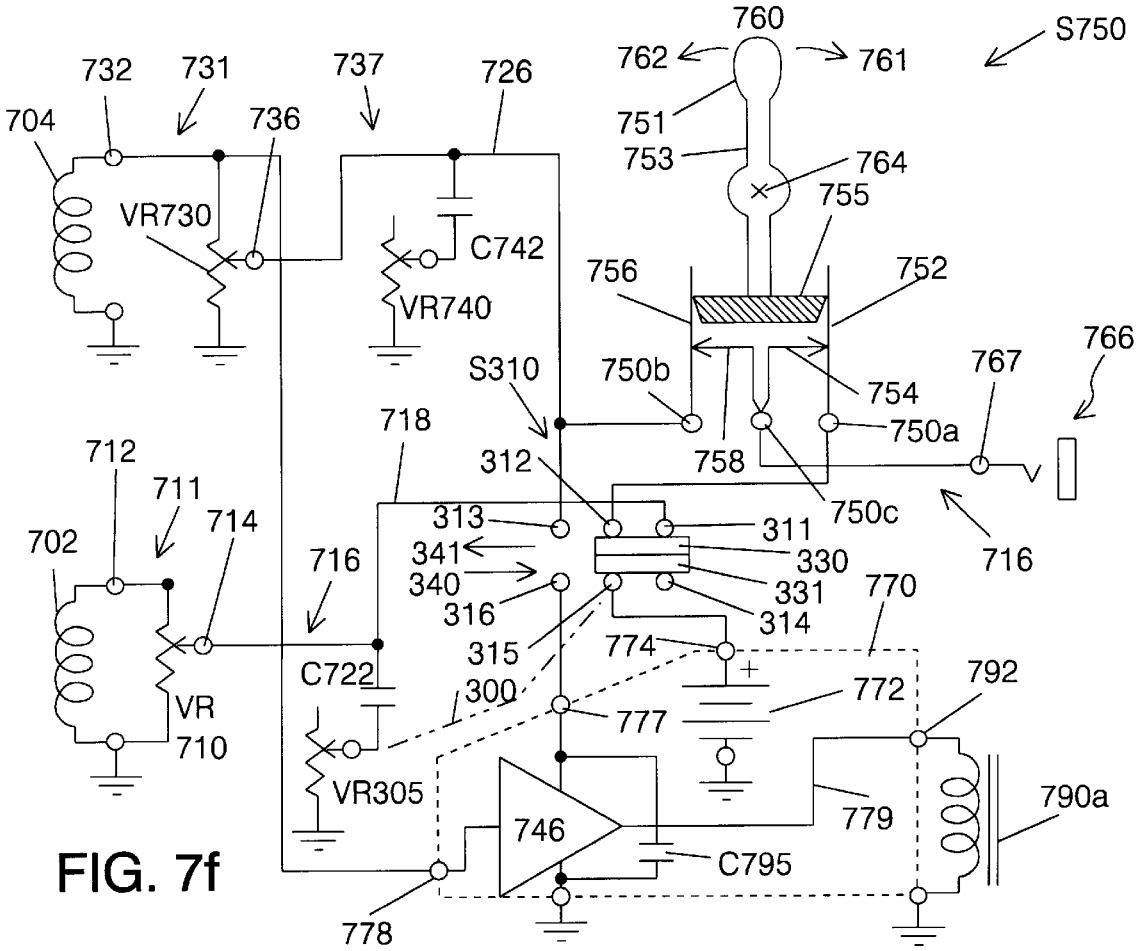

FIG. 7*e* shows a front plan view of the same guitar as FIG. 7*c*, with the main exception that magnetic transducer 790 of FIG. 7*c* has been replaced with acoustic transducer 790*a*. Half-size neck pickup 704*a* of FIG. 7*c* has been replaced by original full-size neck pickup 704 of FIG. 7*a*. FIG. 7*f* depicts a schematic diagram of the guitar and sustainer electronics of FIG. 7*d*, with the exception of the reversal of the role of bridge and neck pickups. In FIG. 7*f*, neck pickup 704 is first pickup and bridge pickup 702 is second pickup, as described in the previous paragraph. This reversal of roles is due to the fact that bridge pickup 702 is located adjacent to transducer 790*a*, and therefore is substantially more susceptible to magnetic crosstalk than is neck pickup 704.

Figure 7G:
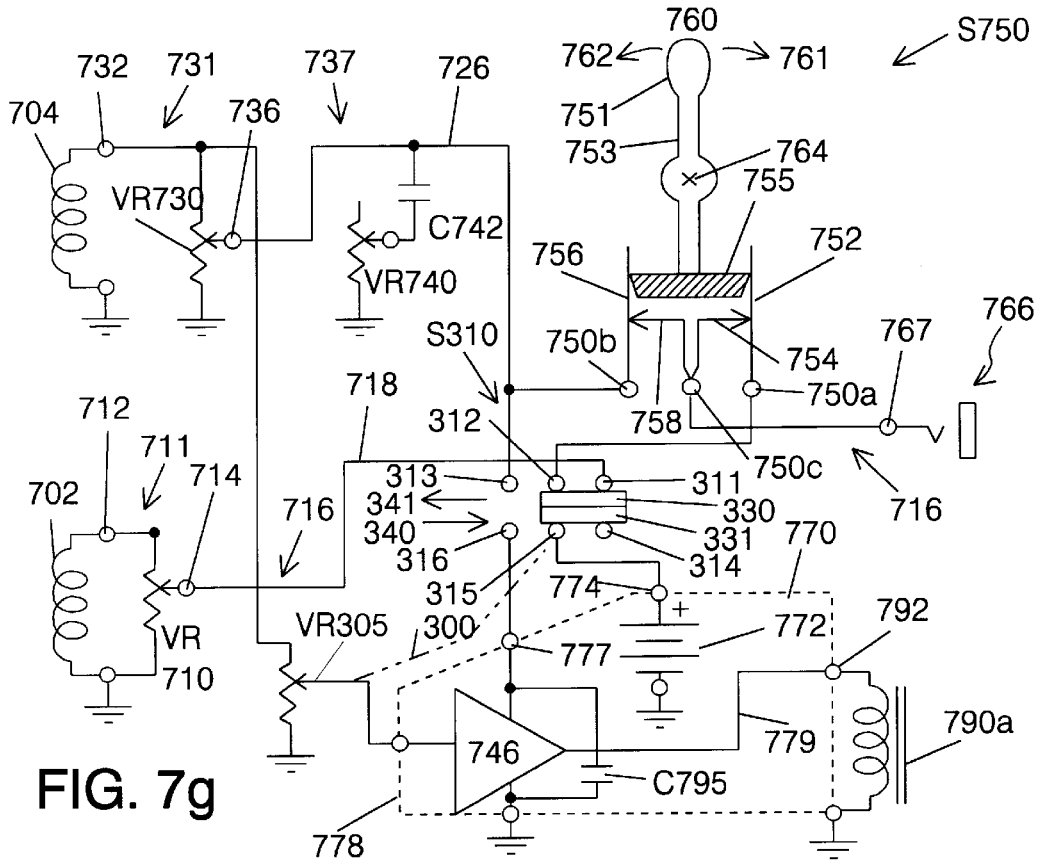

FIG. 7*g* shows the sustainer of FIG. 7*f*, having bridge pickup tone control potentiometer VR305 converted to sustainer "drive" potentiometer. It controls the amplitude of first (neck) pickup output, connected to input terminal 778 of sustainer 770. A control function of the instrument has been given up in order to increase the effectiveness of the sustainer. Other such control substitutions could be made, such as adding a sustainer phase control potentiometer by giving up another guitar function pot, without negating the intent of the invention.

The sustainer of FIGS. 7*c*, 7*d*, 7*e*, 7*f*, and 7*g* provide automatic substitution means of first pickup signal for second pickup signal whenever the sustainer is switched on.

Placement of the volume and tone controls in the signal paths of the pickups of the example of FIGS. 7*c* and 7*d* are not critical to the intent of the invention. A single volume or single tone control could be used, and they could be placed in the signal path between center contact 750*c* of switch S750 and output terminal 767. Other arrangements of the instrument basic function controls could be utilized without compromising or negating the intent of the invention.

It is typical for magnetic sustainers to have input to the sustainer amplifier connected directly to the first pickup output terminal, rather than to a volume-controlled or tone controlled first pickup signal. This is because sustainers work better if the direct connection is made. However, if such an alternative processed-signal connection were to be made, it would not negate the intent of the invention.

Other connection schemes, volume control schemes, tone control schemes, and pickup selector switch schemes could be substituted for the above-described guitar and sustainer without negating the intent of the invention. For instance, in some guitar models, the pickup selector switch comprises multiple toggle switches, one for each pickup, having a common pole which is connected to the instrument output terminal. As another example, separate pickup tone controls could be replaced with a single tone control connected between the pickup selector switch common terminal and the instrument output terminal (or between common poles of multiple toggle switches and instrument output terminal, in the case of multiple separate pickup toggle switches). Or, a single volume control could be placed between pickup selector switch common terminal and instrument output terminal (or between common poles of multiple toggle switches and instrument output terminal, in the case of multiple separate pickup toggle switches). Numerous possibilities are possible without negating the intent of the invention.

Figure 8C:
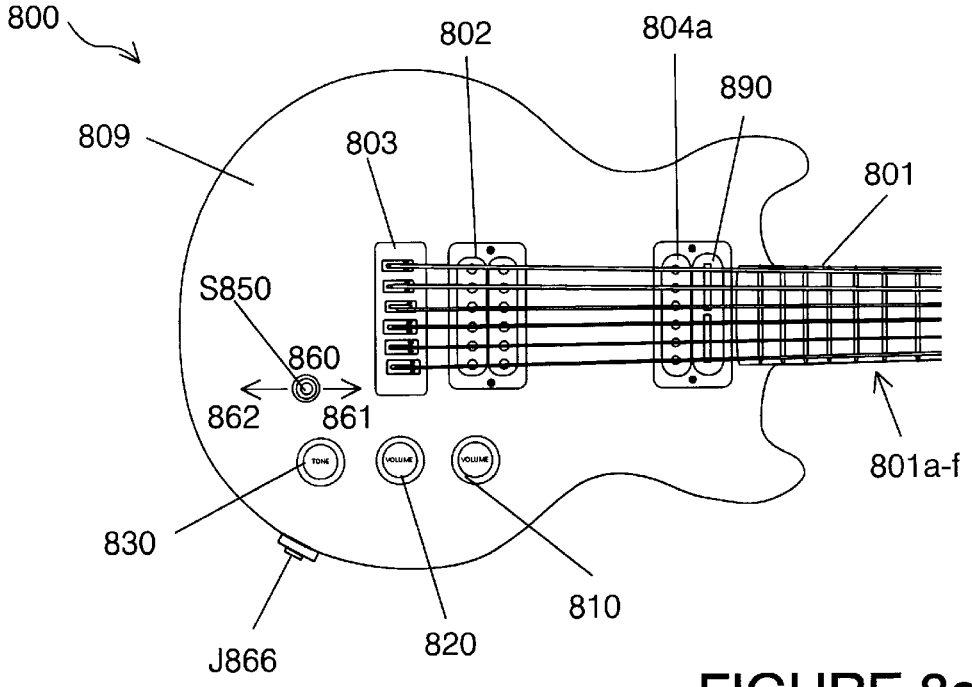
FIG. 8*c* Front plan view of the guitar of FIG. 8*a*, having a magnetic sustainer installed.
Figure 8A:
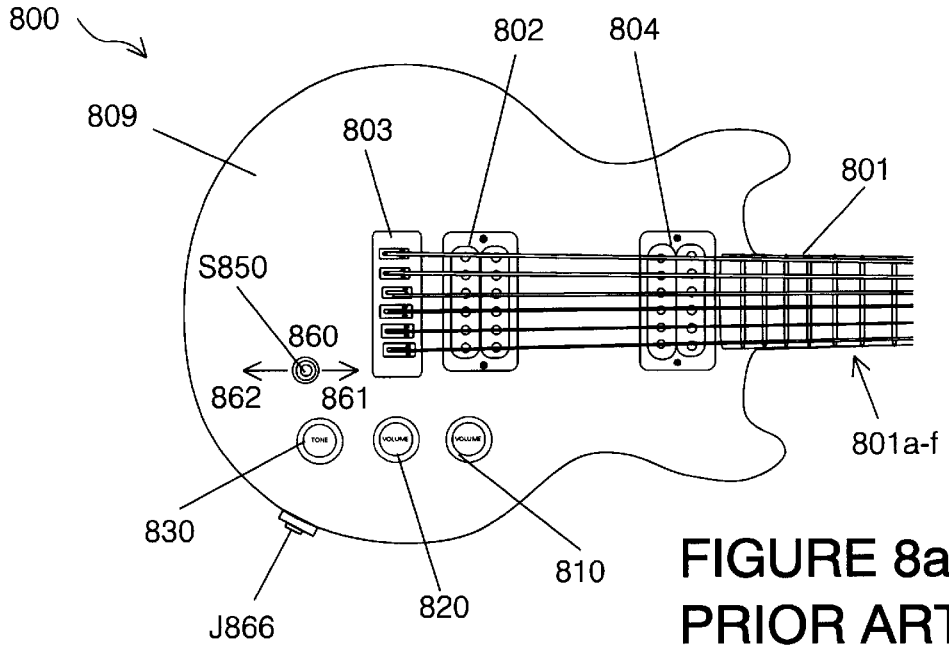
FIGURE 8a PRIOR ART
FIG. 8*a* Prior Art electric guitar front plan view
Figure 8B:
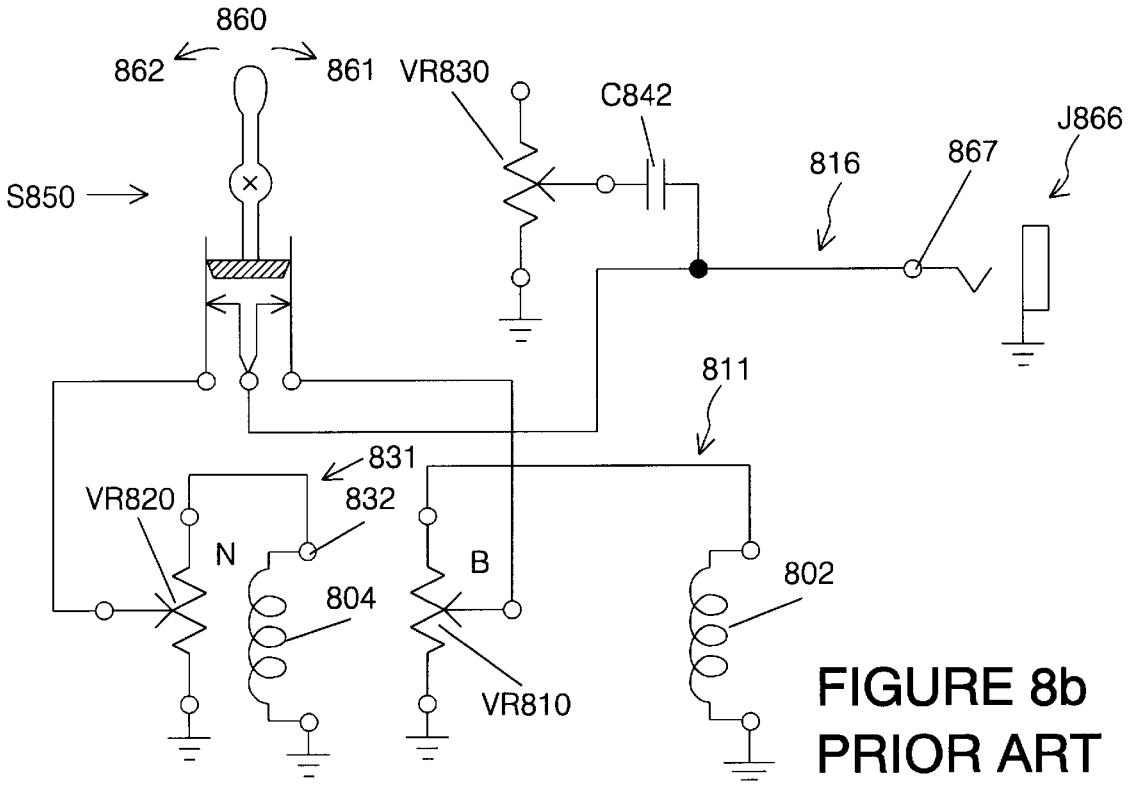
FIGURE 8b PRIOR ART
FIG. 8*b* Electrical schematic of Prior Art electric guitar of FIG. 8*a*

FIG. 8*a* shows in front plan view body 809 of a "Custom" model electric guitar 800, made by Hamer Guitars of New Hartford, Conn. This guitar, as with the Gibson "Les Paul" model of FIG. 7*a*, has two humbucker pickups for sensing and responding to the vibrations of strings 801*a–f*. FIG. 8*b* shows a schematic of the guitar 800 of FIG. 8*a*. Bridge pickup 802 is disposed adjacent to bridge 803. Neck pickup 804 is disposed adjacent to neck 801. Volume control potentiometer VR810 is provided to control the amplitude of bridge pickup output signal 811. Volume control potentiometer VR820 is provided to control the amplitude of neck pickup output signal 831. Switch S850 is provided to select either bridge pickup 802 in position 861 or neck pickup 804 in position 862 or the combination of both bridge pickup 802 and neck pickup 804 in position 860. This pickup selector switch S850 is similar to that of the "Les Paul" model shown in FIG. 7. Tone control potentiometer VR830, in conjunction with capacitor C842, is provided to adjust the tone of selected pickup output signal 816, which is applied to guitar output terminal 767 of output jack 866. Controls VR810, VR820, and VR830 are provided with control knobs 810, 820, and 830, respectively, shown in FIG. 8*a*, for turning the rotary shafts (not shown) of the potentiometers. The selected pickup output signal 816 is applied to terminal 867 of output jack J866.

Figure 8D:
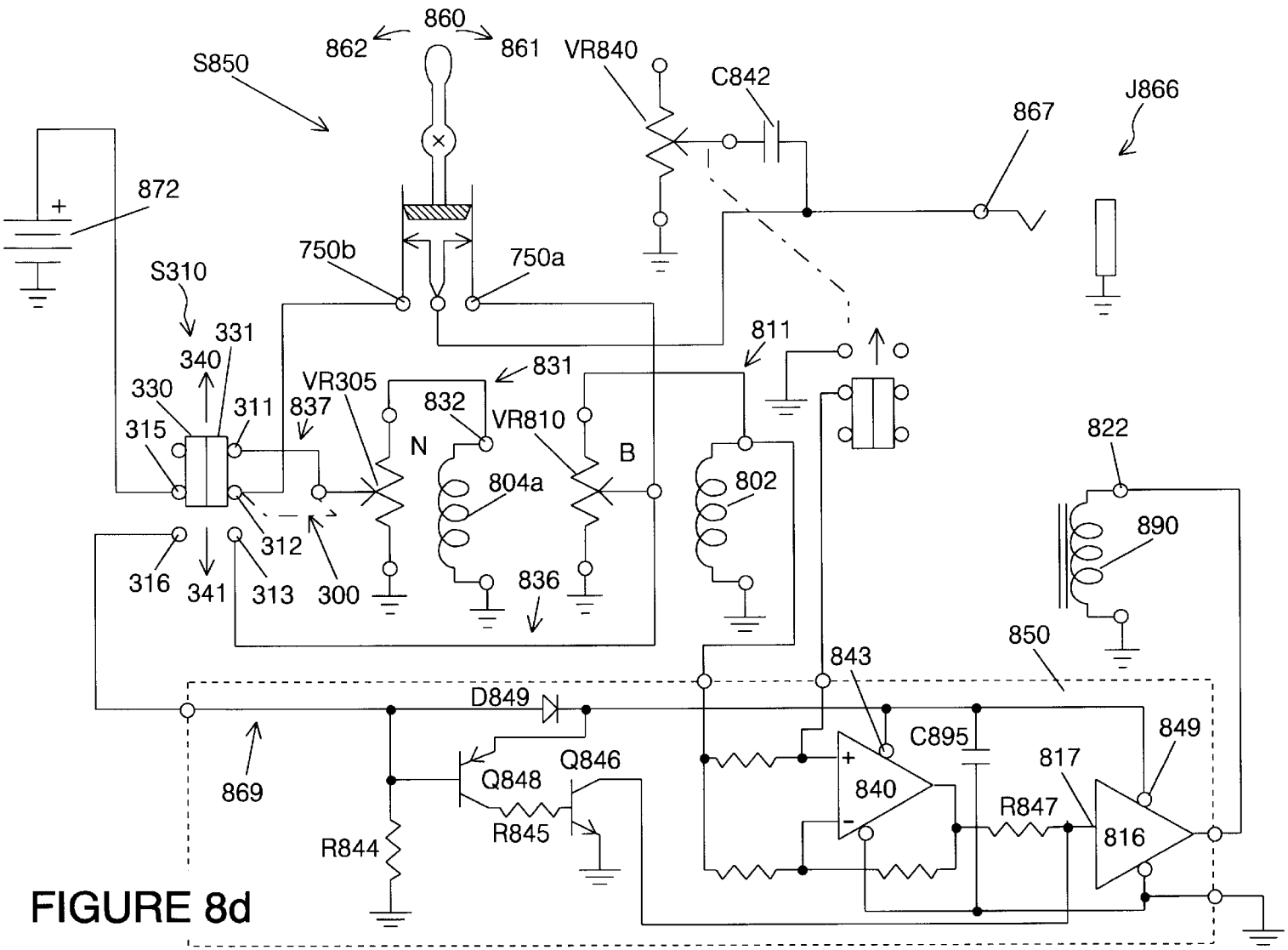
FIG. 8*d* Electrical schematic of guitar and sustainer of FIG. 8*c*, showing switch/potentiometer combination of FIG. 3 as guitar control and sustainer power switch, also showing pickup substitution switching function, where the bridge pickup is a "first pickup", also showing automatic mute function, further showing a second switch/potentiometer combination used for sustainer drive signal phase inversion.

FIG. 8*c* shows in front plan view the same guitar as FIG. 8*a*, but further including sustainer circuit 870 installed inside the guitar electronics cavity. New half-size pickup 804*a* and string driver transducer 890 replace neck pickup 804 of FIG. 8*a*. Both fit into the cavity formerly occupied by full-size humbucking neck pickup 804. FIG. 8*d* shows a schematic of the guitar and sustainer.

When a magnetic sustainer shown in the electrical schematic of FIG. 7*d* was installed into the guitar of FIG. 8*a*, a problem was noticed. When the sustainer was switched from "on" to "off" by sustainer power switch S310, a loud momentary burst of "squealing" sound was heard to come from the instrument amplifier. While the sound lasted only for approximately 50 to 100 milliseconds immediately after turning the sustainer off, it was quite loud, and unacceptable.

Examination of the problem revealed that this squealing only occurred when pickup selector switch S750 was in position 760 or 762, indicating that neck pickup 704*a* was selected. The problem did not occur when pickup selector switch S750 was in position 761, indicating only bridge pickup selection. Further examination of the problem revealed that the automatic pickup switching function combined with the normal discharge of the sustainer amplifier power supply filter capacitor C795 described above and shown in the electrical schematic of FIG. 7*d* was causing the problem. When the sustainer was switched off, sliding contact 330 of sustainer power switch S310 closed contacts 311 and 312, causing volume-controlled neck pickup ("second" pickup) output signal at terminal 736 of volume control potentiometer VR730 to be connected to terminal 750*b* of pickup selector switch S750. Immediately after disconnecting sustainer amplifier 746 from power supply 772 by actuating sustainer power switch S310, power supply filter capacitor C795 still contained charge. The sustainer is operational until C795 discharges sufficiently that sustainer amplifier 746 no longer functions. Therefore, until power supply filter capacitor C795 discharged, the second pickup was picking up an intense magnetic field being radiated by the transducer, due to its close proximity to the transducer 790.

Figure 5A:
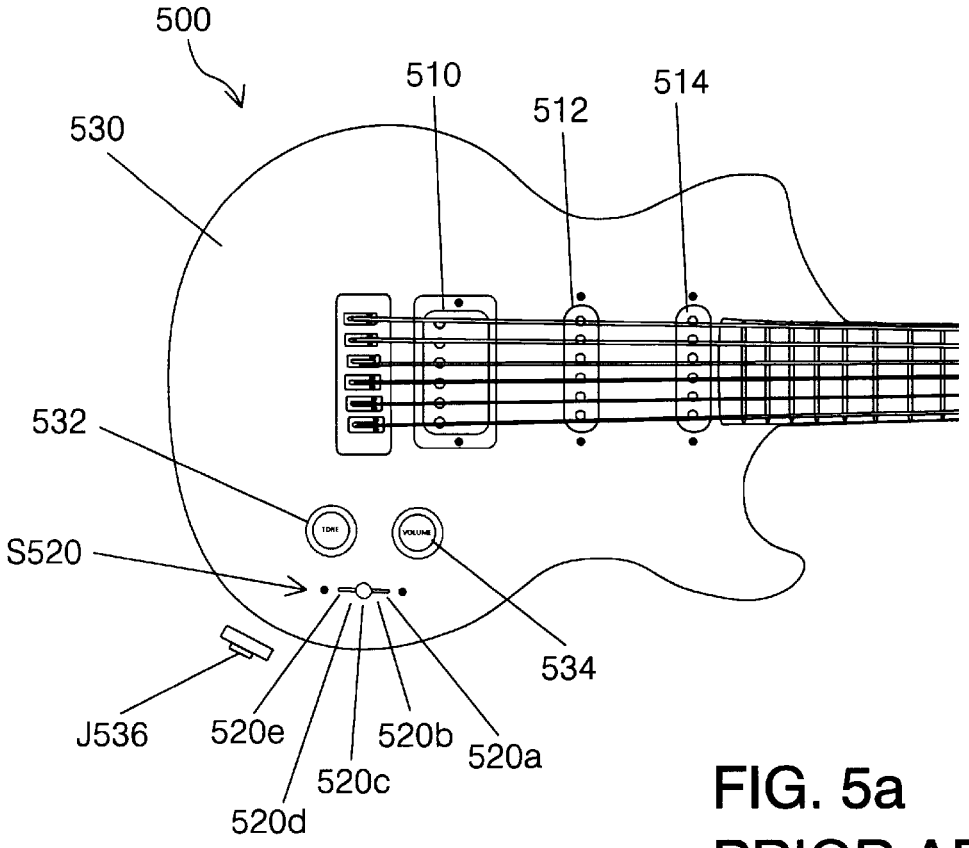
FIG. 5a PRIOR ART
Figure 5B:
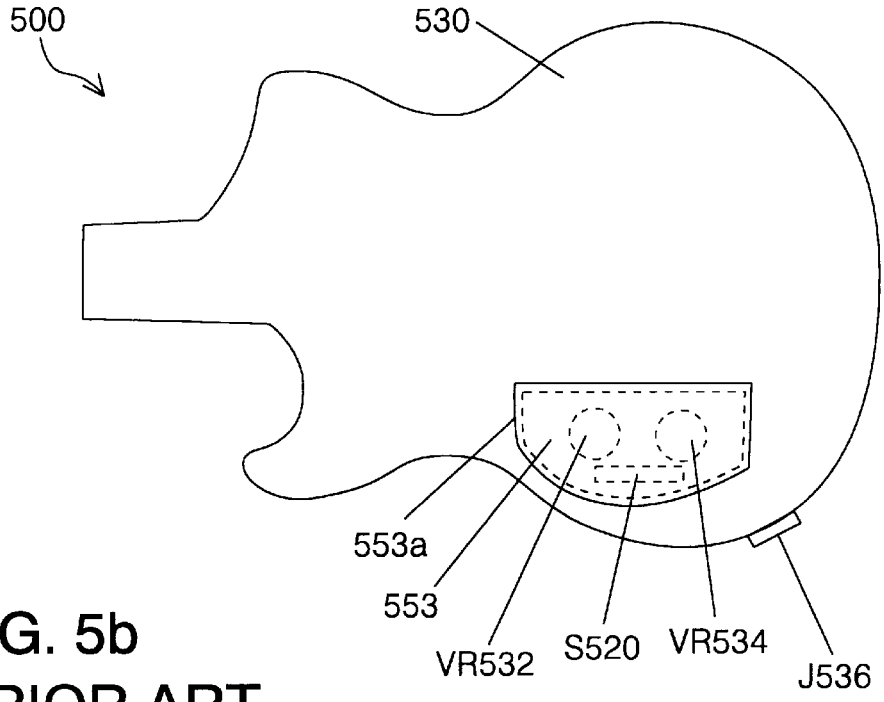
FIG. 5b PRIOR ART
Figure 5C:
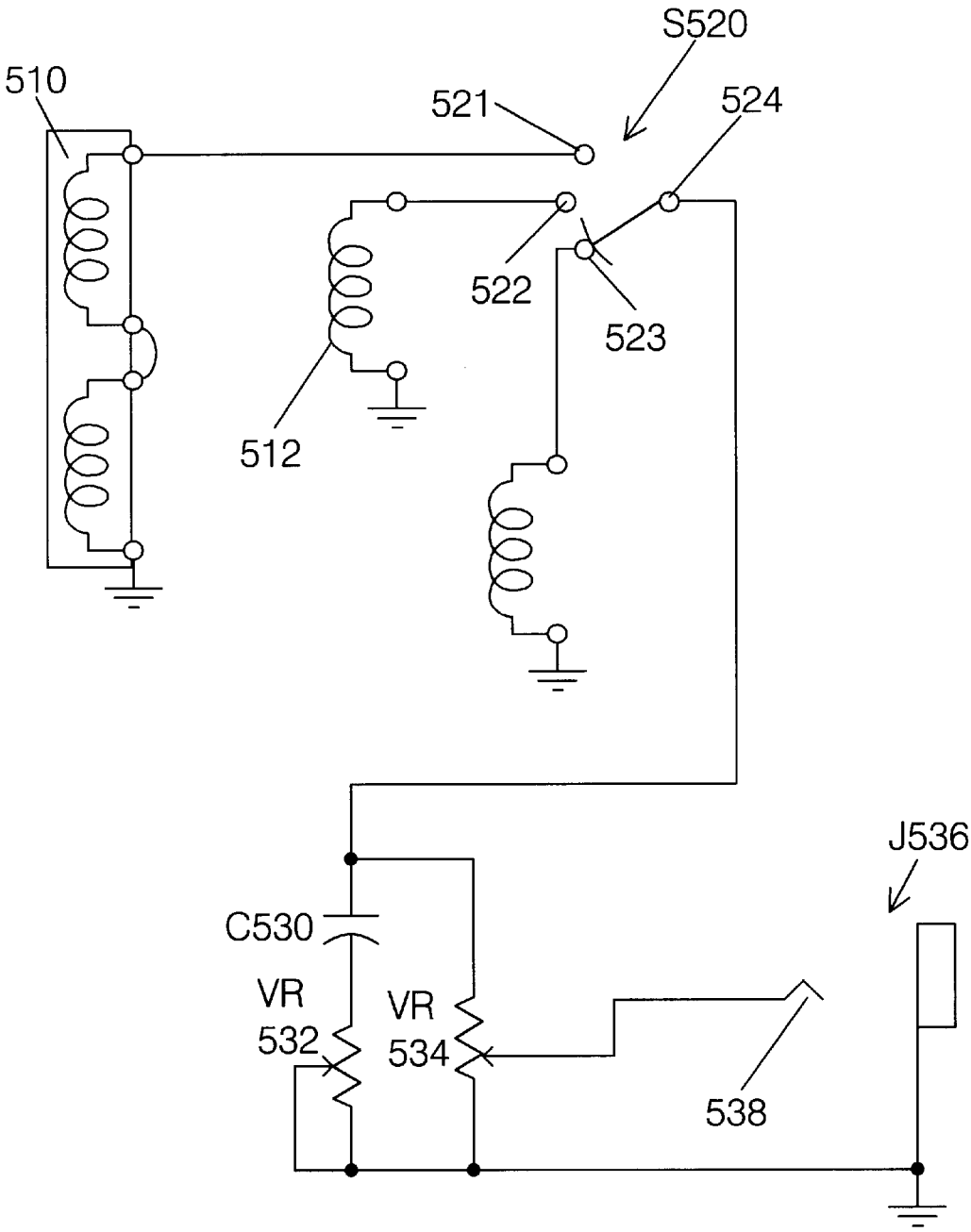
FIG. 5c PRIOR ART
Figure 5D:
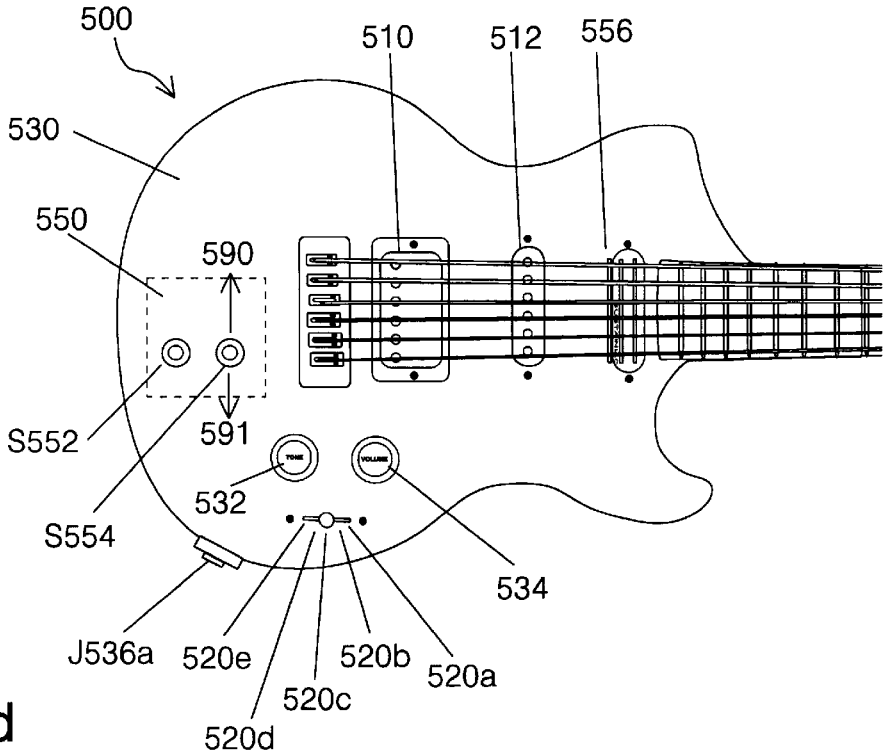
FIG. 5d PRIOR ART
Figure 5E:
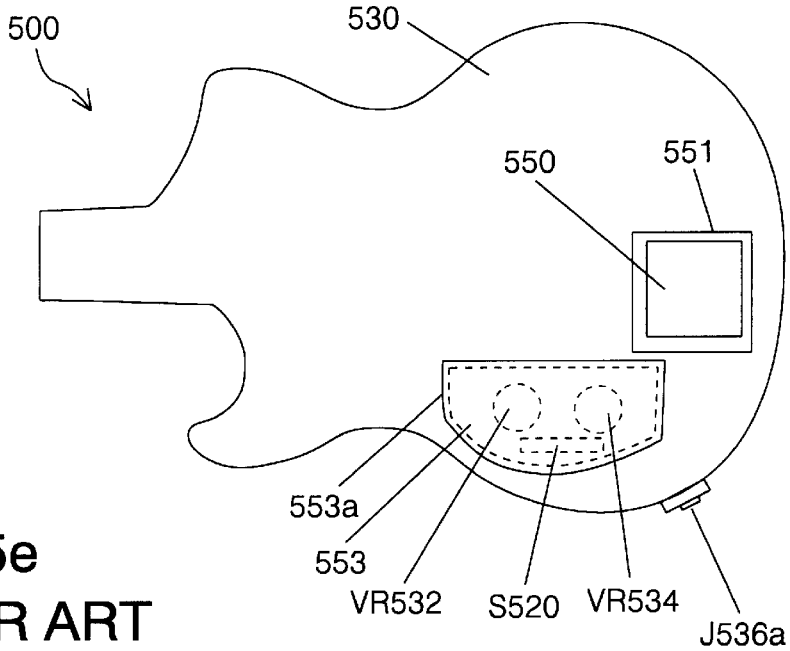
FIG. 5e PRIOR ART
Figure 5F:
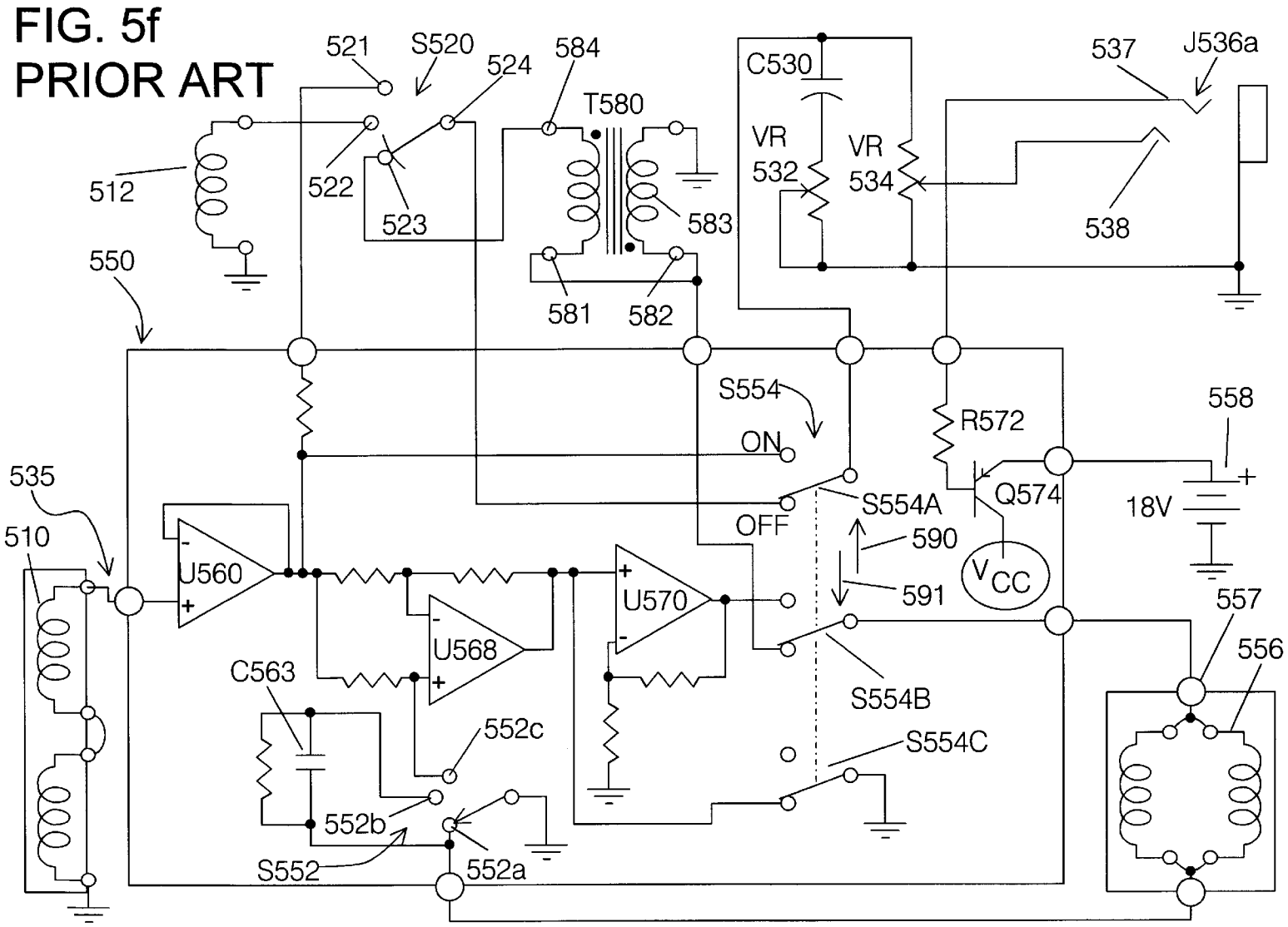
FIG. 5f PRIOR ART

The solution to the problem is to mute the sustainer drive signal 792 at some point in the signal path of the amplifier, such as input terminal 778 of amplifier 746. One possible solution is to add a third pole to switch S310, as shown by switch pole S554C of the prior art sustainer of FIG. 5*f*. However, three pole switches of the integral potentiometer/switch combination type of FIG. 3 are not readily available in the marketplace having three poles. Therefore, an electronic muting circuit was developed which responds to a mute signal.

This modification of the sustainer circuit of FIG. 7*d* is described in the following paragraphs, and depicted in FIG. 8*c* and FIG. 8*d*. The muting circuit mutes the amplifier signal immediately after S310 contacts 315 and 316 are opened. This muted condition is caused to exist for a period of time long enough for power supply filter capacitor C895 to discharge to a level where the sustainer amplifier circuitry stops functioning. In the preferred embodiment of the invention, bipolar NPN transistor Q846 is used as an electronic switch. The collector terminal is connected to the junction of resistor R847 and input terminal 817 of amplifier 816. When transistor Q846 is placed in saturation, the sustainer amplifier signal at input terminal 817 is shorted to ground through the low impedance of saturated transistor Q846, and a muted condition occurs. The mute circuit functions as follows:

When power to the sustainer is switched on, contacts 315 and 316 of sustainer power switch S310 are shorted together by conductive contactor 330. In this condition, diode D849 conducts current to the positive power supply terminals 843 and 849 of amplifiers 840 and 816, respectively. Capacitor C895, which is the power supply filter capacitor for the sustainer amplifier circuits, is charged to the power supply voltage minus the voltage drop across diode D849. PNP Transistor Q848 is held in cutoff condition, because the forward voltage drop across diode D849 holds the emitter-base junction of Q848 in reverse bias. Within a few microseconds after contacts 315 and 316 of switch S310 are opened, current flow through diode D849 ceases, and the forward voltage drop across the diode drops to zero. Capacitor C895 starts to discharge through amplifier terminals 843 and 849, since energy from power supply 872 cannot recharge C895. Capacitor C895 does not completely discharge immediately, but at a rate determined by the capacitance of C895 and also the amount of current which the amplifier circuits draw. Since the base of transistor Q848 is connected through resistor R844 to ground, when contacts 315 and 316 of sustainer power switch S310 are opened, transistor Q848 is no longer held in reverse bias condition. Transistor base current flows through resistor R844 to ground. The voltage at the base terminal of transistor Q848 becomes the value of the voltage impressed upon capacitor C895 minus the emitter-base junction drop of transistor Q848. This voltage value at the instant of the opening of switch contacts 315 and 316 constitutes mute signal 869 at the base of transistor Q848. Resistors R844 and R845 are of such values that transistor Q848 is placed into a condition of saturation. Transistor Q848 conducts current into the base of Q846 through resistor R845, placing Q846 into saturation also. This shorts out input terminal 817 of amplifier 816, thereby muting the drive signal at terminal 822 of transducer 890. Thus, a muting signal 869 is provided to affect a muted condition for the sustainer drive signal. The muting condition remains as long as there is sufficient voltage impressed across the terminals of C895 to keep transistors Q848 and Q846 in saturation. Therefore, selection of resistor values of R844 and R845 must be done such that saturation of Q848 and Q846 remains until the impressed voltage on C895 decreases to such a value that amplifiers 840 and 816 no longer function. In the preferred embodiment of the invention, these values are: R844=100K ohms, R845=10K ohms.

The muting circuit shown in FIG. 8*d* and described above, is the preferred muting circuit for the invention. However, many different variations of electronic switch circuits can be arranged to accomplish the same purpose. The preferred embodiment shown in FIG. 8*d* and described above is not meant to be the intent of the invention. Rather, the intent is to use an electronic switch in conjunction with a switch such as switch S310, regardless of the actual specific circuit topology chosen.

A similar muting circuit could be made to respond to the opening of switch contacts 315 and 316, using other types of electronic switches. Field effect transistors, CMOS gates, etc., or even an electromechanical relay could be used without negating the intent of the invention.

Alternatively, a similar electronic switch means could be made to quickly discharge capacitor C895 upon opening of contacts 315 and 316. The collector of Q846 could be connected to the cathode of D849 instead of to the input terminal 817 of amplifier 816.

Figure 8E:
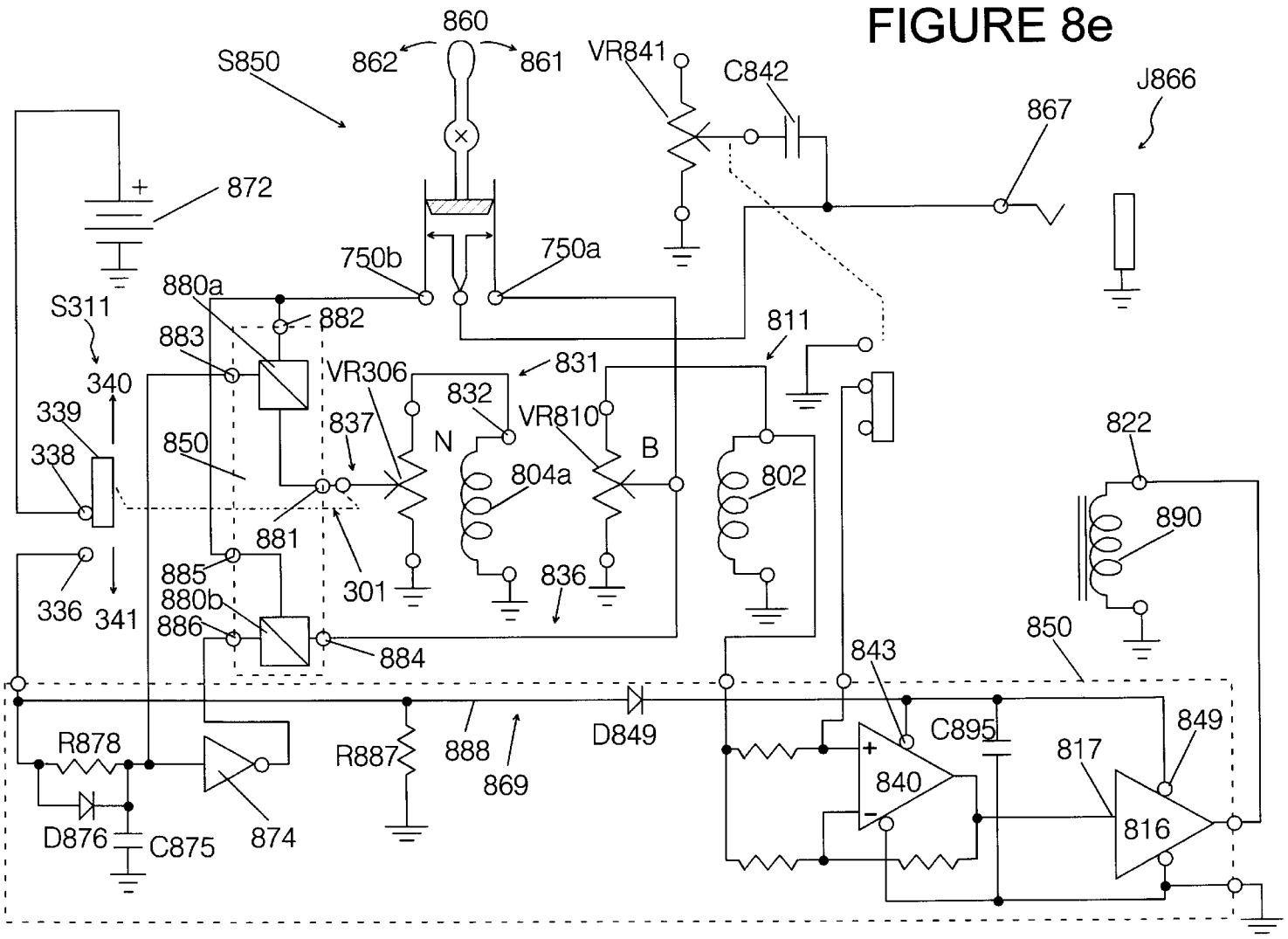
FIG. 8*e* Electrical schematic of guitar and sustainer of FIG. 8*c*, showing switch/potentiometer combination of FIG. 3, where the sustainer power switch and drive signal phase inversion switch are of SPST type, and pickup substitution switching function is accomplished by an electronic switch.

FIG. 8*e* shows the same guitar as FIG. 8*c* and FIG. 8*d*, which replaces combination switch/potentiometer 300 with another switch/potentiometer combination 301. Switch S311 comprises a single-pole, single-throw (SPST) switch. In this example, sustainer circuit 850 includes two analog switches, 880*a* and 880*b*, which are depicted as functional blocks. By placing the positive voltage of power supply 872 at control terminal 883 by closing power switch S311, analog switch 880*a* switches to an "on" condition, whereby a low resistance (approximately 100 ohms) exists between terminals 881 and 882. When control terminal 883 is connected to ground through resistor 888, a high resistance exists between terminals 881 and 882 (greater than ten megohms). Analog switch 880*b* functions in a similar manner. Terminal 886 is the control terminal of analog switch 880*b*. The terminals under control of terminal 886 are terminals 884 and 885.

When the sustainer is in the "off" condition, contactor 339 of switch S311 is in position 340, which leaves contacts 336 and 338 open. In this condition, the positive voltage supply line 888 of sustainer circuit 850 is grounded through resistor R887. This connects control terminal 886 of analog switch 880*b* to ground, and opens terminals 884 and 885. Therefore, bridge pickup volume-controlled output signal 836 is not connected to terminal 750*b* of pickup selector switch S850. Inverter logic gate 874 input is also grounded through resistors R887 and R870. This places positive power supply voltage at the output of inverter 874 at control terminal 883 (through R878), thereby connecting terminals 882 and 883 of analog switch 880*a* by low resistance. Therefore, neck pickup volume-controlled output signal 837 is connected to terminal 750*b* of pickup selector switch S850. Consequently, when pickup selector switch S850 is in neck pickup selected position 862 or 860, the neck pickup volume-controlled output signal 837 is connected to terminal 867 of output jack J866.

When the sustainer is switched on by placing sustainer power switch S311 in position 341, positive power supply voltage is applied to the sustainer through terminals 336 and 338 of sustainer power switch S311. Positive power supply voltage charges capacitor C875 quickly through forward-biased diode D876, quickly placing the input terminal of inverter 874 at positive supply potential. This quickly places control terminal 886 of analog switch 880*b* at positive supply potential. Therefore, terminals 884 and 885 are connected by low resistance, allowing bridge pickup volume-controlled output signal 836 to quickly reach pickup selector switch S850 terminal 750*b*. Concurrently, the output of inverter 874 quickly reaches ground potential, which places ground potential at control terminal 883 of analog switch 880*a*. This quickly removes neck pickup volume-controlled output signal 837 from terminal 750*b* of pickup selector switch S850 because of high resistance between analog switch terminals 882 and 883. Therefore, when the sustainer is switched "on", sustainer power switch S311 quickly substitutes volume-controlled bridge pickup signal 836 for volume-controlled neck pickup signal 837 whenever volume-controlled neck pickup signal 837 is selected by pickup selector switch S850.

When the sustainer is switched "off" by placing sustainer power switch S311 in position 340, sustainer power supply line 888 immediately reaches ground potential through R887, because voltage present on capacitor C895 is blocked from line 888 by reverse-biased diode D849. However, diode D876 is reversed biased by the voltage impressed upon capacitor C875, and therefore capacitor C875 discharges through resistor R870 at a rate determined by the resistance of resistor R870 and the capacitance of C875. When the voltage on C875 decreases to about one-half of the positive supply voltage, analog switch 880*b* will change state, causing the resistance between contacts 884 and 885 to switch from low resistance high resistance. This will disconnect bridge pickup signal 836 from contact 750*b* of pickup selector switch S750. At about the same time, the output of inverter 874 will change state from ground potential to the positive supply potential. This will cause analog switch 880*a* to change state, causing the resistance between contacts 882 and 883 to switch from high resistance to low resistance. This will connect neck pickup signal 837 to contact 750*b* of pickup selector switch S750. Therefore, when the sustainer is switched "off", sustainer power switch S311 reconnects volume-controlled neck pickup signal 837 for volume-controlled bridge pickup signal 836 whenever volume-controlled neck pickup signal 836 is selected by pickup selector switch S850. This reconnection occurs after a time delay determined by the RC time constant of resistor R870 and capacitor C875. This time constant is chosen by setting the RC time constant to be slightly greater than the discharge time of sustainer amplifier power supply capacitor C895.

In the example of FIG. 8*e*, according to a definition established previously, the volume-controlled bridge pickup signal 836 is the "first pickup signal", and the volume-controlled neck pickup signal 836 is the "second pickup signal". If sustainer transducer 890 was placed adjacent to bridge pickup 802 instead of to neck pickup 804*a*, then bridge pickup signal 836 would become "second pickup signal", and neck pickup signal 837 would become "first pickup signal". In this case, the timing of switching logic described for FIG. 8*e* would be reversed. The analog switch circuitry and logic circuitry described in FIG. 8*e* is readily available as inexpensive integrated circuits, such as the various CMOS logic circuits. The exact topology depicted in FIG. 8*e* could be replaced by other types of analog switching and logic circuitry, and would not negate the intent of the invention.

Figure 2A:
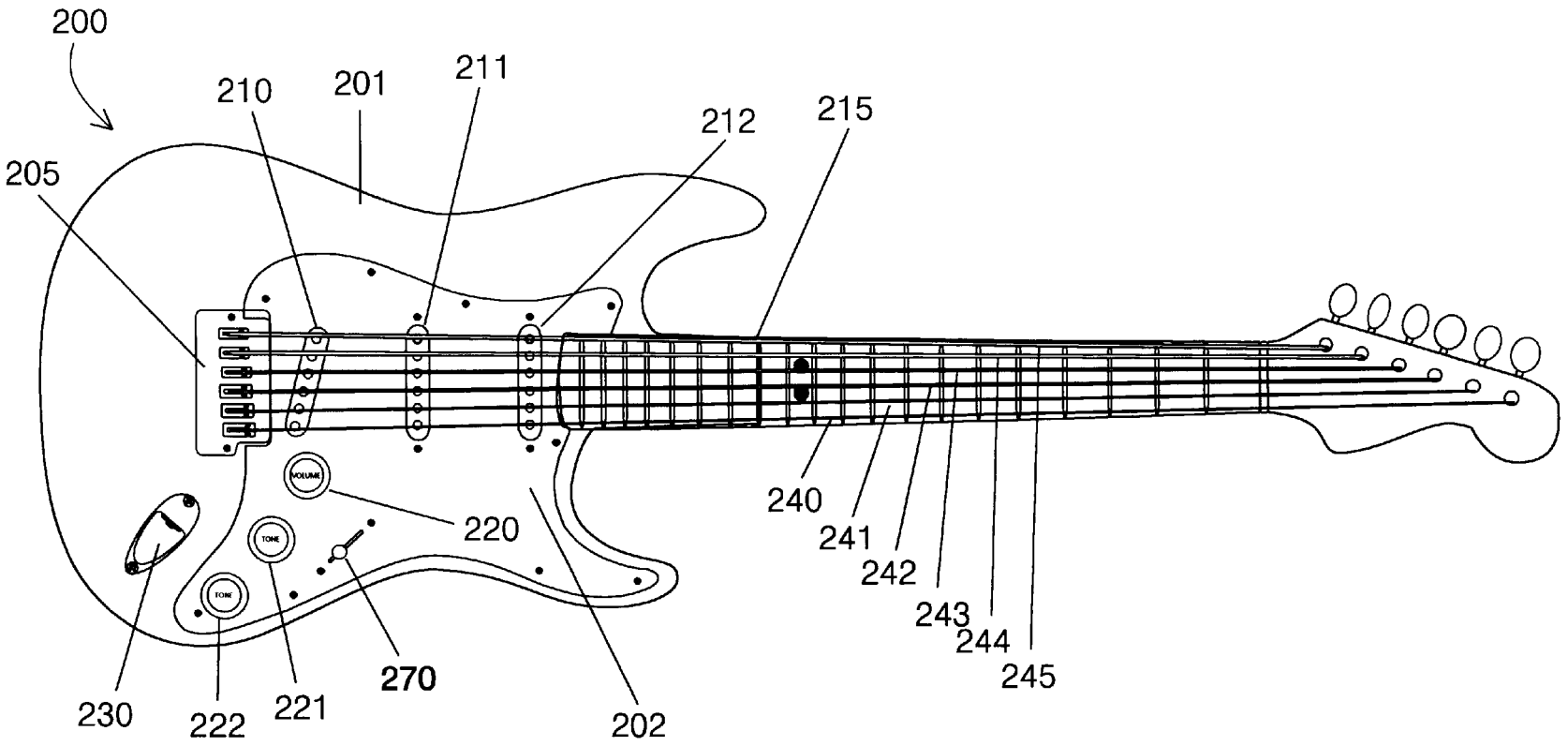
FIG. 2a PRIOR ART
FIG. 2*a* Prior Art electric guitar front plan view
Figure 2B:
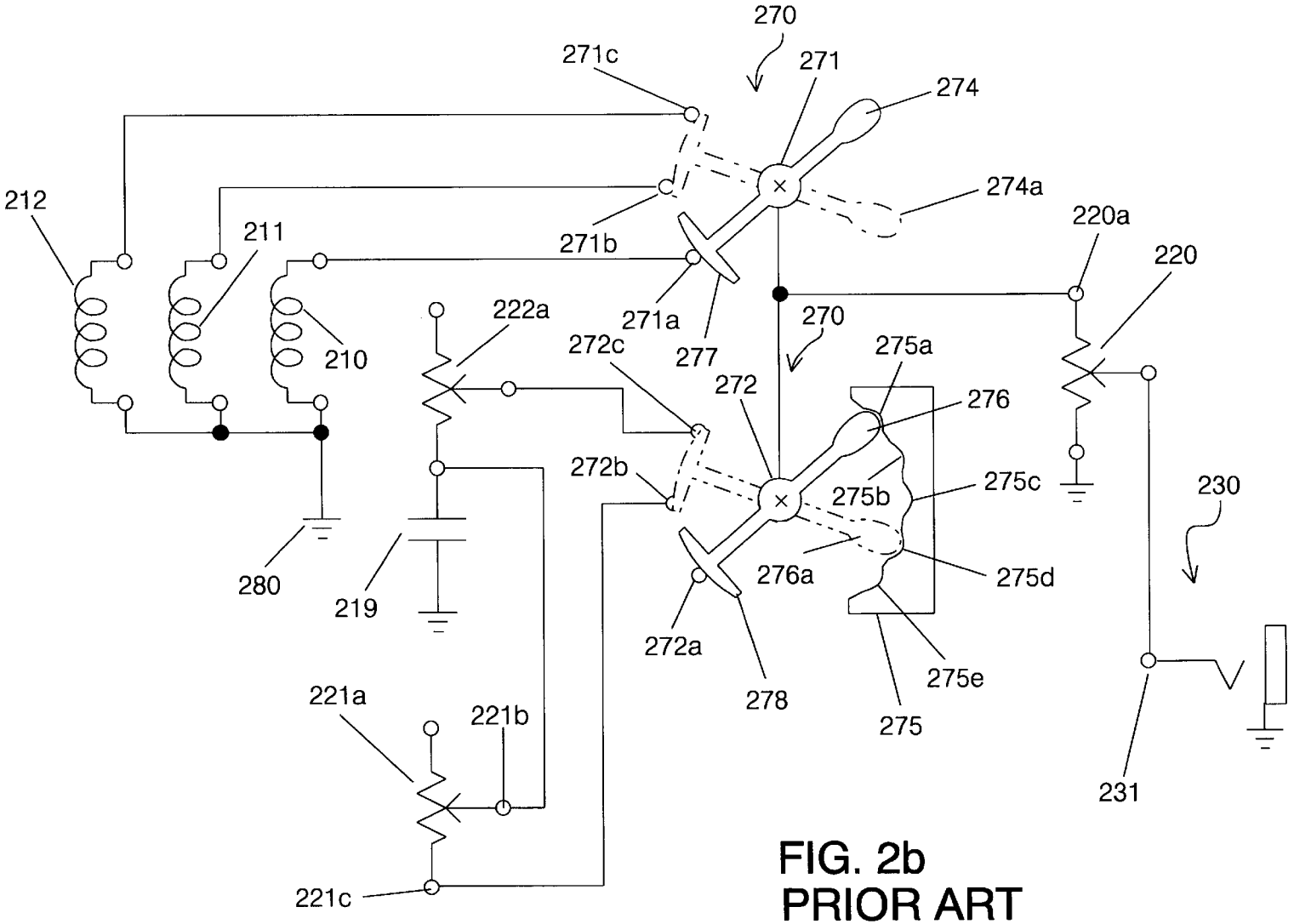
FIG. 2b PRIOR ART
FIG. 2*b* Prior Art electrical schematic of electric guitar
Figure 2C:
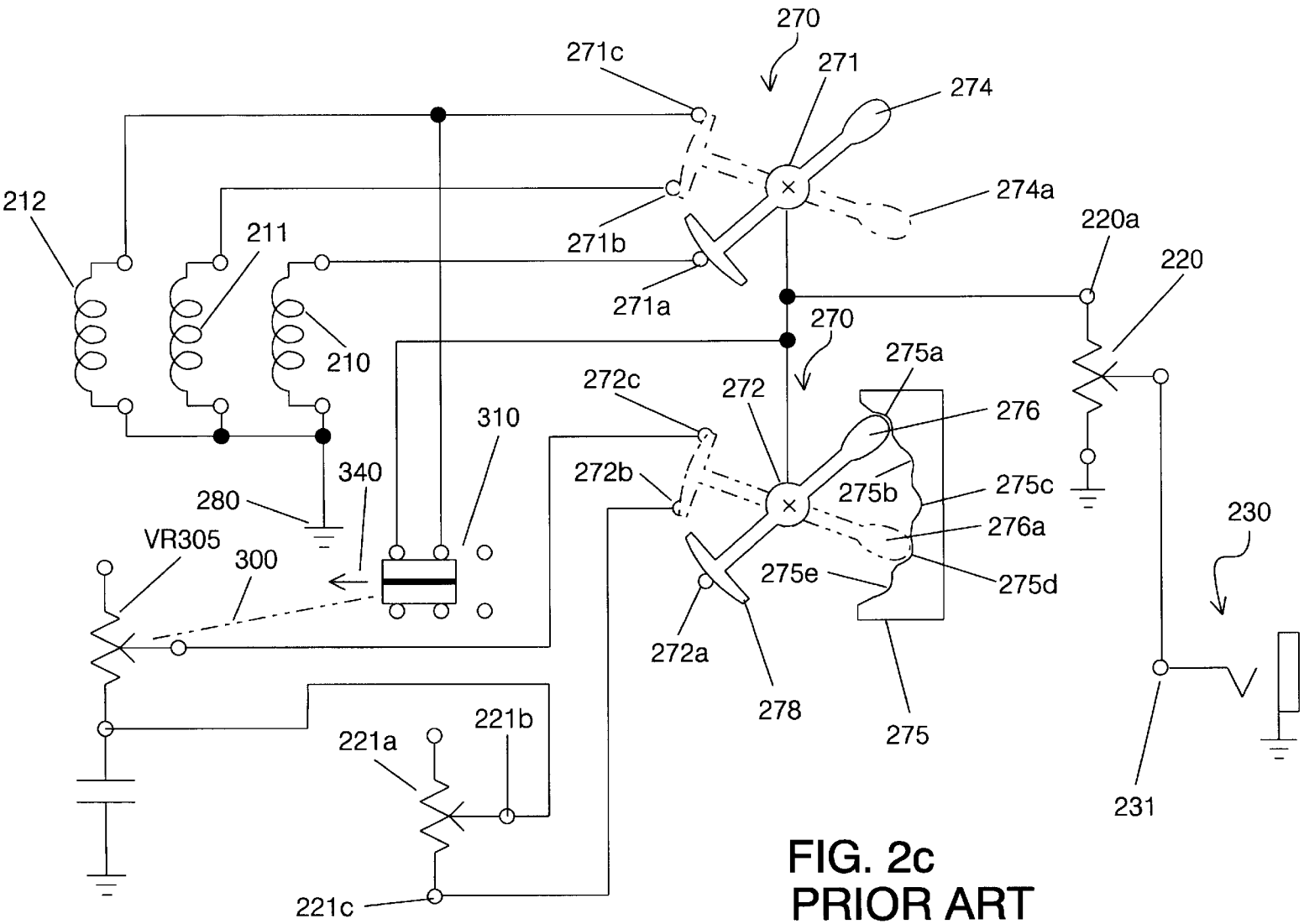
FIG. 2c PRIOR ART
FIG. 2*c* Prior Art electrical schematic of electric guitar showing modification with added pickup selector switch FIG. 2*d* Prior Art electrical schematic of electric guitar showing modification with added muting switch FIG. 3*a* Prior Art integral switch/potentiometer combination perspective view FIG. 3*b* Prior Art integral switch/potentiometer combination electrical schematic FIG. 3*c* Prior Art integral switch/potentiometer combination electrical schematic FIG. 3*d* Prior Art integral switch/potentiometer combination perspective view FIG. 4 Prior Art sustainer elements shown as electrical schematic/block diagram FIG. 5*a* Prior Art electric guitar front plan view FIG. 5*b* Prior Art electric guitar rear plan view FIG. 5*c* Prior Art electric guitar of FIGS. 5*a,b*, with prior art sustainer installed, front plan view FIG. 5*d* Prior Art electric guitar with prior art sustainer of FIG. 5*c*, rear plan view FIG. 5*e* Prior Art electric guitar of FIGS. 5*a,b,* electrical schematic FIG. 5*f* Electrical schematic of Prior Art sustainer of FIG. 5*c*
Figure 2D:
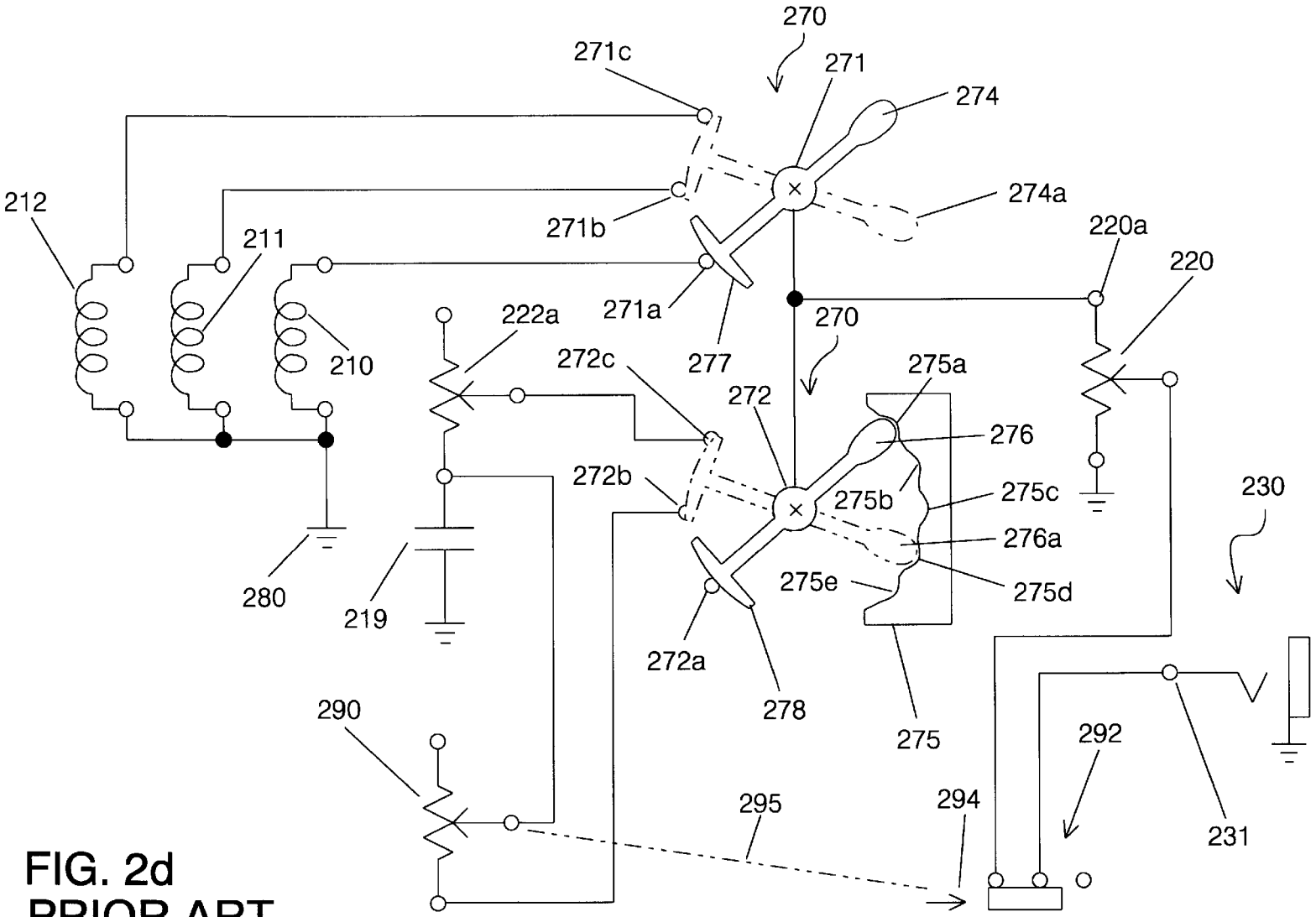
FIG. 2d PRIOR ART
Figure 9A:
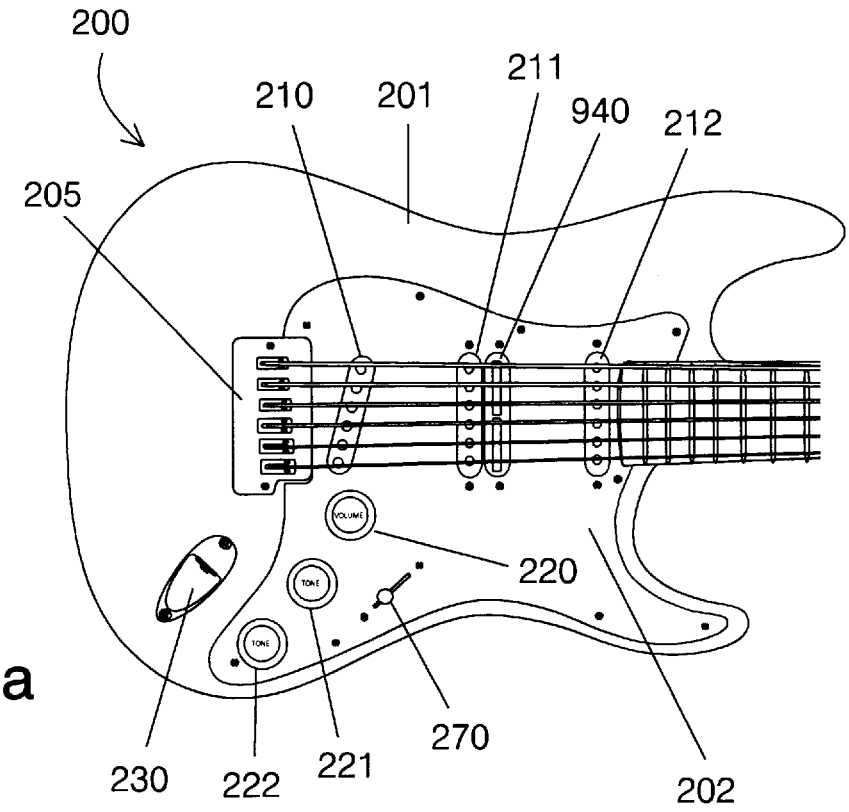
FIG. 9*a* Front plan view of guitar of FIG. 2*a* having a sustainer installed, with transducer adjacent to middle pickup FIG. 9*b* Electrical schematic of guitar of FIG. 9*a*, showing two control potentiometers replaced with integral switch/potentiometer combinations of FIG. 3, where neck pickup is a "first pickup".

FIG. 9*a* shows a front plan view of the prior art Fender "Stratocaster" guitar of FIG. 2*a*, after being modified with the installation of a sustainer. Magnetic transducer 940 is mounted in the space normally occupied by middle pickup 211. The middle pickup cavity of the instrument is enlarged to make room for middle pickup 211, which is moved over to make room for transducer 940. FIG. 9*b* shows the electrical schematic of the sustainer installation. Middle pickup tone control potentiometer 221 of FIG. 2*b* is replaced with integral potentiometer/switch combination 300, as shown in Prior Art FIG. 3. Potentiometer VR305 replaces potentiometer VR221*a* to adjust the tone of the pickup which is selected by the middle pickup position of pickup selector switch S270 (detent position 275*c*). Switch S310 functions as the on/off switch for the sustainer, and also provides automatic pickup substitution to prevent magnetic crosstalk between transducer 940 middle pickup 211, by substituting neck pickup 212 for middle pickup 211 when s310 is placed into position 341, which applies power from power supply 950 to sustainer amplifier 930 and mute circuit 922. Potentiometer VR905 of second integral potentiometer/switch combination 910 replaces original neck pickup tone control potentiometer VR222*a*. Switch S912 of integral potentiometer/switch combination 910 is used to invert the phase of the output of amplifier 920 (by grounding the noninverting terminal of amplifier 920) in order to change the harmonic mode of sustained string vibrations.

Figure 9C:
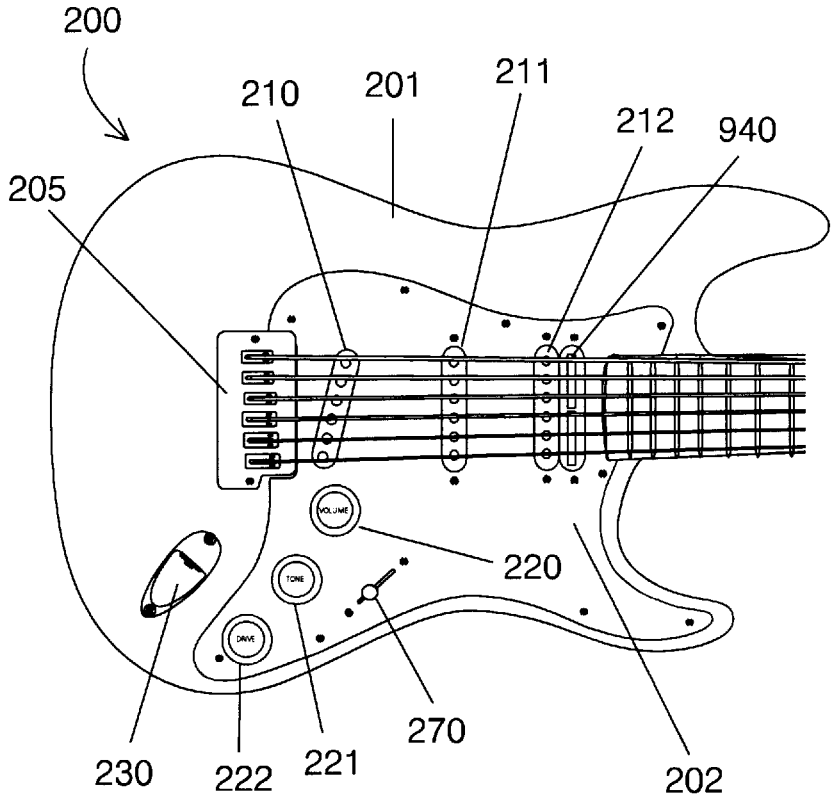
FIG. 9*c* Guitar of FIG. 9*a,* with transducer adjacent to neck pickup
Figure 9B:
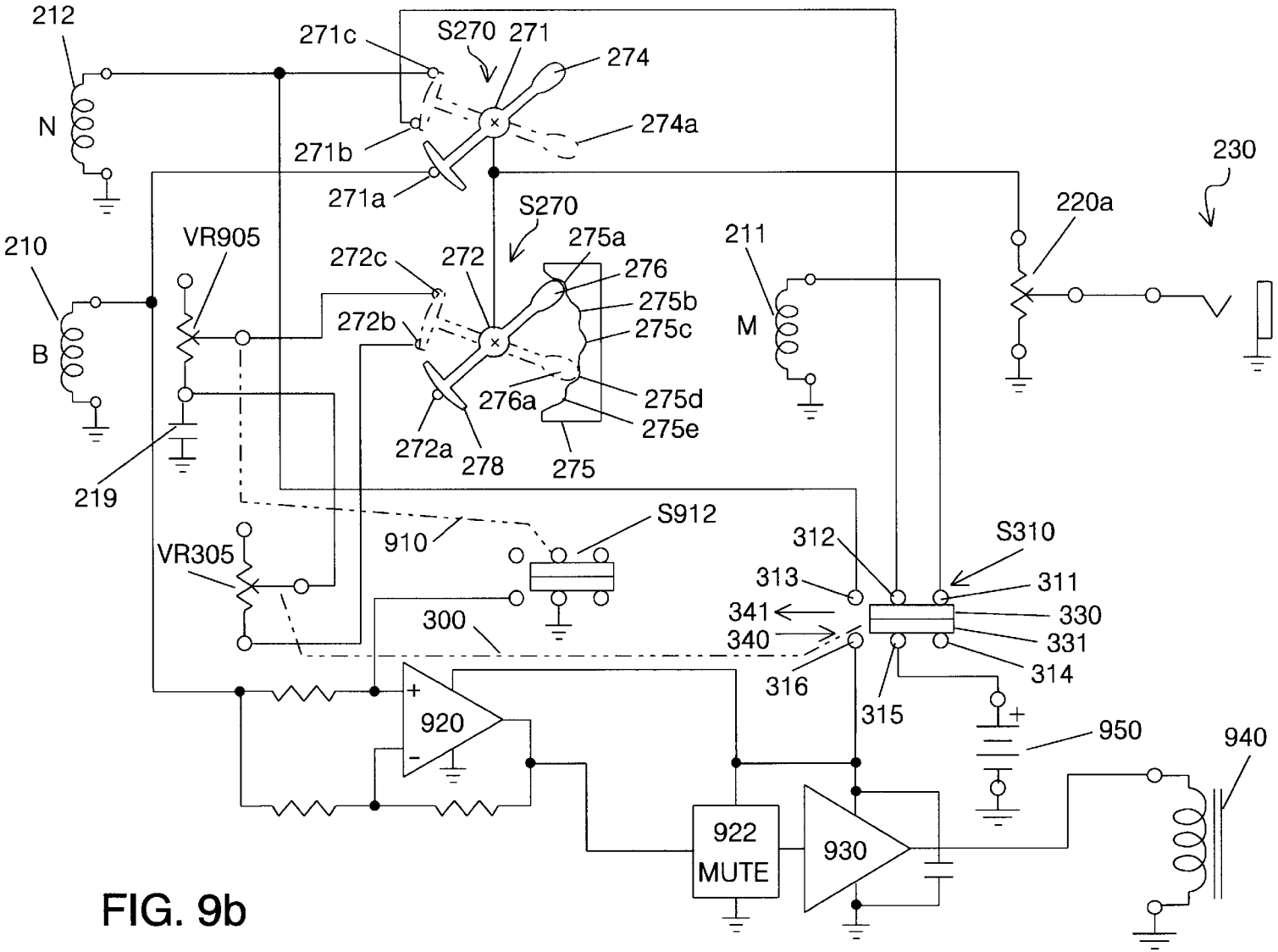
FIG. 9*d* Electrical schematic of guitar of FIG. b, showing two control potentiometers replaced with integral switch/potentiometer combinations of FIG. 3, where middle pickup is a "first pickup".
Figure 9D:
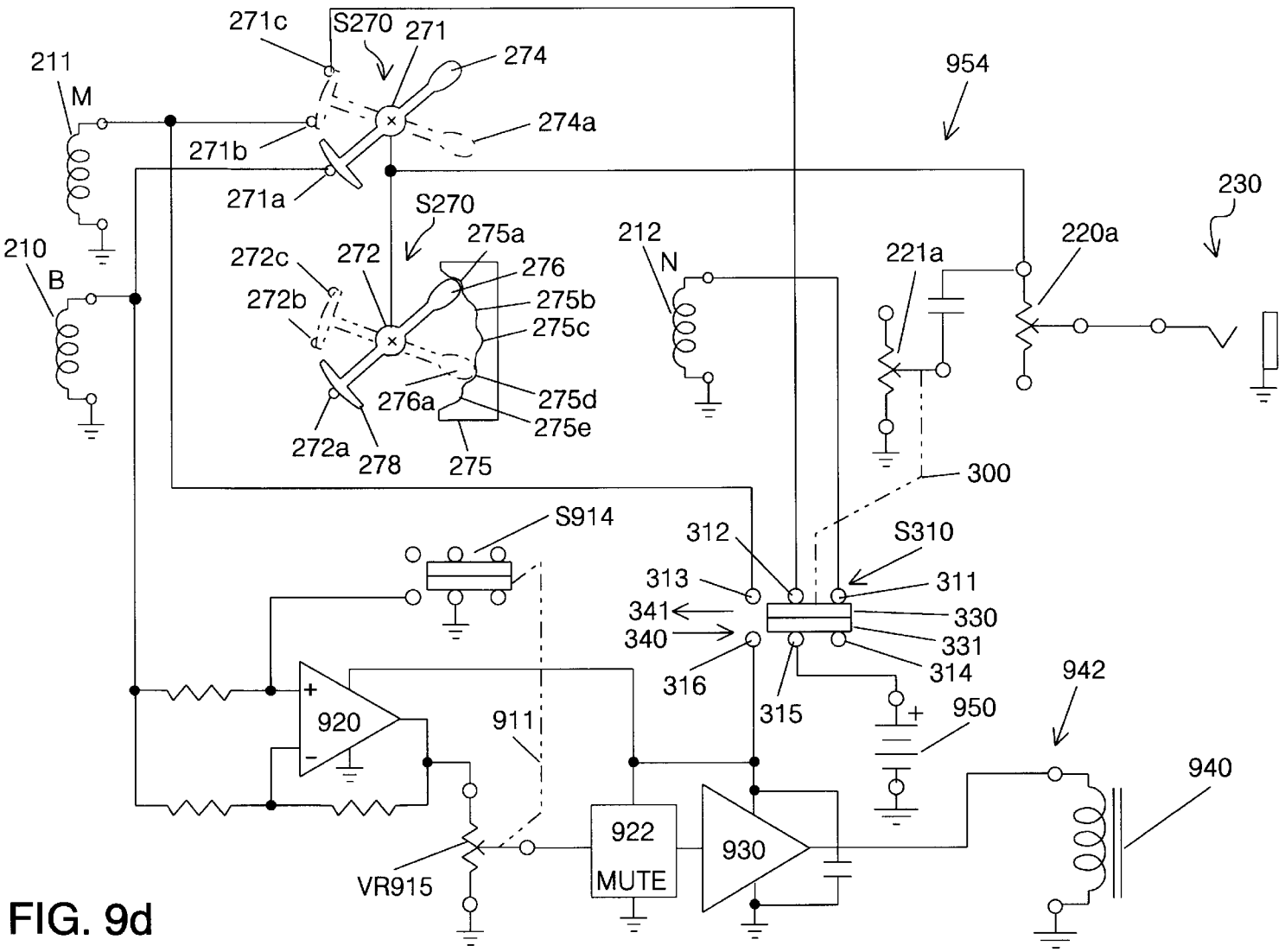

FIG. 9*c* shows a front plan view of the prior art Fender "Stratocaster" guitar of FIG. 2*a*, after being modified with another installation example of a sustainer. Magnetic transducer 940 is mounted in the space normally occupied by neck pickup 212. The neck pickup cavity of the instrument is enlarged to make room for neck pickup 212, which is moved over to make room for transducer 940. FIG. 9*d* shows the electrical schematic of the sustainer installation. Middle pickup tone control potentiometer 221 of FIG. 2*b* is replaced with integral potentiometer/switch combination 300, as shown in Prior Art FIG. 3. Separate tone controls for both middle pickup 211 and neck pickup 212 are relinquished in order to add a sustainer parameter adjustment. Potentiometer 305 adjusts the tone of the selected pickup output signal 954 in conjunction with capacitor 952. Switch S310 functions as the on/off switch for the sustainer, and also provides automatic pickup selection to prevent magnetic crosstalk from transducer 940 to neck pickup 212 when the sustainer is on. Potentiometer VR915 of second integral potentiometer/switch combination 911 replaces original neck pickup tone control potentiometer VR222*a*. VR915 is used instead to control the "drive" function, which is the amplitude of the drive signal 942, in order to control the vibration intensity of sustained string vibrations. Switch S914 of integral potentiometer/switch combination 911 is used to invert the phase of the output of amplifier 920 in order to change the harmonic mode of sustained string vibrations.

I claim:

1. A sustainer for an electric stringed musical instrument, wherein said electric stringed musical instrument comprises:

(a) one or more strings, wherein the vibrations of said strings produce the musical tones of said electric stringed musical instrument, (b) at least one pickup means responsive to said vibrations of said strings, wherein said at least one pickup means produces a pickup output signal in response to said string vibrations of said musical instrument, (c) at least one control potentiometer means, each said control potentiometer means used for varying a parameter of said pickup output signal, each said control potentiometer means having a rotary shaft means for varying the electrical resistance setting of said control potentiometer means, such that said pickup output signal parameter is varied by rotating said shaft means of said control potentiometer means, (d) an output terminal means for accepting said pickup output signal, such that said pickup output signal can be connected to an external instrument amplifier via said output terminal means for the purpose of producing audible tones corresponding to said vibrations of said strings, (e) an instrument body on which to mount said strings, said at least one pickup means, said at least one control potentiometer means, and said sustainer, wherein the function of said sustainer is to sustain the vibration of one or more strings of said instrument, wherein the function of said sustainer is to sustain the vibration of one or more strings of said instrument, and said sustainer comprises:

(f) a string driver transducer means capable of inducing vibrations in said strings, (g) a sustainer amplifier means comprising:

(1) an input means which accepts said pickup output signal, (2) amplifier means, which amplifies said pickup output signal to form a drive signal, (3) an output means, wherein said drive signal transfers sufficient energy to said string driver transducer means to sustain said vibrations of said strings, (h) a power supply means for providing electrical energy to said sustainer amplifier means, (i) a power switch means which provides connection and disconnection means between said power supply means and said sustainer amplifier means in response to actuation of said power switch means in order to turn said sustainer on and off, wherein said power switch means is an integral part of said control potentiometer means, whereby the appearance of said control potentiometer means having said power switch means as an integral part when viewed from the outside of said musical instrument is similar to that of said instrument containing said potentiometer without said power switch means being present as said integral part of said potentiometer.

2. A sustainer for an electric stringed musical instrument as claimed in claim 1, wherein said power switch means is a pull-on, push-off switch means, wherein actuation of said pull-on, push-off switch means is accomplished by pulling and pushing said rotary shaft means of said potentiometer means.

3. A sustainer for an electric stringed musical instrument as claimed in claim 1, wherein said power switch means is a push-on, push-off switch means, wherein actuation of said push-on, push-off switch is accomplished by pushing said rotary shaft means of said potentiometer means.

4. A sustainer for an electric stringed musical instrument as claimed in claim 1, wherein said power switch means is a rotate on, rotate off switch, wherein actuation of said rotate on, rotate off switch is accomplished by rotating said rotary shaft means of said potentiometer means.

5. A sustainer for an electric stringed musical instrument as claimed in claim 1, wherein said power switch means is a push-on momentary switch, wherein actuation of said push-on momentary switch means is accomplished by pushing said rotary shaft means of said potentiometer means.

6. A sustainer for an electric stringed musical instrument as claimed in claim 1, wherein said integral combination power switch means and potentiometer means are actuated by concentric shafts.

7. A sustainer for an electric stringed musical instrument as claimed in claim 1, wherein said stringed musical instrument further comprises at least a second control potentiometer means for varying a second parameter of said pickup output signal, wherein said second parameter of said pickup output signal is varied by rotating a rotary shaft means of said second control potentiometer means, wherein said sustainer also comprises a phase reversal switch means which provides phase reversal of said driver signal in response to actuation of said phase reversal switch means, wherein said phase reversal switch means is an integral part of said second output signal control potentiometer means, such that said phase reversal switch means is actuated by said shaft means of said second control potentiometer.

8. A sustainer for a stringed musical instrument as claimed in claim 7, wherein said phase reversal switch means is either said pull-on, push-off type or said push-on, push-off type.

9. A sustainer for a stringed musical instrument as claimed in claim 7, wherein said phase reversal switch means and potentiometer means are actuated by concentric shafts.

10. A sustainer for an electric stringed musical instrument as claimed in claim 1, wherein one of said musical instrument control potentiometer means is replaced by a sustainer control potentiometer means, whereby the original external appearance of said electric stringed musical instrument is not substantially changed by said replacement.

11. The sustainer of claim 10, wherein said parameter of said drive signal is amplitude.

12. The sustainer of claim 10, wherein said parameter of said drive signal is phase shift as a function of frequency.

13. A sustainer for an electric stringed musical instrument, wherein said electric stringed musical instrument comprises:

(a) a first pickup means responsive to the vibrations of one or more strings, wherein said first pickup means produces a first pickup output signal in response to said string vibrations of said instrument, wherein said first pickup output signal is split into two branches, a first branch being a first pickup instrument output signal, and a second branch being a sustainer input signal, (b) a second pickup means responsive to said vibrations of said strings, wherein said second pickup means produces a second pickup output signal in response to said string vibrations of said instrument, (c) a pickup selector switch means for selecting either said first pickup instrument output signal or said second pickup output signal or a combination of both said first pickup instrument output signal and said second pickup output signal, wherein selected said first pickup instrument output signal or selected said second pickup output signal or selected said combination of both said first pickup instrument output signal and said second pickup output signal comprises a selected pickup output signal, (d) at least one control potentiometer means having a control shaft means for varying a parameter of said selected pickup output signal, or for varying a parameter of said first pickup instrument output signal or for varying a parameter of said second pickup output signal, such that said parameter is varied by rotating said shaft means of said control potentiometer means, (e) an output terminal means for accepting said selected pickup output signal or said first pickup output signal, such that said selected pickup output signal or said first pickup output signal can be connected to an external instrument amplifier via said output terminal means for the purpose of producing audible tones corresponding to said vibrations of said musical instrument strings;

wherein the function of said sustainer is to sustain the vibration of one or more strings of said instrument, and said sustainer comprises:

(f) a string driver means capable of inducing vibrations in said one or more strings, (g) a sustainer amplifier means which amplifies said pickup output signal to form a drive signal that transfers sufficient energy to said string driver means to sustain said vibrations of said strings;

(h) a power supply means for providing electrical energy to said sustainer amplifier means, wherein said power supply means contains an energy storage capacitor which is charged to the output voltage of said power supply, (i) a sustainer power switch means which provides:

(1) connection and disconnection means between said power supply means and said sustainer amplifier means in response to actuation of said power switch means in order to turn said sustainer on and off, (2) substitution means for substituting said first pickup instrument output signal for said selected pickup output signal when said sustainer is turned on, regardless of which said pickup output signal is selected by said pickup selector switch means when said sustainer is turned off, wherein said sustainer power switch means is an integral part of one of said instrument control potentiometer means, whereby the appearance of said control potentiometer means having said power switch means as an integral part when viewed from the outside of said musical instrument is similar to that of said instrument containing said potentiometer without said power switch means being present as said integral part of said potentiometer.

14. The sustainer of claim 13, comprising additionally:

(a) a mute circuit means which mutes said drive signal, wherein said mute circuit means responds to a mute control signal, said mute circuit control signal being present when said power switch means disconnects said power supply and said sustainer amplifier means, wherein (b) said mute circuit control signal remains present for sufficient time to allow said energy storage capacitor of said power supply to discharge sufficiently for said sustainer amplifier circuit to cease functioning.

15. The sustainer of claim 13, wherein said sustainer additionally comprises a potentiometer means for controlling a parameter of said drive signal, and where said potentiometer means for controlling a parameter of said drive signal replaces one of said control potentiometer means for controlling a parameter of said selected pickup output signal, or for varying a parameter of said first pickup instrument output signal or for varying a parameter of said second pickup output signal, wherein said sustainer power switch means is an integral part of one of said instrument control potentiometer means, whereby said sustainer power switch means is not visible from the front of the instrument.

16. The sustainer of claim 13, wherein said power switch means is a double pole, double throw type, wherein (a) a first pole of said double pole, double throw power switch means provides said connection and disconnection means between said power supply means and said sustainer amplifier means in response to actuation of said double pole, double throw power switch means, and wherein (b) a second pole of said double pole, double throw power switch means provides substitution means for substituting said first pickup instrument output signal for said selected pickup output signal when said sustainer is turned on, regardless of which said pickup output signal is selected by said pickup selector switch means when said sustainer is turned off.

17. The sustainer of claim 16, wherein said double pole, double throw power switch means is either a pull-push, push-push, momentary-push, or is of concentric-shaft type.

18. The sustainer of claim 13, wherein said connection and disconnection means between said power supply means and said sustainer amplifier means in response to actuation of said power switch means in order to turn said sustainer on and off comprises a single pole, single throw switch means, and wherein said substitution means for substituting said first pickup instrument output signal for said selected pickup output signal when said sustainer is turned on, regardless of which said pickup output signal is selected by said pickup selector switch means when said sustainer is turned off, comprises an electronic switch circuit means which responds to said connection and disconnection means between said power supply means and said sustainer amplifier means.

19. The sustainer of claim 13, wherein said electric stringed musical instrument comprises additionally:

(a) a third pickup means responsive to said vibrations of said strings, wherein said third pickup means produces a corresponding third pickup output signal in response to said string vibrations of said instrument, wherein (b) said pickup selector switch means comprises means for selecting either said first pickup means output signal or said second pickup means output signal or said third pickup means output signal, or a combination of said first pickup means output signal and said second pickup means output signal.

20. A sustainer for an electric stringed musical instrument, wherein said electric stringed musical instrument comprises:

(a) one or more strings, wherein the vibrations of said strings produce the musical tones of said electric stringed musical instrument, (b) at least one pickup means responsive to said vibrations of said strings, wherein said at least one pickup means produces a pickup output signal in response to said string vibrations of said musical instrument, (c) at least one control potentiometer means, each said control potentiometer means used for varying a parameter of said pickup output signal, each said control potentiometer means having a rotary shaft means for varying the electrical resistance setting of said control potentiometer means, such that said pickup output signal parameter is varied by rotating said shaft means of said control potentiometer means, (d) an output terminal for accepting said pickup output signal, such that said pickup output signal can be connected to an external instrument amplifier via said output terminal for the purpose of producing audible tones corresponding to said vibrations of said strings, (e) an instrument body, on which to mount said strings, said at least one pickup means, said at least one control potentiometer means, and said sustainer means, wherein the function of said sustainer is to sustain the vibration of one or more strings of said instrument, wherein the function of said sustainer is to sustain the vibration of one or more strings of said instrument, and said sustainer comprises:

(f) a string driver transducer means capable of inducing vibrations in said strings, (g) a sustainer amplifier means comprising:

(1) an input means which accepts said pickup output signal, (2) amplifier means, which amplifies said pickup output signal to form a drive signal, (3) an output means, wherein said drive signal transfers sufficient energy to said string driver transducer means to sustain said vibrations of said strings, (h) at least control potentiometer means for varying the at least one parameter of said sustainer drive signal, (i) a power supply means for providing electrical energy to said sustainer amplifier means, (j) a power switch means which provides connection and disconnection means between said power supply means and said sustainer amplifier means in response to actuation of said power switch means, wherein said power switch means is an integral part of either said instrument control potentiometer means or said sustainer control potentiometer means, whereby said sustainer power switch means is not visible from the exterior of the instrument.

21. The sustainer of claim 20, wherein said at least one potentiometer means for varying said at least one parameter of said drive signal replaces a corresponding number of said control potentiometer means used for varying a parameter of said pickup output signal, whereby replacement of said control potentiometer means used for varying a parameter of said pickup output signal with said potentiometer means for varying the at least one parameter of said drive signal does not substantially change the original external appearance of said electric stringed musical instrument.

22. The sustainer of claim 20, wherein said at least one potentiometer means for varying said at least one parameter of said drive signal controls the amplitude of said drive signal.

23. The sustainer of claim 20, wherein said at least one potentiometer means for varying said at least one parameter of said drive signal controls the frequency response of said drive signal.

24. The sustainer of claim 20, wherein said at least one potentiometer means for varying said at least one parameter of said drive signal controls the phase response of said drive signal.

* * * * *